US007583257B2

(12) United States Patent
Kimura

(10) Patent No.: US 7,583,257 B2
(45) **Date of Patent: *Sep. 1, 2009**

(54) SIGNAL LINE DRIVING CIRCUIT AND LIGHT EMITTING DEVICE

(75) Inventor: Hajime Kimura, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 517 days.

This patent is subject to a terminal disclaimer.

(21) Appl. No.: 11/221,770

(22) Filed: Sep. 9, 2005

(65) Prior Publication Data

US 2006/0028413 A1 Feb. 9, 2006

Related U.S. Application Data

(62) Division of application No. 10/283,368, filed on Oct. 30, 2002, now Pat. No. 6,963,336.

(30) Foreign Application Priority Data

Oct. 31, 2001 (JP) ..... 2001-335918
Sep. 30, 2002 (JP) ..... 2002-287948

(51) Int. Cl.
*G09G 5/00* (2006.01)

(52) U.S. Cl. ..... 345/204; 345/76; 345/82

(58) Field of Classification Search ..... 345/55, 345/76–84, 87–100, 204, 211; 315/169.1–169.3
See application file for complete search history.

(56) References Cited

U.S. PATENT DOCUMENTS 4,967,140 A 10/1990 Groeneveld et al.
5,783,952 A 7/1998 Kazazian
6,091,203 A 7/2000 Kawashima et al.
6,222,357 B1 4/2001 Sakuragi
6,229,506 B1 5/2001 Dawson et al.

(Continued)

FOREIGN PATENT DOCUMENTS

EP 0359315 3/1990

(Continued)

OTHER PUBLICATIONS

International Preliminary Examination Report dated Oct. 14, 2004 for PCT/JP2002/011279.

(Continued)

*Primary Examiner*—Regina Liang
(74) *Attorney, Agent, or Firm*—Eric J. Robinson; Robinson Intellectual Property Law Office, P.C.

(57) ABSTRACT

Variations occur in the characteristics of transistors. The present invention is a signal-line drive circuit comprising first and second current source circuits corresponding to respective plurality of signal lines, a shift register, and n (n is a natural number of one or more) video-signal constant current source s, wherein each of the first and second current source circuits has a capacitance means and a supply means. The capacitance means held in one of the first and second source circuits converts a current including a current supplied from each of the n video-signal constant current source s to voltage in response to a sampling pulse supplied from the shift register and a latch pulse supplied from the exterior; and the supply means held in the other supplies a current responsive to the converted voltage. The values of the currents supplied from the n video-signal constant current source s are set to a proportion of $2^0:2^1:\ldots:2^n$.

32 Claims, 46 Drawing Sheets

U.S. PATENT DOCUMENTS

| | | | | |
|---|---|---|---|---|
| 6,310,589 | B1 | 10/2001 | Nishigaki et al. | |
| 6,344,843 | B1 | 2/2002 | Koyama et al. | |
| 6,373,454 | B1 | 4/2002 | Knapp et al. | |
| 6,473,064 | B1 | 10/2002 | Tsuchida et al. | |
| 6,498,438 | B1 | 12/2002 | Edwards | |
| 6,765,560 | B1 | 7/2004 | Ozawa | |
| 6,859,193 | B1 | 2/2005 | Yumoto | |
| 6,963,336 | B2 * | 11/2005 | Kimura | 345/204 |
| 7,015,882 | B2 | 3/2006 | Yumoto | |
| 7,193,591 | B2 | 3/2007 | Yumoto | |
| 7,379,039 | B2 | 5/2008 | Yumoto | |
| 7,388,564 | B2 | 6/2008 | Yumoto | |
| 2001/0048410 | A1 | 12/2001 | Nishigaki et al. | |
| 2002/0057244 | A1 | 5/2002 | Koyama et al. | |
| 2002/0135309 | A1 | 9/2002 | Okuda | |
| 2003/0048669 | A1 | 3/2003 | Abe | |
| 2003/0128199 | A1 | 7/2003 | Kimura | |
| 2003/0128200 | A1 | 7/2003 | Yumoto | |
| 2003/0156102 | A1 | 8/2003 | Kimura | |
| 2003/0169250 | A1 | 9/2003 | Kimura | |
| 2004/0085029 | A1 | 5/2004 | Kimura | |
| 2006/0119552 | A1 | 6/2006 | Yumoto | |

FOREIGN PATENT DOCUMENTS

| | | |
|---|---|---|
| EP | 1039440 | 9/2000 |
| EP | 1 063 630 | 12/2000 |
| EP | 1 102 234 | 5/2001 |
| EP | 1130565 | 9/2001 |
| EP | 1333422 | 8/2003 |
| JP | 62-122488 | 8/1987 |
| JP | 02-105907 | 4/1990 |
| JP | 05-042488 | 10/1993 |
| JP | 06-118913 | 4/1994 |
| JP | 08-095522 | 4/1996 |
| JP | 08-101669 | 4/1996 |
| JP | 08-106075 | 4/1996 |
| JP | 09-244590 | 9/1997 |
| JP | 10-312173 | 11/1998 |
| JP | 11-045071 | 2/1999 |
| JP | 11-231834 | 8/1999 |
| JP | 11-282419 | 10/1999 |
| JP | 2000-039926 | 2/2000 |
| JP | 2000-081920 | 3/2000 |
| JP | 2000-105574 | 4/2000 |
| JP | 2000-122607 | 4/2000 |
| JP | 2000-122608 | 4/2000 |
| JP | 2001-034221 | 2/2001 |
| JP | 2001-042822 | 2/2001 |
| JP | 2001-056667 | 2/2001 |
| JP | 2001-147659 | 5/2001 |
| JP | 2001-290469 | 10/2001 |
| JP | 2001-005426 | 1/2002 |
| JP | 2002-514320 | 5/2002 |
| JP | 2002-517806 | 6/2002 |
| JP | 2002-215095 | 7/2002 |
| JP | 2002-278497 | 9/2002 |
| JP | 2003-150112 | 5/2003 |
| JP | 2003-195812 | 7/2003 |
| JP | 2003-195815 | 7/2003 |
| KR | 2001-085788 | 9/2001 |
| WO | WO-98/11554 | 3/1998 |
| WO | WO 98/48403 | 10/1998 |
| WO | WO 99/65011 | 12/1999 |
| WO | WO-01/06484 | 1/2001 |
| WO | WO-01/26088 | 4/2001 |
| WO | WO 02/39420 | 5/2002 |

OTHER PUBLICATIONS

Reiji Hattori et al., "Analog-Circuit Simulation of the Current-Programmed Active-Matrix Pixel Electrode Circuits Based on Poly-Si TFT for Organic Light-Emitting Displays," The Japan Society of Applied Physics, AM-LCD '01, Jul. 11-13, 2001, pp. 223-226.

Reiji Hattori et al., *Circuit Simulation of Poly-Si TFT Based Current-Writing Active-Matrix Organic LED Display*, The Institute of Electronics, Information and Communication Engineers, Technical Report of IEICE, ED2001-8, SDM2001-8 (Apr. 2001), pp. 7-14.

Abe et al., 16-1: *A Poly-Si TFT 6-Bit Current Data Driver for Active Matrix Organic Light Emitting Diode Displays*, Eurodisplay 2002, pp. 279-282.

Hattori, *Data-Line Driver Circuits for Current Programmed Active-Matrix OLED Based on Poly-Si TFTs*, AM-LCD '02, pp. 17-20.

Yumoto et al., *Pixel-Driving Methods for Large-Sized Poly-Si AM-OLED Displays*, Asia Display/IDW '01, pp. 1395-1398.

Office Action (Korean Patent Application No. 2004-7006165), Dec. 18, 2008.

Supplimentary European Search Report (Application No. 02775443.1) Dated Feb. 9, 2009.

* cited by examiner

PRIOR ART
Fig. 17A signal input time
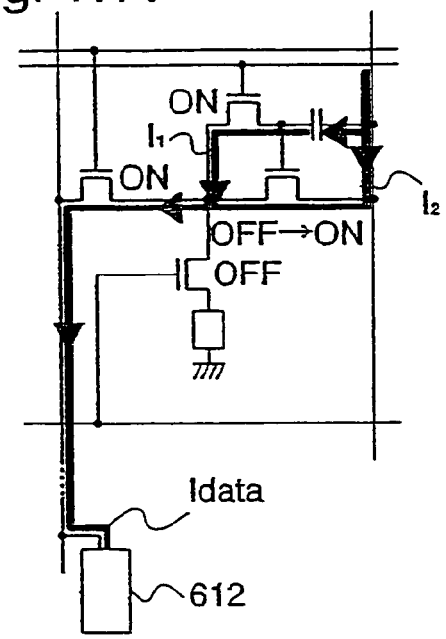
PRIOR ART
Fig. 17B signal input complete time
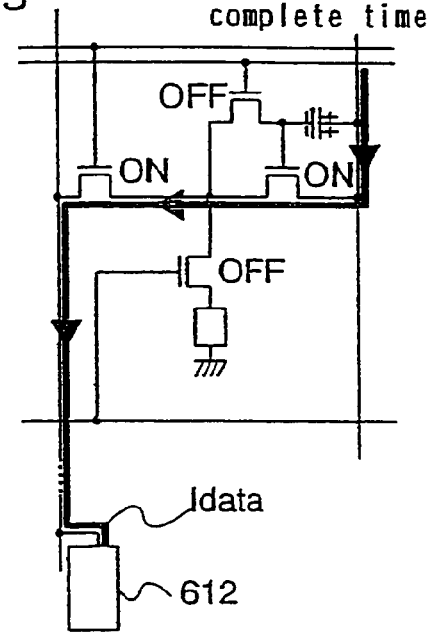
PRIOR ART
Fig. 17C light emitting time
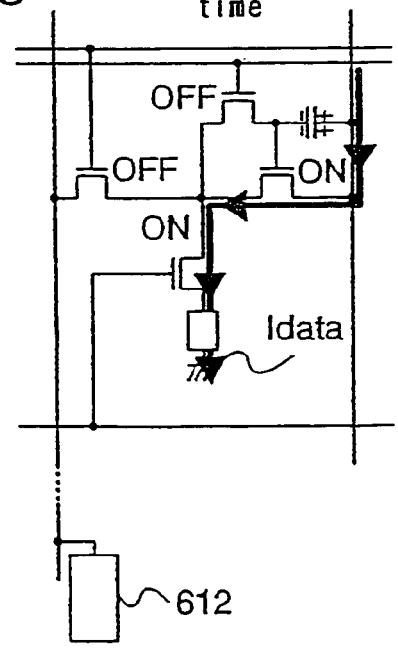
Fig. 17D PRIOR ART
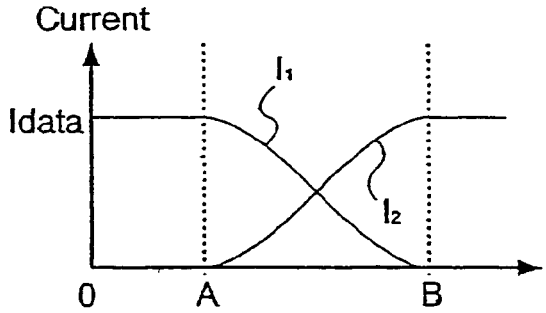
Fig. 17E
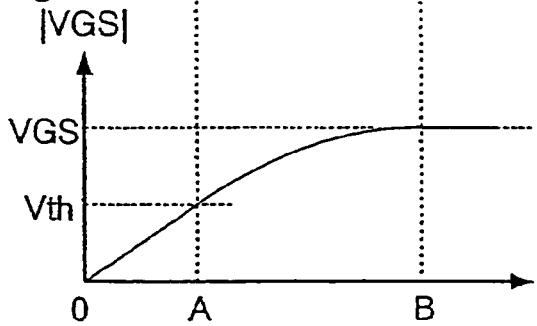
PRIOR ART Fig. 20A signal input time
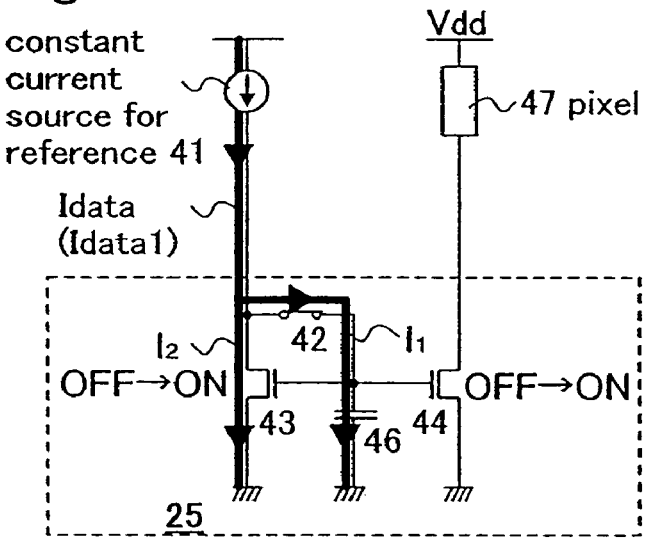
Fig. 20B signal input complete time
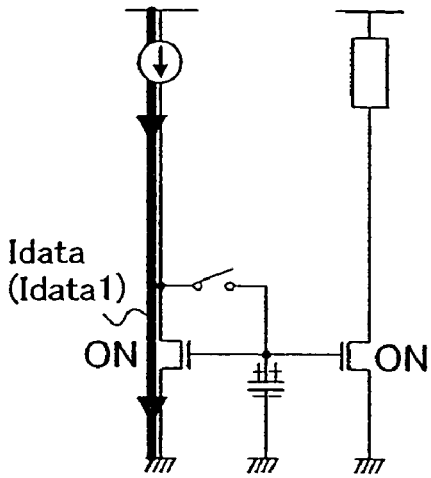
Fig. 20C signal input time to pixel
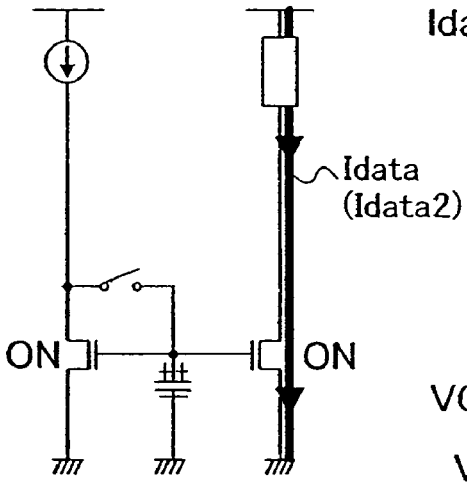
Fig. 20D
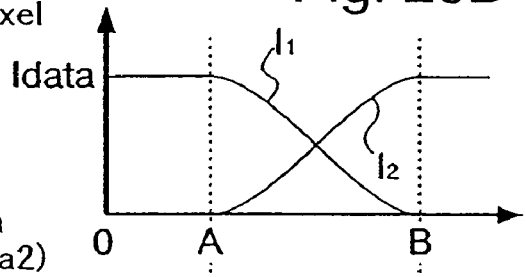
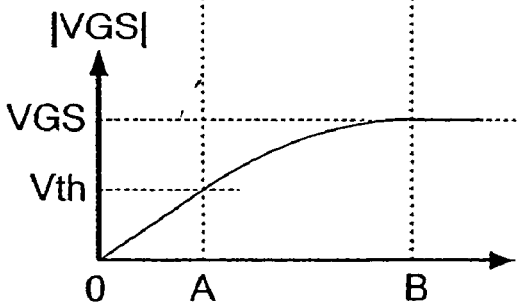
Fig. 20E Fig. 27A1
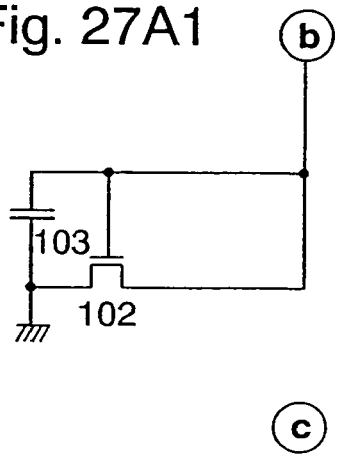
Fig. 27A2
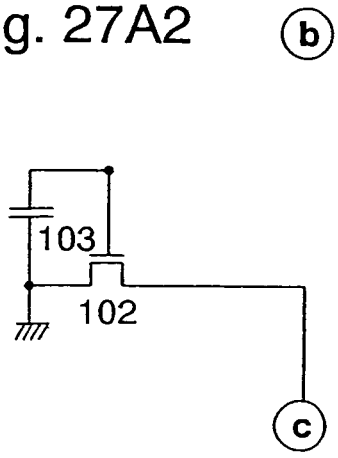
Fig. 27B1
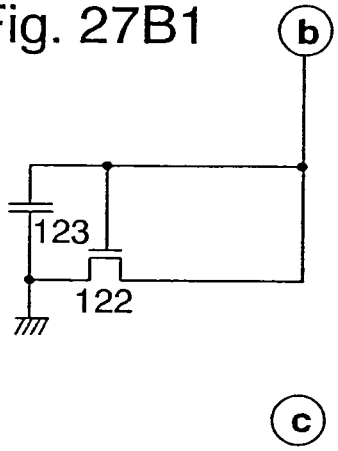
Fig. 27B2
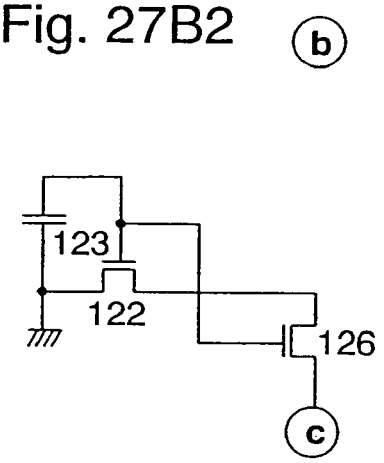
Fig. 27C1
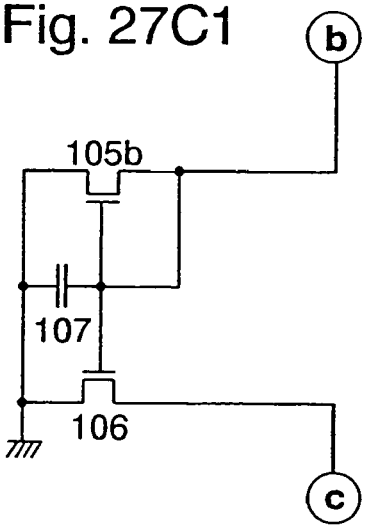
Fig. 27C2
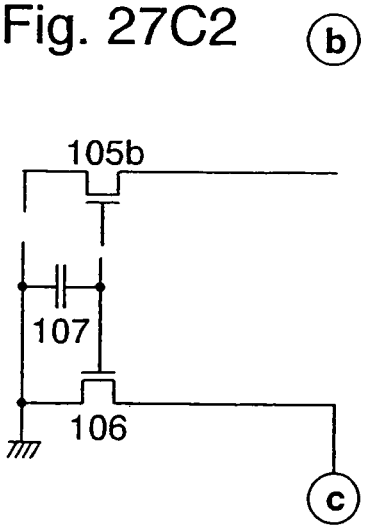

Fig. 28A
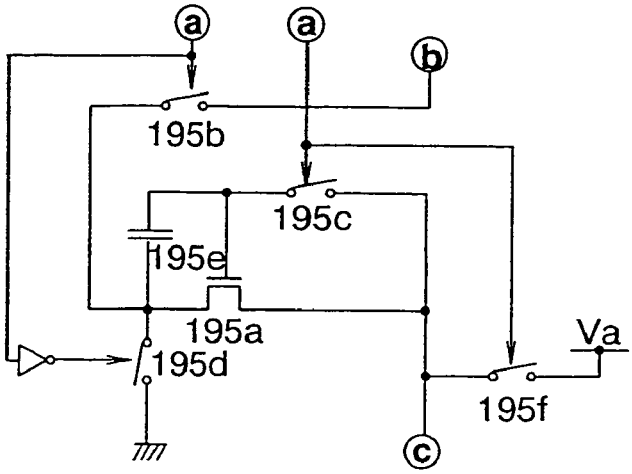
Fig. 28B1
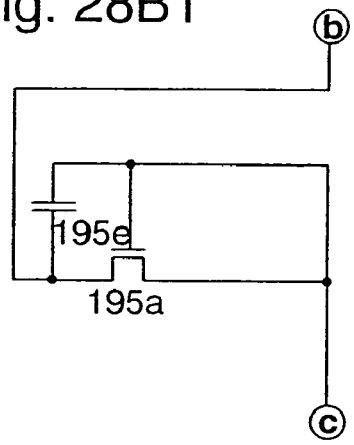
Fig. 28B2
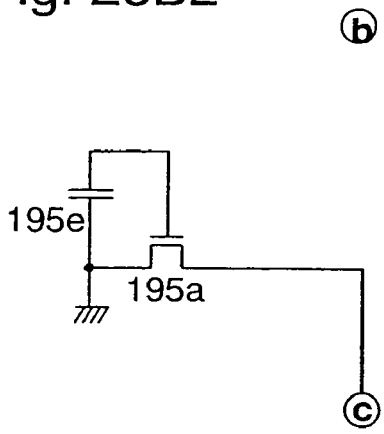
Fig. 28C1
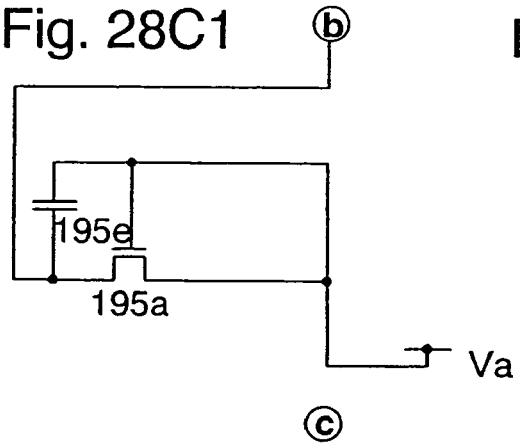
Fig. 28C2
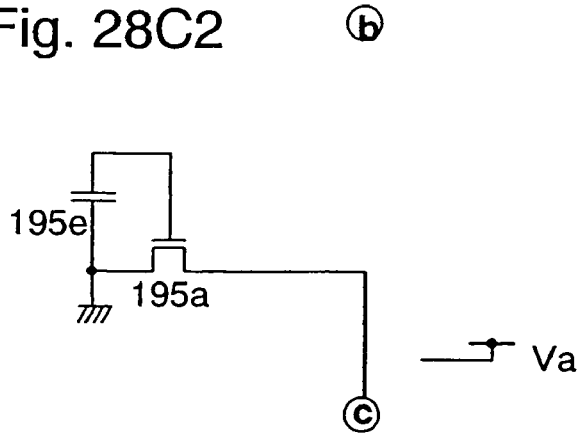

Fig. 30A1
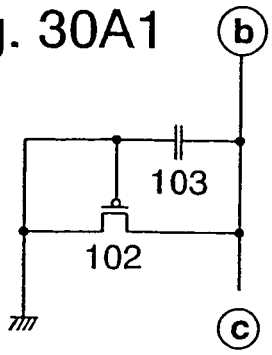
Fig. 30A2
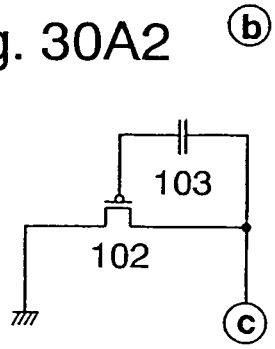
Fig. 30B1
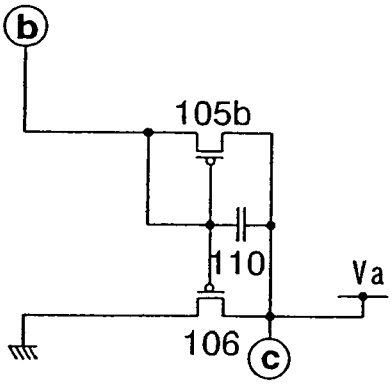
Fig. 30B2
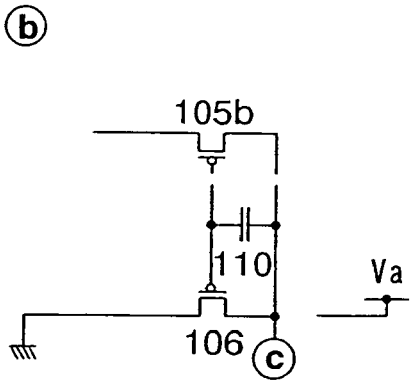
Fig. 30C1
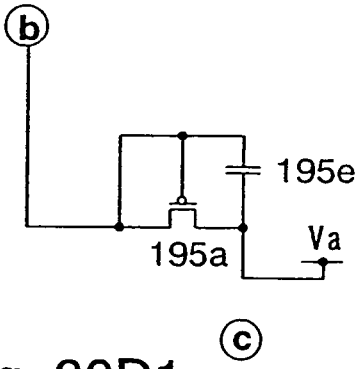
Fig. 30C2
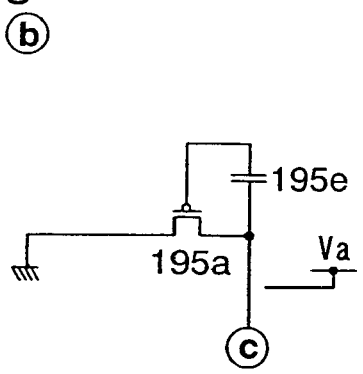
Fig. 30D1
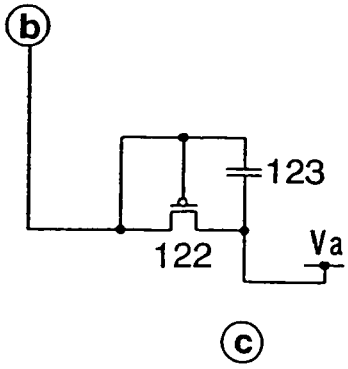
Fig. 30D2
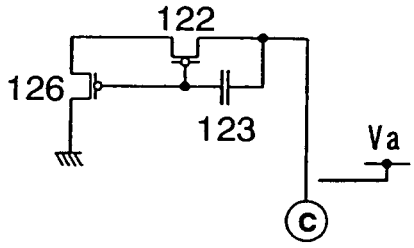

Fig. 31A
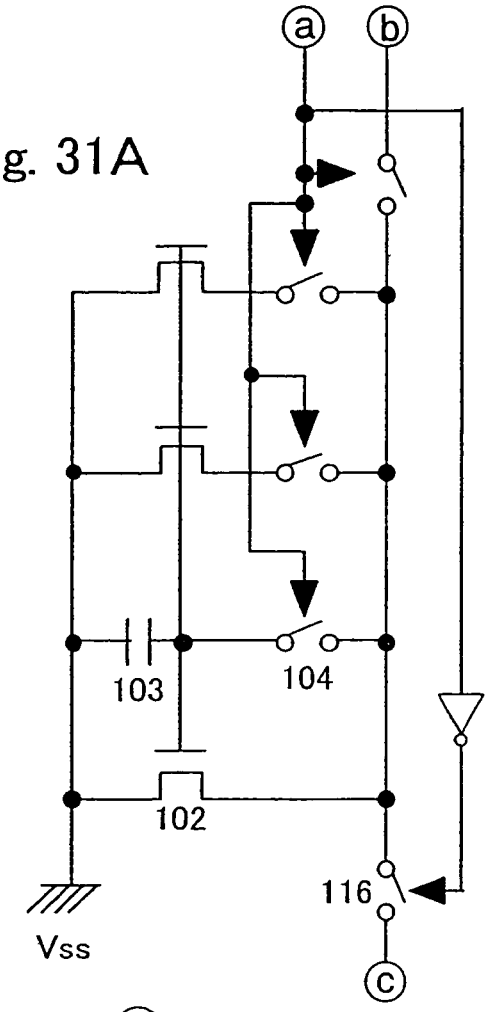
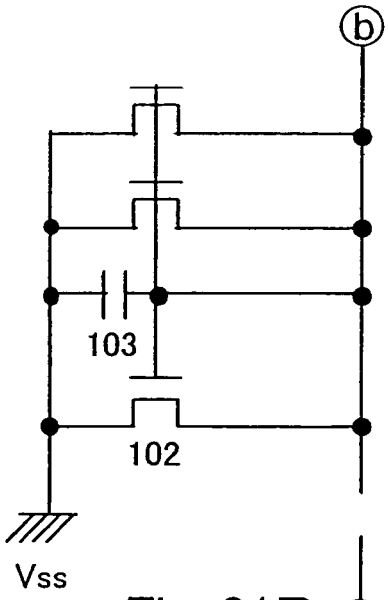
Fig. 31B
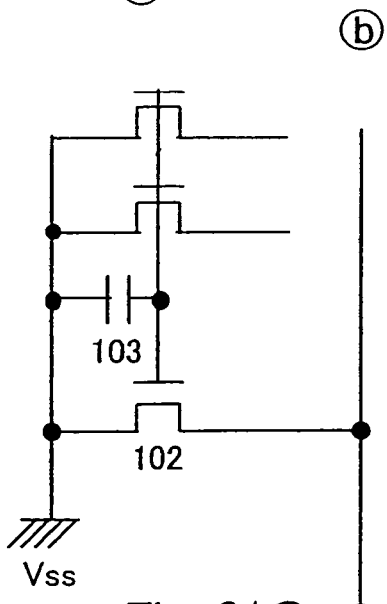
Fig. 31C

SIGNAL LINE DRIVING CIRCUIT AND LIGHT EMITTING DEVICE

TECHNICAL FIELD

The present invention relates to a technique of a signal line drive circuit. Further, the present invention relates to a light emitting device including the signal line drive circuit.

BACKGROUND ART

Recently, display devices for performing image display are being developed. Liquid crystal display devices that perform image display by using a liquid crystal element are widely used as display devices because of advantages of high image quality, thinness, lightweight, and the like.

In addition, light emitting devices using self-light emitting elements as light emitting elements are recently being developed. The light emitting device has characteristics of, for example, a high response speed suitable for motion image display, low voltage, and low power consumption, in addition to advantages of existing liquid crystal display devices, and thus, attracts a great deal of attention as the next generation display device.

As gradation representation methods used in displaying a multi-gradation image on a light emitting device, an analog gradation method and a digital gradation method are given. The former analog gradation method is a method in which the gradation is obtained by analogously controlling the magnitude of a current that flows in a light emitting element. The latter digital gradation method is a method in which the light emitting element is driven only in two states thereof: an ON state (state where the luminance is substantially 100%) and an OFF state (state where the luminance is substantially 0%). In the digital gradation method, since only two gradations can be displayed, a method configured by combining the digital gradation method and a different method to display multi-gradation images has been proposed.

When classification is made based on the type of a signal that is input to pixels, a voltage input method and a current input method are given as pixel-driving methods. The former voltage input method is a method in which: a video signal (voltage) that is input to a pixel is input to a gate electrode of a driving element; and the driving element is used to control the luminance of a light emitting element. The latter current input method is a method in which the set signal current is flown in a light emitting element to control the luminance of the light emitting element.

Hereinafter, referring to FIG. 16A, a brief description will be made on an example of a circuit of a pixel in a light emitting device employing the voltage input method and a driving method thereof. The pixel shown in FIG. 16A includes a signal line 501, a scanning line 502, a switching TFT 503, a driving TFT 504, a capacitor device 505, a light emitting element 506, and power sources 507 and 508.

When the potential of the scanning line 502 varies, and the switching TFT 503 is turned ON, a video signal that has been input to the signal line 501 is input to a gate electrode of the driving TFT 504. According to the potential of the input video signal, a gate-source voltage of the driving TFT 504 is determined, and a current flowing between the source and the drain of the driving TFT 504 is determined. This current is supplied to the light emitting element 506, and the light emitting element 506 emits light. As a semiconductor device for driving the light emitting element, a polysilicon transistor is used. However, the polysilicon transistor is prone to variation in electrical characteristics, such as a threshold value and an ON current, due to defects in a grain boundary. In the pixel shown in FIG. 16A, if characteristics of the driving TFT 504 vary in units of the pixel, even when identical video signals have been input, the magnitudes of the corresponding drain currents of the driving TFTs 504 are different. Thus, the luminance of the light emitting element 506 varies.

To solve the problems described above, a desired current may be input to the light emitting element, regardless of the characteristics of the TFTs for driving the light emitting element. From this viewpoint, the current input method has been proposed which can control the magnitude of a current that is supplied to a light emitting element regardless of the TFT characteristics.

Next, referring to FIGS. 16B and 17, a brief description will be made with respect to a circuit of a pixel in a light emitting device employing the current input method and a driving method thereof. The pixel shown in FIG. 16B includes a signal line 601, first to third scanning lines 602 to 604, a current line 605, TFTs 606 to 609, a capacitor element 610, and a light emitting element 611. A current source circuit 612 is disposed to each signal line (each column).

Operations of from video signal-writing to light emission will be described by using FIG. 17. In FIG. 17, reference numerals denoting respective portions conform to those shown in FIG. 16. FIGS. 17A to 17C schematically show current paths. FIG. 17D shows the relationship between currents flowing through respective paths during a write of a video signal, and FIG. 17E shows a voltage accumulated in the capacitor device 610 also during the write of a video signal, that is, a gate-source voltage of the TFT 608.

First, a pulse is input to the first and second scanning lines 602 and 603 to turn the TFTs 606 and 607 ON. A signal current flowing through the signal line 601 at this time will be referred to as $I_{data}$. As shown in FIG. 17A, since the signal current $I_{data}$ is flowing through the signal line 601, the current separately flows through current paths $I_1$ and $I_2$ in the pixel. FIG. 17D shows the relationship between the currents. Needless to say, the relationship is expressed as $I_{data}=I_1+I_2$.

The moment the TFT 606 is turned ON, no charge is yet accumulated in the capacitor device 610, and thus, the TFT 608 is OFF. Accordingly, $I_2=0$ and $I_{data}=I_1$ are established. In the moment, the current flows between electrodes of the capacitor device 610, and charge accumulation is performed in the capacitor device 610.

Charge is gradually accumulated in the capacitor device 610, and a potential difference begins to develop between both the electrodes (FIG. 17E). When the potential difference of both the electrodes has reached $V_{th}$ (point A in FIG. 17E), the TFT 608 is turned ON, and $I_2$ occurs. As described above, since $I_{data}=I_1+I_2$ is established, while $I_1$ gradually decreases, the current keeps flowing, and charge accumulation is continuously performed in the capacitor device 610.

In the capacitor device 610, charge accumulation continues until the potential difference between both the electrodes, that is, the gate-source voltage of the TFT 608 reaches a desired voltage. That is, charge accumulation continues until the voltage reaches a level at which the TFT 608 can allow the current $I_{data}$ to flow. When charge accumulation terminates (B point in FIG. 17E), the current $I_1$ stops flowing. Further, since the TFT 608 is fully ON, $I_{data}=I_2$ is established (FIG. 17B). According to the operations described above, the operation of writing the signal to the pixel is completed. Finally, selection of the first and second scanning lines 602 and 603 is completed, and the TFTs 606 and 607 are turned OFF.

Subsequently, a pulse is input to the third scanning line 604, and the TFT 609 is turned ON. Since $V_{GS}$ that has been just written is held in the capacitor device 610, the TFT 608 is already turned ON, and a current equal to $I_{data}$ flows thereto from the current line 605. Thus, the light emitting element 611 emits light. At this time, when the TFT 608 is set to operate in a saturation region, even if the source-drain voltage of the TFT 608 varies, a light emitting current $I_{EL}$ flowing to the light emitting element 611 flows without variation.

As described above, the current input method refers to a method in which the drain current of the TFT 609 is set to have the same current value as that of the signal current $I_{data}$ set in the current source circuit 612, and the light emitting element 611 emits light with the luminance corresponding to the drain current. By using the thus structured pixel, the effects of the characteristic variations of TFTs constituting the pixel is reduced, and a desired current can be supplied to the light emitting element.

Incidentally, in the light emitting device employing the current input method, a signal current corresponding to a video signal needs to be precisely input to a pixel. However, when a signal line drive circuit (corresponding to the current source circuit 612 in FIG. 16) used to input the signal current to the pixel is constituted by polysilicon transistors, variation in characteristics thereof occurs, thereby also causing variation in characteristics of the signal current.

That is, in the light emitting element employing the current input method, influence by variation in characteristics of TFTs constituting the pixel and the signal line drive circuit need to be suppressed. However, while the effects of the characteristic variations of TFTs constituting the pixel is reduced by using the pixel having the structure of FIG. 16B, reduction of the effects of characteristic variations of TFTs constituting the signal line drive circuit is difficult. Hereinafter, using FIG. 18, a brief description will be made of the structure and operation of a current source circuit disposed in the signal line drive circuit that drives the pixel employing the current input method.

The current source circuit 612 shown in FIGS. 18A and 18B corresponds to the current source circuit 612 of FIG. 16B. The current source circuit 612 includes constant current sources 555 to 558. The constant current sources 555 to 558 are controlled by signals that are input via respective terminals 551 to 554. The magnitudes of currents supplied from the constant current sources 555 to 558 are different from one another, and the ratio thereof is set to 1:2:4:8.

FIG. 18B shows a circuit structure of the current source circuit 612, in which the constant current sources 555 to 558 shown therein correspond to transistors. The ratio of ON currents of the transistors 555 to 558 is set to 1:2:4:8 according to the ratio (1:2:4:8) of the value of L (gate length)/W (gate width). The current source circuit 612 then can control the current magnitudes at $2^4$=16 levels. Specifically, currents having 16-gradation analog values can be output for 4-bit digital video signals. Note that the current source circuit 612 is constituted by polysilicon transistors, and is integrally formed with the pixel portion on the same substrate.

As described above, conventionally, a signal line drive circuit incorporated with a current source circuit has been proposed (for example, refer to Non-patent Documents 1 and 2).

In addition, digital gradation methods include a method in which a digital gradation method is combined with an area gradation method to represent multi-gradation images (hereinafter, referred to as area gradation method), and a method in which a digital gradation method is combined with a time gradation method to represent multi-gradation images (hereinafter, referred to as time gradation method). The area gradation method is a method in which one pixel is divided into a plurality of sub-pixels, emission or non-emission is selected in each of the sub-pixels, and the gradation is represented according to a difference between a light emitting area and the other area in a single pixel. The time gradation method is a method in which gradation representation is performed by controlling the emission period of a light emitting element. To be more specific, one frame period is divided into a plurality of subframe periods having mutually different lengths, emission or non-emission of a light emitting element is selected in each period, and the gradation is presented according to a difference in length of light emission time in one frame period. In the digital gradation method, the method in which a digital gradation method is combined with a time gradation method (hereinafter, referred to as time gradation method) is proposed. (For example, refer to Patent Document 1).

Non-patent Document 1

Reiji Hattori & three others, "Technical Report of Institute of Electronics, Information and Communication Engineers (IEICE)", ED 2001-8, pp. 7-14, "Circuit Simulation of Current Specification Type Polysilicon TFT Active Matrix-Driven Organic LED Display"

Non-patent Document 2

Reiji H et al.; "AM-LCD'01", OLED-4, pp. 223-226

Patent Document 1

JP 2001-5426 A

DISCLOSURE OF THE INVENTION

The above-described current source circuit 612 is set such that the ON-state currents of the transistors are in a proportion of 1:2:4:8 by the design of the value L (gate length)/W (gate width). However, in the transistors 555 to 558, many factors including variations in the gate length, gate width, and the thickness of a gate insulator film, which are caused by the difference in manufacturing process and a substrate for use, conspire to cause variations in the threshold value and mobility. Therefore, it is difficult to set the proportion of the ON-state currents of the transistors 555 to 558 to 1:2:4:8 accurately as designed. In brief, the values of currents to be supplied to pixels vary by column.

In order to set the proportion of the ON-state currents of the transistors 555 to 558 to 1:2:4:8 accurately as designed, all the characteristics of the current source circuits in all columns must be the same. In other words, it is necessary for all the characteristics of the transistors of the current source circuits held in the signal-line drive circuit to be the same; however, it is extremely difficult to realize.

The present invention has been made in consideration of the above problems, and provides a signal-line drive circuit capable of reducing the effects of the characteristic variations of TFTs and supplying a desired signal current to pixels. Furthermore, the present invention provides a light emitting device capable of reducing the effects of the characteristic variations of TFTs that constitute both the pixels and the drive circuit and supplying a desired signal current to light-emitting elements using the pixels with the circuit configuration in which the effects of the characteristic variations of TFTs are reduced.

The present invention provides a signal-line drive circuit with a new configuration equipped with an electrical circuit (referred to as a current source circuit in this specification) that carries a desired constant current with reduced effects of characteristic variations in TFTs. Furthermore, the present invention provides a light emitting device equipped with the signal-line drive circuit described above.

The present invention provides a signal-line drive circuit having a current source circuit disposed in each column (each signal line and so on).

In the signal-line drive circuit of the present invention, a signal current is set in the current source circuit arranged in each signal line using a video-signal constant current source. The current source circuit in which the signal current is set is capable of feeding a current proportional to the video-signal constant current source. Thus, the effects of the characteristic variations of TFTs constituting the signal-line drive circuit can be reduced by using the current source circuit.

The video-signal constant current source may be integrated with the signal-line drive circuit on the substrate. Alternatively, current may be inputted as a video-signal current from the outside of the substrate using an IC or the like. In this case, a constant current or a current responsive to the video signal is supplied as a video-signal current from the exterior of the substrate to the signal-line drive circuit.

The outline of the signal-line drive circuit of the present invention will be described with reference to FIGS. 1 and 2. FIGS. 1 and 2 show a signal-line drive circuit around the ith to (i+2)th three signal lines.

Referring to FIG. 1, a signal-line drive circuit 403 has a current source circuit 420 arranged in each signal line (each column). The current source circuit 420 has a terminal a, a terminal b, and a terminal c. From the terminal a, a setting signal is inputted. To the terminal b, a current (signal current) is supplied from a video-signal constant current source 109 connected to the current line. From the terminal c, a signal held in the current source circuit 420 is outputted through a switch 101. In other words, the current source circuit 420 is controlled by the setting signal inputted from the terminal a; to which the supplied signal current is inputted through the terminal b; and which outputs a current proportional to the signal current through the terminal c. The switch 101 is arranged between the current source circuit 420 and pixels connected to the signal line, and the ON/OFF of the switch 101 is controlled by a latch pulse.

Next, a signal-line drive circuit having a different configuration form that of FIG. 1 will be described with reference to FIG. 2. In FIG. 2, the signal-line drive circuit 403 includes two or more current source circuits 420 for each signal line (each column). The current source circuit 420 includes a plurality of current source circuits. Assuming that two current source circuits are provided, the current source circuit 420 includes a first current source circuit 421 and a second current source circuit 422. Each of the first current source circuit 421 and the second current source circuit 422 includes a terminal a, a terminal b, a terminal c, and a terminal d. Through the terminal a, a setting signal is inputted. Through the terminal b, a current (signal current) is supplied from the video-signal constant current source 109 connected to the current line. Through the terminal c, a signal held in each of the first current source circuit 421 and the second current source circuit 422 is outputted. In other words, the current source circuit 420 is controlled by the setting signal inputted through the terminal a and a control signal inputted through the terminal d; to which the supplied signal current is inputted through the terminal b; and which outputs a current (signal current) proportional to the signal current through the terminal c. The switch 101 is arranged between the current source circuit 420 and pixels connected to the signal line, and the ON/OFF of the switch 101 is controlled by a latch pulse. Through the terminal d, a control signal is inputted.

In this specification, the operation of bringing the writing of signal current $I_{data}$ to the current source circuit 420 to an end (setting a signal current, setting so as to allow the output of a current proportional to the signal current by the signal current, and defining so that the current source circuit 420 can output the signal current) is called a setting operation; and the operation of inputting the signal current $I_{data}$ to pixels (operation of the current source circuit 420 to output a signal current) is called an inputting operation. Referring to FIG. 2, since the control signals inputted to the first current source circuit 421 and the second current source circuit 422 are different from each other, one of the first current source circuit 421 and the second current source circuit 422 performs setting operation and the other performs inputting operation. Thus, the two operations can be performed at the same time.

In the present invention, a light emitting device includes a panel having a pixel section including light-emitting elements and a signal-line drive circuit enclosed between the substrate and a cover member; a module mounting an IC and the like on the panel; and a display. In short, the light emitting device corresponds to the general term for the panel, module, and the display.

The signal-line drive circuit of the present invention includes latches each having a current source circuit. The signal-line drive circuit of the present invention can be applied to both an analog intensity-level system and a digital intensity-level system.

According to the present invention, the TFT can be replaced with a general transistor using a single crystal, a transistor using an SOI (silicon on insulator), an organic transistor and so on for application.

The present invention is a signal-line drive circuit comprises first and second current source circuits corresponding to respective plurality of signal lines; a shift register; and n (n is a natural number of one or more) video-signal constant current source s, characterized in that:

each of the first and second current source circuits has a capacitance means and a supply means; wherein the capacitance means held in one of the first and second source circuits converts a current including a current supplied from each of the n video-signal constant current source s to voltage in accordance with a sampling pulse supplied from the shift register and a latch pulse supplied from the exterior; and the supply means held in the other supplies a current responsive to the converted voltage; and the values of the currents to be supplied from the n video-signal constant current source s are set to a proportion of $2^0:2^1:\ldots:2^n$.

The present invention is a signal-line drive circuit comprising (2×n) current source circuits corresponding to respective plurality of signal lines; a shift register; and n (n is a natural number of one or more) video-signal constant current source s, characterized in that:

the (2×n) current source circuits includes a capacitance means for converting a current supplied from either one of the n video-signal constant current source s to voltage in accordance with a sampling pulse supplied from the shift register and a latch pulse supplied from the exterior; and a supply means for supplying a current corresponding to the converted voltage;

a current is supplied to each of the plurality of signal lines from the n current source circuits selected from the (2×n) current source circuits; and the values of the currents to be supplied from the n video-signal constant current source s are set to a proportion of $2^0:2^1:\ldots:2^n$.

The signal-line drive circuit with the foregoing configuration according to the present invention includes a shift register and a latch having two or more current source circuits. The current source circuit having a supply means and a capacitance means can supply a predetermined value of current without being affected by the characteristic variations of the constituting transistors. The signal-line drive circuit has a logical operator. A sampling pulse supplied from the shift register and a latch pulse supplied from the exterior are inputted to the two input terminals of the logical operator. In the present invention, the two or more current source circuits disposed in the latch are controlled using a signal outputted from the output terminal of the logical operator. In this case, the operation of converting the supplied current to a voltage can accurately be performed in the current source circuit over a long period of time.

In the present invention, there is provided a signal-line drive circuit having the foregoing current source circuits. Furthermore, in the present invention, there is provided a light emitting device capable of reducing the effects of the characteristic variations in TFTs that constitute both the pixels and the drive circuit, and supplying a desired signal current $I_{data}$ to light-emitting elements by using pixels with the circuit configuration in which the effects of the characteristic variations in TFTs are reduced.

BRIEF DESCRIPTION OF THE DRAWINGS

FIGS. 17A-17E are explanatory views of operations of a pixel in the light emitting device.

FIGS. 20A-20E are explanatory views of operations of a current source circuit.

FIGS. 27A1-27C2 are circuit diagrams of a current source.

FIGS. 28A-28C2 are circuit diagrams of a current source.

FIGS. 30A1-30D2 are circuit diagrams of a current source.

FIGS. 31A-31C are circuit diagrams of a current source.

BEST MODE FOR CARRYING OUT THE INVENTION

First Embodiment

In this embodiment, an example of a circuit structure and its operation of a current source circuit 420 which is supplied in a signal line drive circuit of the present invention will be described.

In the invention, a setting signal input from a terminal a represents a signal input from an output terminal of a logical operator. In other words, the setting signal in FIG. 1 corresponds to the signal input from the output terminal of the logical operator. In the present invention, the setting operation of the current source circuit 420 is performed in accordance with the signal input from the output terminal of the logical operator.

One of two input terminals of the logical operator is input with a sampling pulse from a register, and the other is input with a latch pulse. In the logical operator, a logic operation of two signals which have been input is performed, and a signal from the output terminal is output. Then in the current source circuit, the setting operation or the input operation is performed according to the signal input from the output terminal of the logical operator.

Note that a shift register has a structure including, for example, flip-flop circuits (FFs) in a plurality of columns. A clock signal (S-CLK), a start pulse (S-SP), and an inverted clock signal (S-CLKb) are input to the shift register, and signals serially output according to the timing of the input signals are called sampling pulses.

Figure 6A:
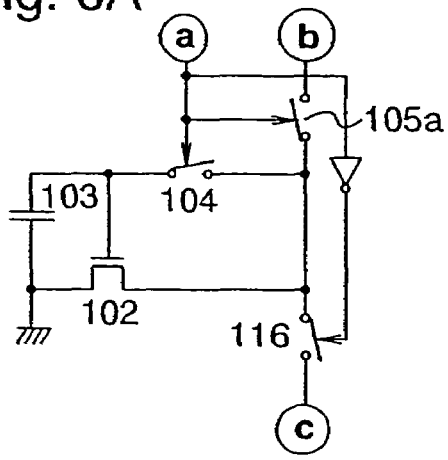
FIGS. 6A-6E are circuit diagrams of current source circuits.

In FIG. 6A, a circuit including switches 104, 105*a*, and 106, a transistor 102 (n-channel type), and a capacitor device 103 for retaining a gate-source voltage VGS of the transistor 102 corresponds to the current source circuit 420.

In the current source circuit 420, the switch 104 and the switch 105*a* are turned ON by a signal input via the terminal a. A current is supplied via a terminal b from a video-signal current source 109 (hereafter referred to as constant current source 109) connected to a current line (video line), and a charge is retained in the capacitor device 103. The charge is retained in the capacitor device 103 until a signal current $I_{data}$ supplied from the constant current source 109 becomes identical with a drain current of the transistor 102.

Then, the switch 104 and the switch 105*a* are turned OFF by a signal input via the terminal a. As a result, since the predetermined charge is retained in the capacitor device 103, the transistor 102 is imparted with a capability of flowing a current having a magnitude corresponding to that of the signal current $I_{data}$. If the switch 101 (signal current control switch) and the switch 106 are turned into a conductive state, a current via a terminal c flows to a pixel connected to the signal line. At this time, since the gate voltage of the transistor 102 is maintained at a predetermined gate voltage in the capacitor device 103. Thus, the effects of the characteristic variations of TFTs constituting the signal line drive circuit is reduced, and the magnitude of the current input to the pixel can be controlled.

The connection structure of the switch 104 and the switch 105*a* is not limited to the structures shown in FIG. 6A. For example, the structure may be such that one of terminals of the switch 104 is connected to the terminal b, and the other terminal is connected between itself and the gate electrode of the transistor 102; and one of terminals of the switch 105*a* is connected to the terminal b via the switch 104, and the other terminal is connected to the switch 106. Then, the switch 104 and the switch 105*a* are controlled by a signal input from the terminal a.

Alternatively, the switch 104 may be disposed between the terminal b and the gate electrode of the transistor 104, and the switch 105*a* may be disposed between the terminal b and the switch 116. Specifically, referring to FIG. 27A, lines, switches, and the like may be disposed such that the connection is structured as shown in FIG. 27(A1) in the setting operation, and the connection is structured as shown in FIG. 27(A2) in the input operation. The number of wirings, the number of switches, and the structure are not particularly limited.

In the current source circuit 420 of FIG. 6A, the signal setting operation (setting operation) and the signal inputting operation (input operation) to the pixel or the current source circuit, that is, the current outputting operation from the current source circuit cannot be performed simultaneously.

Figure 6B:
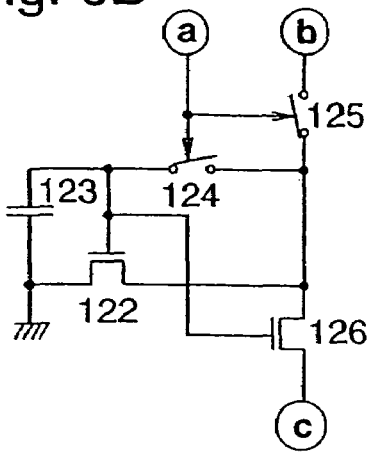

Referring to FIG. 6B, a circuit including a switch 124, a switch 125, a transistor 122 (n-channel type), a capacitor device 123 for retaining a gate-source voltage VGS of the transistor 122, and a transistor 126 (n-channel type) corresponds to the current source circuit 420.

The transistor 126 functions as either a switch or a part of a current source transistor.

In the current source circuit 420 shown in FIG. 6B, the switch 124 and the switch 125 are turned ON by a signal input via the terminal a. Then, a current is supplied via the terminal b from the constant current source 109 connected to the current line, and a charge is retained in the capacitor device 123. The charge is retained therein until the signal current $I_{data}$ flown from the constant current source 109 becomes identical with a drain current of the transistor 122. Note that, when the switch 124 is turned ON, since a gate-source voltage VGS of the transistor 126 is set to 0 V, the transistor 126 is turned OFF.

Subsequently, the switch 124 and the switch 125 are turned OFF by a signal input via the terminal a. As a result, since a predetermined charge is retained in the capacitor device 123, the transistor 122 is imparted with a capability of flowing a current having a magnitude corresponding to that of the signal current $I_{data}$. If the switch 101 (signal current control switch) is turned into a conductive state, the current flows to the pixel connected to the signal line via the terminal c. At this time, since the gate voltage of the transistor 122 is maintained by the capacitor device 123 at a predetermined gate voltage, a drain current corresponding to the signal current $I_{data}$ flows to the drain region of the transistor 122. Thus, the effects of the characteristic variations of TFTs constituting the signal line drive circuit is reduced, and the magnitude of the current input to the pixel can be controlled.

When the switches 124 and 125 have been turned OFF, gate and source potentials of the transistor 126 are varied not to be the same. As a result, since the charge retained in the capacitor device 123 is distributed also to the transistor 126, and the transistor 126 is automatically turned ON. Here, the transistors 122 and 126 are connected in series, and the gates thereof are connected. Accordingly, each of the transistors 122 and 126 serves as a multi-gate transistor. That is, a gate length L of the transistor varies between the setting operation and the input operation. Therefore, the value of the current supplied from the terminal b at the time of the setting operation can be made larger than the value of the current supplied from the terminal c at the time of the input operation. Thus, various loads (such as wiring resistances and cross capacitances) disposed between the terminal b and the constant current source 109 can be charged even faster. Consequently, the setting operation can be completed quickly.

The number of switches, the number of wirings, and their connection structures are not particularly limited. Specifically, referring to FIG. 27B, wirings and switches may be disposed such that the connection is structured as shown in FIG. 27(B1) in the setting operation, and the connection is structured as shown in FIG. 27(B2) in the input operation. In particular, in FIG. 27(C2), it is sufficient that the charge accumulated in a capacitor device 107 does not leak. The number of switches and wirings are not particularly limited.

Note that, in the current source circuit 420 shown in FIG. 6B, the signal setting operation (setting operation) and the signal inputting operation (input operation) to the pixel, that is, the current outputting operation from the current source circuit cannot be performed simultaneously.

Figure 6C:
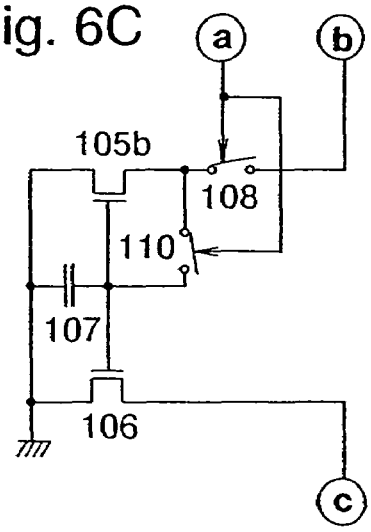

Referring to FIG. 6C, a circuit including a switch 108, a switch 110, transistors 105*b*, 106 (n-channel type), and a capacitor device 107 for retaining gate-source voltages VGS of the transistors 150*b* and 106 corresponds to the current source circuit 420.

In the current source circuit 420 shown in FIG. 6C, the switch 108 and the switch 110 are turned ON by a signal input via a terminal a. Then, a current is supplied via a terminal b from the constant current source 109 connected to the current line, and a charge is retained in the capacitor device 107. The charge is retained therein until the signal current $I_{data}$ flown from the constant current source 109 becomes identical with a drain current of the transistor 105*b*. At this time, since the gate electrodes of the transistor 105*b* and of the transistor 106 are connected to each other, the gate voltages of the transistor 105*b* and the transistor 106 are retained by the capacitor device 107.

Then, the switch 108 and the switch 110 are turned OFF by the signal input via the terminal a. As a result, since a predetermined charge is retained in the capacitor device 107, the transistor 106 is imparted with a capability of flowing a current having a magnitude corresponding to that of the signal current $I_{data}$. If the switch 101 (signal current control switch) is turned to a conductive state, a current flows to the pixel connected to the signal line via a terminal c. At this time, since the gate voltage of the transistor 106 is maintained by the capacitor device 107 at the predetermined gate voltage, a drain current corresponding to the current (the signal current $I_{data}$) flows to the drain region of the transistor 106. Thus, the effects of the characteristic variations of TFTs constituting the signal line drive circuit is reduced, and the magnitude of the current input to the pixel can be controlled.

At this time, characteristics of the transistor 105*b* and the transistor 106 need to be the same to cause the drain current corresponding to the signal current $I_{data}$ to flow precisely to the drain region of the transistor 106. To be more specific, values such as mobility and thresholds of the transistor 105*b* and the transistor 106 need to be the same. In addition, in FIG. 6C, the value of W (gate width)/L (gate length) of each of the transistor 105*b* and the transistor 106 may be arbitrarily set, and a current proportional to the signal current $I_{data}$ supplied from the constant current source 109 and the like may be supplied to the pixel.

Further, the value of W/L of the transistor 105*b* or the transistor 106 that is connected to the constant current source 109 is set high, whereby the write speed can be increased by supplying a large current from the constant current source 109.

With the current source circuit 420 shown in FIG. 6C, the signal setting operation (setting operation) can be performed simultaneously with the signal inputting operation (input operation) to the pixel.

Figure 6D:
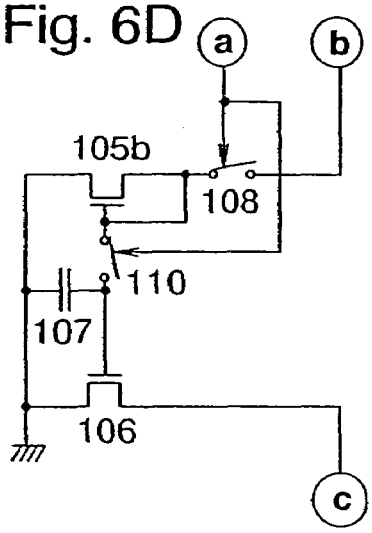
Figure 6E:
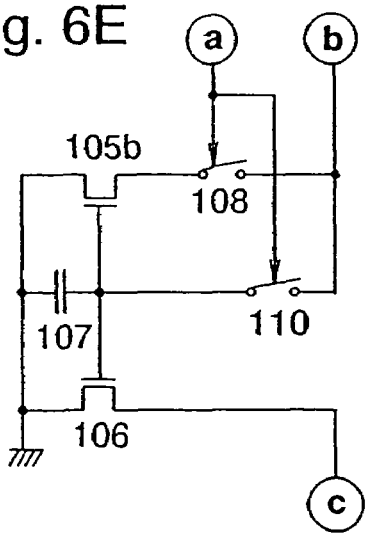

Each of the current source circuits 420 of FIGS. 6D and 6E has the same circuit element connection structures as that of the current source circuit 420 of FIG. 6C, except for the connection structure of the switch 110. In addition, since the operation of the current source circuit 420 of each of FIGS. 6D and 6E conforms to the operation of the current source circuit 420 of FIG. 6C, a description thereof will be omitted in the present embodiment.

Note that, the number of switches, the number of wirings, and their connection structures are not particularly limited. Specifically, referring to FIG. 27C, wirings and switches may be disposed such that the connection is structured as shown in FIG. 27(C1) in the setting operation, and the connection is structured as shown in FIG. 27(C2) in the input operation. In particular, in FIG. 27(C2), it is sufficient that the charge accumulated in the capacitor device 107 does not leak.

Referring to FIG. 28A, a circuit including switches 195*b*, 195*c*, 195*d*, and 195*f*, a transistor 195*a*, and a capacitor device 195*e* corresponds to the current source circuit. In the current source circuit shown in FIG. 28A, the switches 195*b*, 195*c*, 195*d*, and 195*f* are turned ON by a signal input via a terminal a. Then, a current is supplied via a terminal b from the constant current source 109 connected to the current line. A predetermined charge is retained in the capacitor device 195*e* until the signal current supplied from the constant current source 109 becomes identical with a drain current of the transistor 195*a*.

Then, the switches 195*b*, 195*c*, 195*d*, and 195*f* are turned OFF by a signal input via the terminal a. At this time, since the predetermined charge is retained in the capacitor device 195*e*, the transistor 195*a* is imparted with a capability of flowing a current having a magnitude corresponding to that of the signal current. This is because the gate voltage of the transistor 195*a* is set by the capacitor device 195*a* to a predetermined gate voltage, and a drain current corresponding to a current (reference current) flows to the drain region of the transistor 195*a*. In this state, a current is supplied to the outside via a terminal c. Note that, in the current source circuit shown in FIG. 28A, the operation for setting the current source circuit to have a capability of flowing a signal current cannot be performed simultaneously with the input operation for inputting the signal current to the pixel. In addition, when a switch controlled by the signal input via the terminal a is ON, and also, when a current is controlled not to flow from the terminal c, the terminal c needs to be connected to another line of the other potential. Here, the line potential is represented by Va. Va may be a potential sufficient to flow a current flowing from the terminal b as it is, and may be a power supply voltage Vdd as an example.

Note that, the number of switches, the number of wirings, and their connection structures are not particularly limited. Specifically, referring to FIGS. 28B and 28C, wirings and switches may be disposed such that the connection is structured as shown in either FIG. 28(B1) or 28(C1) in the setting operation, and the connection is structured as shown in either FIG. 28(B2) or 28(C2) in the input operation. The number of wirings and switches are not particularly limited.

Further, in the current source circuits of FIGS. 6A and 6C to 6E, the current-flow directions (directions from the pixel to the signal line drive circuit) are the same. The polarity (conductivity type) of each of the transistor 102, the transistor 105*b*, and the transistor 106 can be of p-channel type.

Figure 7A:
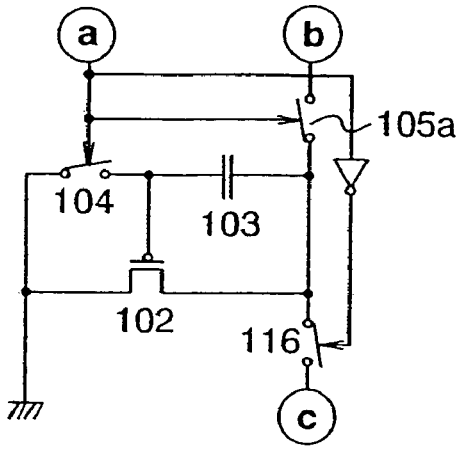
FIGS. 7A-7D are circuit diagrams of current source circuits.
Figure 7B:
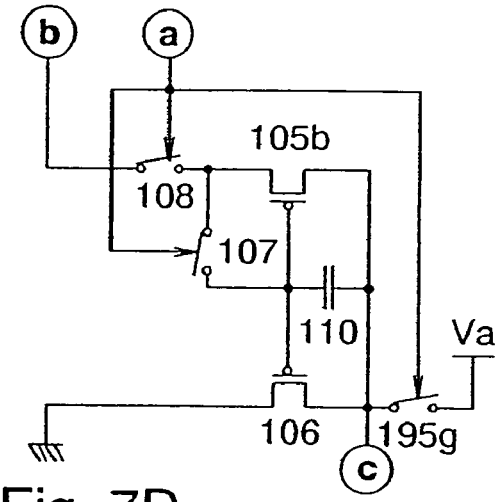
Figure 7C:
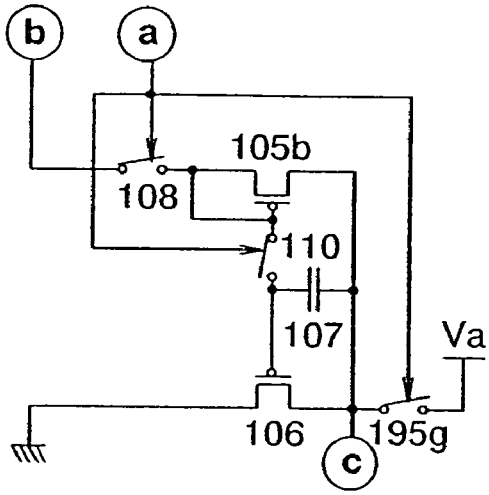
Figure 7D:
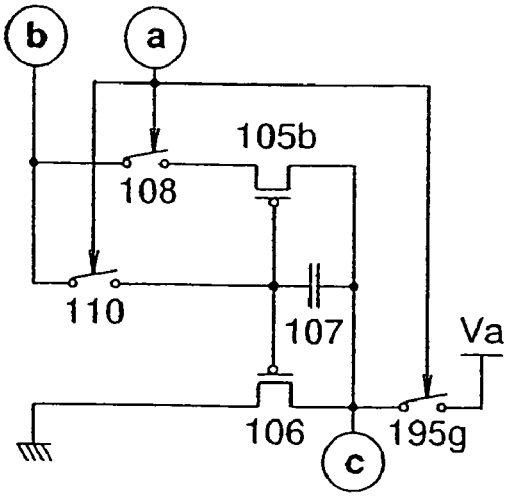

FIG. 7A shows a circuit structure in which the current-flow direction (direction from the pixel to the signal line drive circuit) is the same, and the transistor 102 shown in FIG. 6A is set to be of p-channel type. In FIG. 7A, with the capacitor device disposed between the gate and the source, even when the source potential varies, the gate-source voltage can be maintained. Further, FIGS. 7B to 7D show circuit diagrams in which the current-flow directions (directions from the pixel to the signal line drive circuit) are the same, and the transistor 105*b* and the transistor 106 shown in FIGS. 6C to 6E are set to be of p-channel type.

Figure 29A:
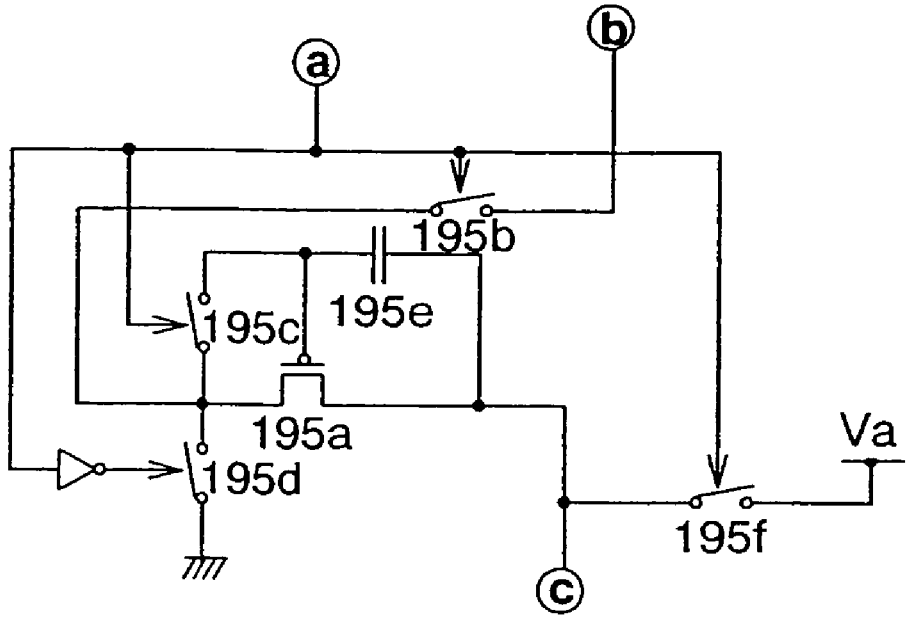
FIGS. 29A-29B are circuit diagrams of a current source.
Figure 29B:
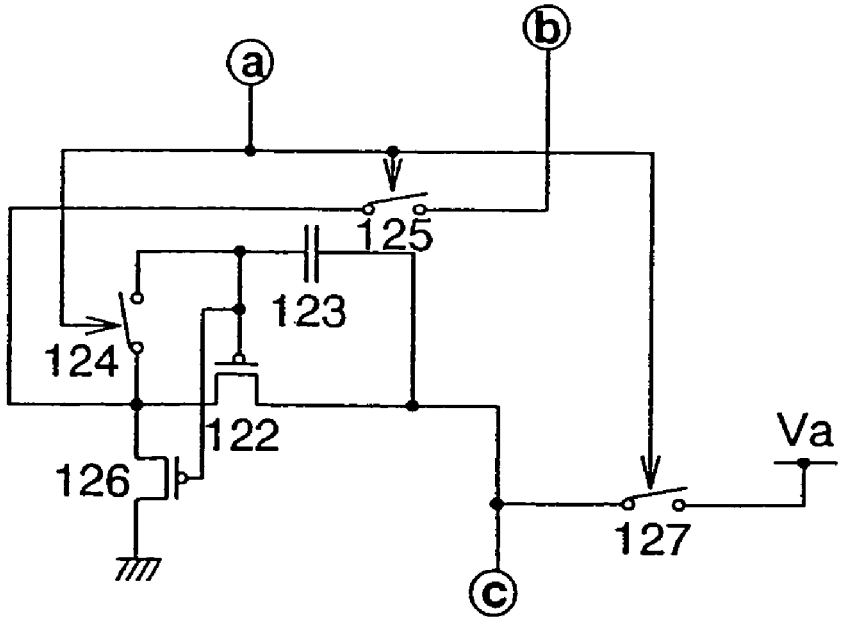

Further, FIG. 29A shows a case where the transistor 195*a* is set to be of p-channel type in the structure of FIG. 28. FIG. 29B shows a case where the transistors 122 and 126 are set to be of p-channel type in the structure of FIG. 6B.

Referring to FIG. 31, a circuit including switches 104 and 116, a transistor 102, a capacitor device 103, and the like corresponds to the current source circuit.

FIG. 31A corresponds to the circuit of FIG. 6A that is partly modified. In the current source circuit of FIG. 31A, the transistor gate width W varies between the setting operation of the current source and the input operation. Specifically, in the setting operation, the connection is structured as shown in FIG. 31B, in which the gate width W is large. In the input operation, the connection is structured as shown in FIG. 31C, in which the gate width W is small. Therefore, the value of the current supplied from the terminal b at the time of the setting operation can be made larger than the value of the current supplied from the terminal c at the time of the input operation. Thus, various loads (such as wiring resistances and cross capacitances) disposed between the terminal b and the constant current source for the video signal can be charged even faster. Consequently, the setting operation can be completed quickly.

Note that, FIG. 31 shows the circuit of FIG. 6A that is partly modified. In addition, the circuit can be easily applied to, for example, other circuits shown in FIG. 6 and to the circuits shown in FIG. 7, FIG. 28, FIG. 30, and FIG. 29.

Note that, in the above mentioned current source circuits, a current flows from the pixel to the signal line drive circuit. However, the current not only flows from the pixel to the signal line drive circuit, but also may flow from the signal line drive circuit to the pixel. It depends on the structure of the pixel that the current flows in a direction from the pixel to the signal line drive circuit or in a direction from the signal line drive circuit to the pixel. In the case where the current flows from the signal line drive circuit to the pixel, Vss (low potential power source) may be set to Vdd (high potential power source), and the transistors 102, 105*b*, 106, 122, and 126 may be set to be of p-channel type in FIG. 6. Also in the circuit diagram shown in FIG. 7, Vss may be set to Vdd, and the transistors 102, 105*b*, and 106 may be of n-channel type.

Note that wirings and switches may be disposed such that the connection is structured as shown in FIGS. 30(A1) to (D1) in the setting operation, and the connection is structured as shown in FIGS. 30(A2) to (D2) in the input operation. The number of switches, the number of wirings and their connection structures are not particularly limited.

Note that, in all the current source circuits described above, the disposed capacitor device may not be disposed by being substituted by, for example, a gate capacitance of a transistor.

Hereinafter, a description will be made in detail regarding the operations of the current source circuits of FIGS. 6A, 7A, 6C to 6E, and 7B to 7D among those described above by using FIGS. 6 and 7. To begin with, the operations of the current source circuits of FIGS. 6A and 7A will be described with reference to FIG. 19.

Figure 19A:
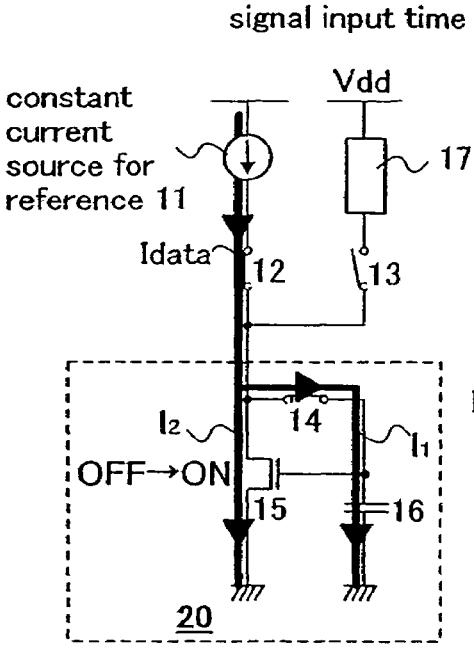
FIGS. 19A-19F are explanatory views of operations of a current source circuit.
Figure 19B:
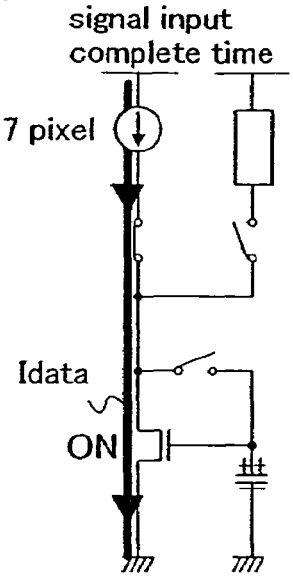
Figure 19C:
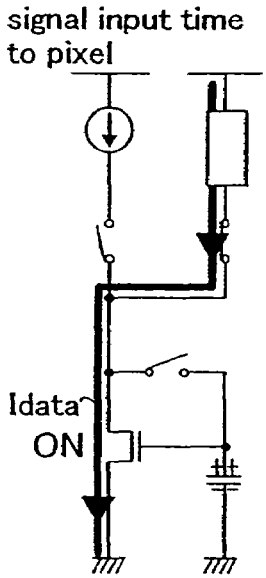
Figure 19D:
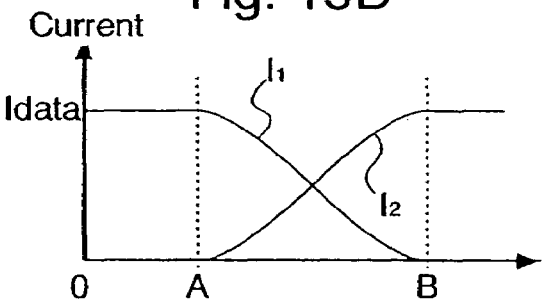
Figure 19E:
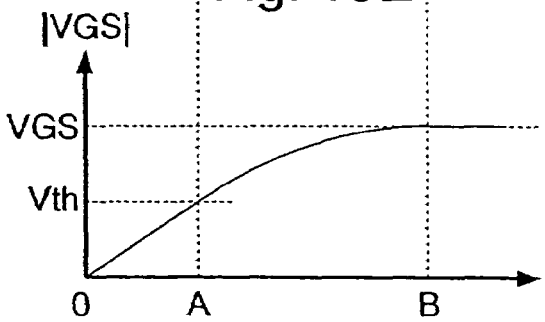

FIGS. 19A to 19C schematically show paths of a current flowing among circuit elements. FIG. 19D shows the relationship between the current flowing through each path and the time when the signal current $I_{data}$ is written to the current source circuit. FIG. 19E shows the relationship between the voltage accumulated in a capacitor device 16, that is, the gate-source voltage of a transistor 15, and the time when the signal current $I_{data}$ is written to the current source circuit. In the circuit diagrams of FIGS. 19A to 19C, numeral 11 denotes a video-signal current source, each of switches 12 to 14 is a semiconductor device having a switching function, numeral 15 denotes a transistor (n-channel type), numeral 16 denotes a capacitor device, and numeral 17 denotes a pixel. In this embodiment, the switch 14, the transistor 15, and the capacitor device 16 form an electric circuit corresponding to a current source circuit 20. Drawing lines and reference symbols are shown in FIG. 19A. Since drawing lines and reference symbols shown in FIGS. 19B and 19C are similar to those shown in FIG. 19A, they are omitted here.

A source region of the n-channel transistor 15 is connected to Vss, and a drain region thereof is connected to the video-signal current source 11. One of electrodes of the capacitor device 16 is connected to Vss (the source of the transistor 15), and the other electrode is connected to the switch 14 (the gate of the transistor 15). The capacitor device 16 plays a role of holding the gate-source voltage of the transistor 15.

Note that, in practice, the current source circuit 20 is supplied in the signal line drive circuit. A current corresponding to the signal current $I_{data}$ flows via, for example, a circuit element included in the signal line or the pixel from the current source circuit 20 supplied in the signal line drive circuit. However, since FIG. 19 is a diagram for briefly explaining the outline of the relationship among the video-signal current source 11, the current source circuit 20, and the pixel 17, a detailed illustration of the structure is omitted.

First, an operation (setting operation) of the current source circuit 20 for retaining the signal current $I_{data}$ will be described by using FIGS. 19A and 19B. Referring to FIG. 19A, the switch 12 and the switch 14 are turned ON, and the switch 13 is turned OFF. In this state, the signal current $I_{data}$ is output from the video-signal current source 11, and flows to the current source circuit 20 from the video-signal current source 11. At this time, since the signal current $I_{data}$ is flowing from the video-signal current source 11, the current flows separately through current paths $I_1$ and $I_2$ in the current source circuit 20, as shown in FIG. 19A. FIG. 19D shows the relationship at this time. Needless to say, the relationship is expressed as $I_{data}=I_1+I_2$.

The moment the current starts to flow from the video-signal current source 11, since no charge is accumulated in the capacitor device 16, the transistor 15 is OFF. Accordingly, $I_2=0$ and $I_{data}=I_1$ are established.

A charge is gradually accumulated into the capacitor device 16, and a potential difference begins to occur between both electrodes of the capacitor device 16 (FIG. 19E). When the potential difference of both the electrodes has reached $V_{th}$ (point A in FIG. 19E), the transistor 15 is turned ON, and $I_2>0$ is established. As described above, since $I_{data}=I_1+I_2$, while $I_1$ gradually decreases, the current keeps flowing. The charge accumulation is continuously performed in the capacitor device 16.

The potential difference between both the electrodes of the capacitor device 16 serves as the gate-source voltage of the transistor 15. Thus, the charge accumulation in the capacitor device 16 continues until the gate-source voltage of the transistor 15 reaches a desired voltage, that is, a voltage (VGS) that allows the transistor is to be flown with the current $I_{data}$. When the charge accumulation terminates (B point in FIG. 19E), the current $I_1$ stops flowing. Further, since the TFT 15 is ON, $I_{data}=I_2$ is established (FIG. 19B).

Next, an operation (input operation) for inputting the signal current $I_{data}$ to the pixel will be described by using FIG. 19C. When the signal current $I_{data}$ is input to the pixel, the switch 13 is turned ON, and the switch 12 and the switch 14 are turned OFF. Since VGS written in the above-described operation is held in the capacitor device 16, the transistor 15 is ON. A current identical with the signal current $I_{data}$ flows to Vss via the switch 13 and transistor 15, and the input of the signal current $I_{data}$ to the pixel is then completed. At this time, when the transistor 15 is set to operate in a saturation region, even if the source-drain voltage of the transistor 15 varies, a current flowing into the pixel can flows constantly.

In the current source circuit 20 shown in FIG. 19, as shown in FIGS. 19A to 19C, the operation is divided into an operation (setting operation; corresponding to FIGS. 19A and 19B) for completing a write of the signal current $I_{data}$ to the current source circuit 20, and an operation (input operation; corresponding to FIG. 19C) for inputting the signal current $I_{data}$ to the pixel). Then, in the pixel, a current is supplied to the light emitting element in accordance with the input signal current $I_{data}$.

The current source circuit 20 of FIG. 19 is not capable of performing the setting operation and the input operation simultaneously. In the case where the setting operation and the input operation need to be performed simultaneously, at least two current source circuits are preferably supplied to each of a plurality of signal lines each of which is connected with a plurality of pixels and which are provided in a pixel portion. However, if the setting operation can be performed within a period during which the signal current $I_{data}$ is not input to the pixel, only one current source circuit may be provided for each signal line (each column).

Figure 19F:
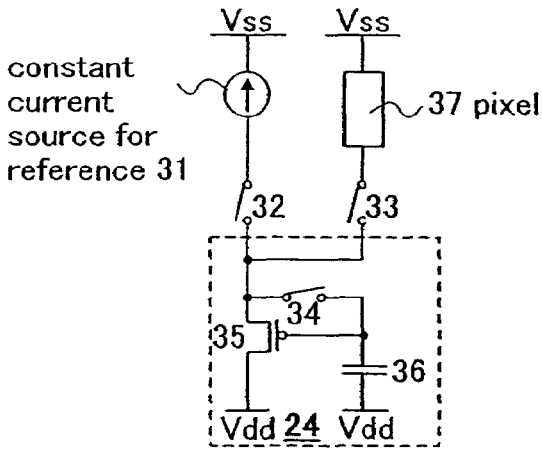

Although the transistor 15 of the current source circuit 20 shown in each of FIGS. 19A to 19C is of n-channel type, the transistor 15 of the current source circuit 20 may be of p-channel type, of course. Here, a circuit diagram for the case where the transistor 15 is of p-channel type is shown in FIG. 19. Referring to FIG. 19F, numeral 31 denotes a video-signal current source, each switches 32 to 34 is a semiconductor device (transistor) having a switching function, numeral 35 denotes a transistor (p-channel type), numeral 36 denotes a capacitor device, and numeral 37 denotes a pixel. In this embodiment, the switch 34, the transistor 35, and the capacitor device 36 form an electric circuit corresponding to a current source circuit 24.

The transistor 35 is of p-channel type. One of a source region and a drain region of the transistor 35 is connected to Vdd, and the other is connected to the constant current source 31. One of electrodes of the capacitor device 36 is connected to Vdd, and the other electrode is connected to the switch 36. The capacitor device 36 plays a role of holding the gate-source voltage of the transistor 35.

An operation of the current source circuit 24 of FIG. 19F is similar to that of the current source circuit 20 described above, except for the current-flow direction, and thus, a description thereof will be omitted here. In the case of designing the current source circuit in which the polarity of the transistor 15 is changed without changing the current-flow direction, the circuit diagram of FIG. 7A may be referenced.

Figure 32:
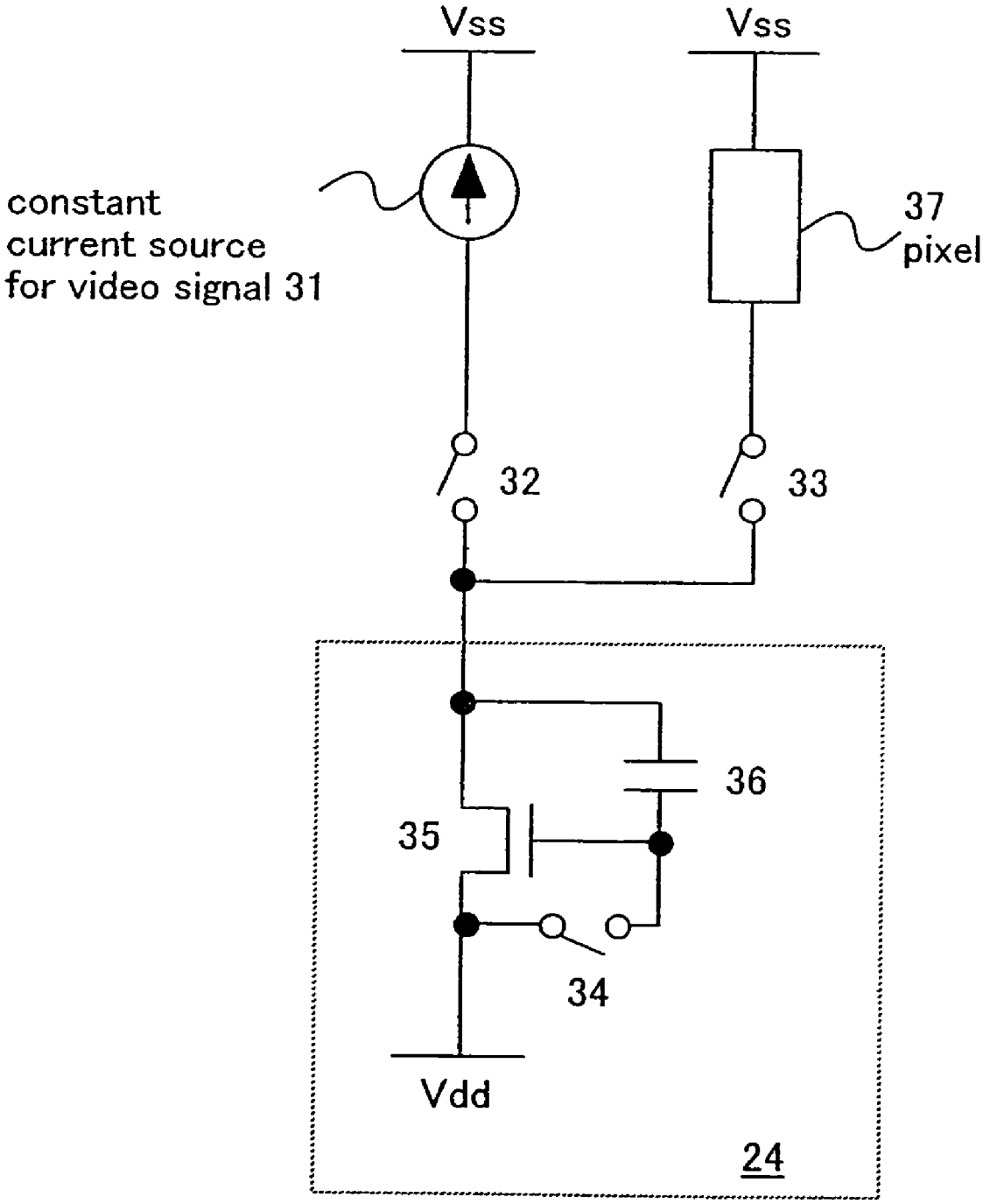
FIG. 32 is a circuit diagram of a current source.

Note that in FIG. 32, the current-flow direction is the same as in FIG. 19F, in which the transistor 35 is of n-channel type. The capacitor device 36 is connected between the gate and the source of the transistor 35. The source potential of the transistor 35 varies between the setting operation and the input operation. However, even when the source potential varies, since the gate-source voltage is retained, a normal operation is implemented.

Next, operations of the current source circuits shown in FIGS. 6C to 6E and FIGS. 7B to 7D will be described by using FIGS. 20 and 21. FIGS. 20A to 20C schematically show paths through which a current flows among circuit elements. FIG. 20D shows the relationship between the current flowing through each path and the time when the signal current $I_{data}$ is written to the current source circuit. FIG. 20E shows the relationship between the voltage accumulated in a capacitor device 46, that is, the gate-source voltages of transistor 43, 44, and the time when the signal current $I_{data}$ is written to the current source circuit. Further, in the circuit diagrams of FIGS. 20A to 20C, numeral 41 denotes a video-signal current source, a switch 42 is a semiconductor device having a switching function, numerals 43 and 44 denote transistors (n-channel type), numeral 46 denotes a capacitor device, and numeral 47 denotes a pixel. In this embodiment, the switch 42, the transistors 43 and 44, and the capacitor device 46 compose an electric circuit corresponding to a current source circuit 25. Note that drawing lines and reference symbols are shown in FIG. 20A, and since drawing lines and reference symbols shown in FIGS. 20B and 20C conform to those shown in FIG. 20A, they are omitted.

A source region of the n-channel transistor 43 is connected to Vss, and a drain region thereof is connected to the video signal current source 41. A source region of the n-channel transistor 44 is connected to Vss, and a drain region thereof is connected to a terminal 48 of the light emitting element 47. One of electrodes of the capacitor device 46 is connected to Vss (the sources of the transistors 43 and 44), and the other electrode thereof is connected to the gate electrodes of the transistors 43 and 44. The capacitor device 46 plays a role of holding gate-source voltages of the transistors 43 and 44.

Note that, in practice, the current source circuit 25 is provided in the signal line drive circuit. A current corresponding to the signal current $I_{data}$ flows via, for example, a circuit element included in the signal line or the pixel, from the current source circuit 25 provided in the signal line drive circuit. However, since FIG. 20 is a diagram for briefly explaining the outline of the relationship among the video-signal current source 41, the current source circuit 25, and the pixel 47, a detailed illustration of the structure is omitted.

In the current source circuit 25 of FIG. 20, the sizes of the transistors 43 and 44 are important. Hereinafter, using different reference symbols, a case where the sizes of the transistors 43 and 44 are identical and a case the sizes are mutually different will be described. Referring to FIGS. 20A to 20C, the case where the sizes of the transistors 43 and 44 are mutually identical will be described by using the signal current $I_{data}$. The case where the sizes of the transistors 43 and 44 are mutually different will be described by using a signal current $I_{data1}$ and a signal current $I_{data2}$. Note that the sizes of the transistors 43 and 44 are determined by using the value of W (gate width)/L (gate length) of each transistor.

First, the case where the sizes of the transistors 43 and 44 are mutually identical will be described. To begin with, operations for retaining the signal current $I_{data}$ in the current source circuit 20 will be described by using FIGS. 20A and 20B. Referring to FIG. 20A, when the switch 42 is turned ON, the signal current $I_{data}$ is set in the video signal current source 41, and flows from the video-signal current source 41 to the current source circuit 25. At this time, since the signal current $I_{data}$ is flowing from the video-signal current source 41, the current flows separately through current paths $I_1$ and $I_2$ in the current source circuit 20, as shown in FIG. 20A. FIG. 20D shows the relationship at this time. Needless to say, the relationship is expressed as $I_{data}=I_1+I_2$.

The moment the current starts to flow from the video signal current source 41, since no charge is yet accumulated in the capacitor device 46, the transistors 43 and 44 are OFF. Accordingly, $I_2=0$ and $I_{data}=I_1$ are established.

Then, a charge is gradually accumulated into the capacitor device 46, and a potential difference begins to occur between both electrodes of the capacitor device 46 (FIG. 20E). When the potential difference of both the electrodes has reached $V_{th}$ (point A in FIG. 20), the transistors 43 and 44 are turned ON, and $I_2>0$ is established. As described above, since $I_{data}=I_1+I_2$, while $I_1$ gradually decreases, the current keeps flowing. The charge accumulation is continuously performed in the capacitor device 46.

The potential difference between both the electrodes of the capacitor device 46 serves as the gate-source voltage of each of the transistors 43 and 44. Thus, the charge accumulation in the capacitor device 46 continues until each the gate-source voltages of the transistors 43 and 44 reaches a desired voltage, that is, a voltage (VGS) that allows the transistor 44 to be flown with the current $I_{data}$. When the charge accumulation terminates (B point in FIG. 20E), the current $I_1$ stops flowing. Further, since the transistors 43 and 44 are ON, $I_{data}=I_2$ is established (FIG. 20B).

Next, an operation for inputting the signal current $I_{data}$ to the pixel will be described by using FIG. 20C. First, the switch 42 is turned OFF. Since VGS written at the above-described operation is retained in the capacitor device 46, the transistors 43 and 44 are ON. A current identical with the signal current $I_{data}$ flows from the pixel 47. Thus, the signal current $I_{data}$ is input to the pixel. At this time, when the transistor 44 is set to operate in a saturation region, even if the source-drain voltage of the transistor 44 varies, the current flowing in the pixel can be flown without variation.

In the case of a current mirror circuit shown in FIG. 6C, even when the switch 42 is not turned OFF, a current can be flown to the pixel 47 by using the current supplied from the video signal current source 41. That is, the setting operation for setting a signal for the current source circuit 20 can be implemented simultaneously with the operation (input operation) for inputting a signal to the pixel.

Next, a case where the sizes of the transistors 43 and 44 are mutually different will be described. An operation of the current source circuit 25 is similar to the above-described operation; therefore, a description thereof will be omitted here. When the sizes of the transistors 43 and 44 are mutually different, the signal current $I_{data1}$ set in the video signal current source 41 is inevitably different from the signal current $I_{data2}$ that flows to the pixel 47. The difference therebetween depends on the difference between the values of W (gate width)/L (gate length) of the transistors 43 and 44.

In general, the W/L value of the transistor 43 is preferably set larger than that of the transistor 44. This is because the signal current $I_{data1}$ can be increased when the W/L value of the transistor 43 is set large. In this case, when the current source circuit is set with the signal current $I_{data1}$, Loads (cross capacitances, wiring resistances) can be charged. Thus, the setting operation can be completed quickly.

The transistors 43 and 44 of the current source circuit 25 in each of FIGS. 20A to 20C are of n-channel type, but the transistors 43 and 44 of the current source circuit 25 may be of p-channel type. Here, FIG. 21 shows a circuit diagram in which the transistors 43 and 44 are of p-channel type.

Figure 21:
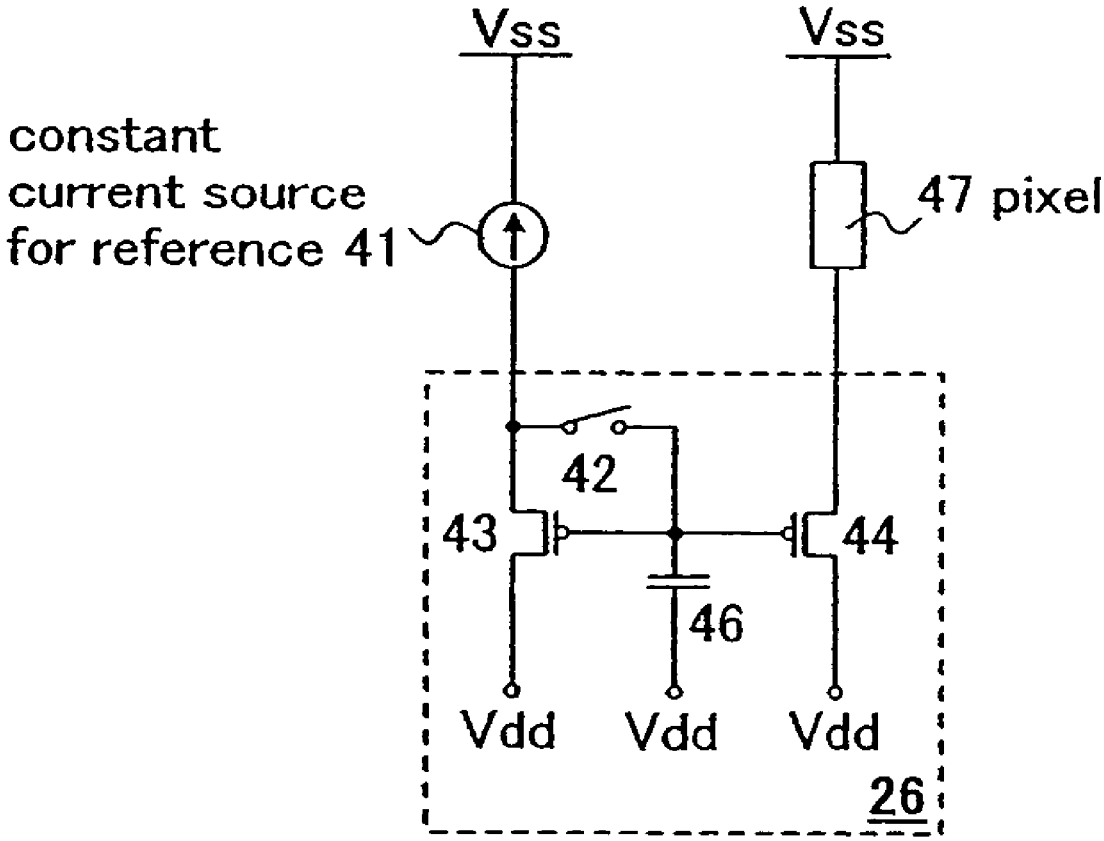
FIG. 21 is an explanatory view of operations of a current source circuit.

Referring to FIG. 21, numeral 41 denotes a constant current source, a switch 42 is a semiconductor device having a switching function, numerals 43 and 44 denote transistors (p-channel type), numeral 46 denotes a capacitor device, and numeral 47 denotes a pixel. In this embodiment, the switch 42, the transistors 43 and 44, and the capacitor device 46 form an electric circuit corresponding to a current source circuit 26.

A source region of the p-channel transistor 43 is connected to Vdd, and a drain region thereof is connected to the constant current source 41. A source region of the p-channel transistor 44 is connected to Vdd, and a drain region thereof is connected to a terminal 48 of the light emitting element 47. One of electrodes of the capacitor device 46 is connected to (source), and the other electrode is connected to the gate electrodes of the transistors 43 and 44. The capacitor device 46 plays a role of holding gate-source voltages of the transistors 43 and 44.

The operation of the current source circuit 24 of FIG. 21 is similar to that shown in each of Figs. FIGS. 20A to 20C except for the current-flow direction, and thus, a description thereof will be omitted here. In the case of designing the current source circuit in which the polarities of the transistors 43 and 44 are changed without changing the current-flow direction, FIG. 7B and FIG. 32 may be referenced.

In summary, in the current source circuit of FIG. 19, the current having the same magnitude as that of the signal current $I_{data}$ set in the constant current source flows to the pixel. In other words, the signal current $I_{data}$ set in the constant current source is identical in value with the current flowing to the pixel. The current is not effected by characteristic variations of transistors supplied in the current source circuit.

In each of the current source circuits of FIG. 19 and FIG. 6B, the signal current $I_{data}$ cannot be output to the pixel from the current source circuit in a period during which the setting operation is performed. Thus, two current source circuits are preferably provided for each signal line, in which an operation (setting operation) for setting a signal is performed to one of the current source circuits, and an operation (input operation) for inputting $I_{data}$ to the pixel is performed using the other current source circuit.

However, in the case where the setting operation and the input operation are not performed at the same time, only one current source circuit may be provided for each column. The current source circuit of each of FIGS. 28A and 29A is similar to the current source circuit of FIG. 19, except for the connection and current-flow paths. The current source circuit of FIG. 31A is similar, except for the difference in magnitude between the current supplied from the constant current source and the current flowing from the current source circuit. The current source circuits of FIGS. 6B and 29B are similar, except for the difference in magnitude between the current supplied from the constant current source and the current flowing from the current source circuit. Specifically, in FIG. 31A, only the gate width W of the transistor is different between the setting operation and the input operation; in FIGS. 6B and 29B, only the gate length L is different between the setting operation and the input operation; and others are similar to those of the structure of the current source circuit in FIG. 19.

In each of the current source circuits of FIGS. 20 and 21, the signal current $I_{data}$ set in the constant current source and the value of the current flowing to the pixel are dependent on the sizes of the two transistors provided in the current source circuit. In other words, the signal current $I_{data}$ set in the constant current source and the current flowing to the pixel can be arbitrarily changed by arbitrarily designing the sizes (W (gate width)/L (gate length)) of the two transistors provided in the current source circuit. However, output of a precise signal current $I_{data}$ to the pixel is difficult in the case where variation is caused in the characteristics of the two transistors, such as threshold values and mobility.

Further, in each of the current source circuits of FIGS. 20 and 21, the signal can be input to the pixel during the setting operation. That is, the setting operation for setting the signal can be performed simultaneously with the operation (input operation) for inputting the signal to the pixel. Thus, unlike the current source circuit of FIG. 19, two current source circuits do not need to be provided in a single signal line.

The present invention with the above structure can reduce the effects of characteristic variations in the TFT and supply a desired current to the outside.

Second Embodiment

The above has described that, for a current source circuit like the one shown in FIG. 6 (and, FIGS. 19, 31A, 6B, 29B, or the like), preferably, two current source circuits are provided for each signal line (each column), in which one of the current source circuits is used to perform the signal setting operation (set operation), and the other current source circuit is used to perform the $I_{data}$ input operation (input operation) to the pixel. This is because the setting operation and the input operation cannot be performed simultaneously. In this embodiment, an exemplary circuit structure of the current source circuit 420 shown in FIG. 2, which has a signal drive circuit of the present invention, will be described with reference to FIG. 8.

In the present invention, a setting signal input from a terminal a represents a signal input from an output terminal of a logical operator. In other words, the setting signal in FIG. 1 corresponds to the signal input from the output terminal of the logical operator. In the present invention, the setting operation of the current source circuit 420 is performed in accordance with the signal input from the output terminal of the logical operator.

One of two input terminals of the logical operator is input with a sampling pulse from a register, and the other is input with a latch pulse. In the logical operator, a logic operation of two signals which have been input is performed, and a signal from the output terminal is output. Then in the current source circuit, the setting operation or the input operation is performed according to the signal input from the output terminal of the logical operator.

The current source circuit 420 is controlled by a setting signal input via the terminal a, and is input with a signal current supplied from the terminal b, thereby the current source circuit 420 outputs a current proportional to the signal current (a video-signal current) from the terminal c.

Figure 8A:
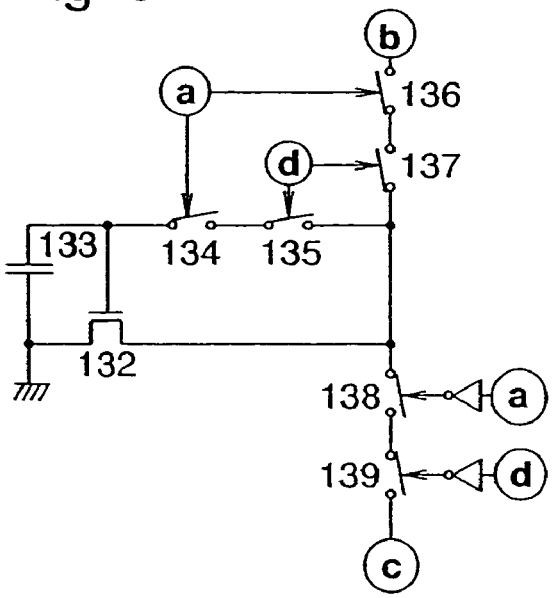
FIGS. 8A-8B are circuit diagrams of current source circuits.

Referring to FIG. 8A, a circuit including switches 134 to 139, a transistor 132 (n-channel type), and a capacitor device 133 for retaining a gate-source voltage VGS of the transistor 132 corresponds to the first current source circuit 421 or the second current source circuit 422.

In the first current source circuit 421 or the second current source circuit 422, the switch 134 and the switch 136 are turned ON by the signal input via the terminal a. Further, the switch 135 and the switch 137 are turned ON by the signal input from the control line via the terminal d. Then, a current (a video-signal current) is supplied via the terminal b from the video-signal current source 109 connected to the current line, and a charge is retained in the capacitor device 133. The charge is retained in the capacitor device 133 until the signal current $I_{data}$ flown from the video-signal current source 109 becomes identical with a drain current of the transistor 132.

Subsequently, the switches 134 to 137 are turned OFF by the signals input via the terminals a and d. As a result, since a predetermined charge is retained in the capacitor device 133, the transistor 132 is imparted with a capability of flowing a current having a magnitude corresponding to that of the signal current $I_{data}$. If the switches 101, 138 and 139 are turned into a conductive state, a current flows to a pixel connected to the signal line via the terminal c. At this time, since the gate voltage of the transistor 132 is maintained by the capacitor device 133 at the predetermined gate voltage, a drain current corresponding to the signal current $I_{data}$ flows to the drain region of the transistor 132. Thus, the effects of the characteristic variations of TFTs constituting the signal line drive circuit is reduced, and the magnitude of the current input to the pixel can be controlled.

Figure 8B:
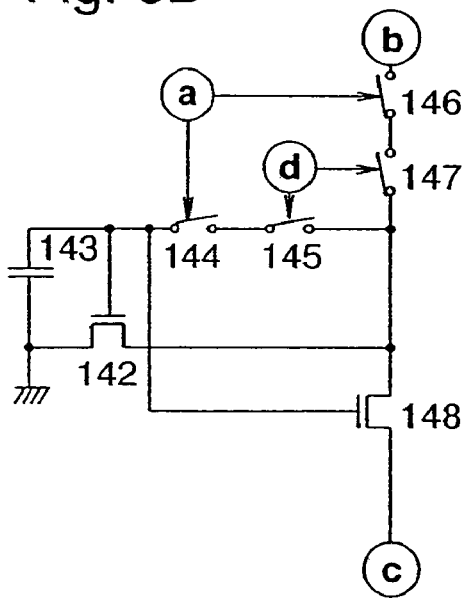

Referring to FIG. 8B, a circuit including switches 144 to 147, a transistor 142 (n-channel type), a capacitor device 143 for retaining a gate-source voltage VGS of the transistor 142, and a transistor 148 (n-channel type) corresponds to the first current source circuit 421 or the second current source circuit 422.

In the first current source circuit 421 or the second current source circuit 422, the switch 144 and the switch 146 are turned ON by the signal input via the terminal a. Further, the switch 145 and the switch 147 are turned ON by the signal input from the control line via the terminal d. Then, a current is supplied via the terminal b from the constant current source 109 connected to the current line, and a charge is retained in the capacitor device 143. The charge is retained in the capacitor device 143 until a signal current $I_{data}$ that is flown from the constant current source 109 becomes identical with a drain current of the transistor 142. When the switch 144 and the switch 145 are turned ON, since a gate-source voltage VGS of the transistor 148 is set to 0 V, the transistor 148 is automatically turned OFF.

Subsequently, the switches 144 to 147 are turned OFF by the signals input via the terminals a and d. As a result, since the signal current $I_{data}$ is retained in the capacitor device 143, the transistor 142 has a capability of flowing a current having a magnitude corresponding to that of the signal current $I_{data}$. If the switch 101 is turned to a conductive state, a current is supplied to a pixel connected to the signal line via the terminal c. At this time, since the gate voltage of the transistor 142 is maintained by the capacitor device 143 at a predetermined gate voltage, a drain current corresponding to the signal current $I_{data}$ flows to a drain region of the transistor 142. Thus, the effects of the characteristic variations of TFTs constituting the signal line drive circuit is reduced, and the magnitude of the current input to the pixel can be controlled.

When the switches 144 and 145 have been turned OFF, gate and source potentials of the transistor 126 are varied not to be the same. As a result, since the charge retained in the capacitor device 143 is distributed also to the transistor 148, and the transistor 148 is automatically turned ON. Here, the transistors 142 and 148 are connected in series, and the gates thereof are connected. Accordingly, each of the transistors 142 and 148 serves as a multi-gate transistor. That is, a gate length L of the transistor varies between the setting operation and the input operation. Therefore, the value of the current supplied from the terminal b at the time of the setting operation can be made larger than that from the terminal c at the time of the input operation. Thus, various loads (such as wiring resistances and cross capacitances) disposed between the terminal b and the video-signal current source can be charged even faster. Consequently, the setting operation can be completed quickly.

Note that FIG. 8A corresponds to a structure in which the terminal d is added to the structure of FIG. 6A. FIG. 8B corresponds to a structure in which the terminal d is added to the structure of FIG. 6B. Thus, the structures of FIGS. 6A and 6B are added with switches in series, thereby being modified to those of FIGS. 8A and 8B each of which is added with the terminal d. The structure of the current source circuit shown in, for example, FIG. 6, 7, 28, 29, or 31 can be arbitrarily used by arranging two switches in series in the first current source circuit 421 or the second current source circuit 422 of FIG. 2.

Figure 2:
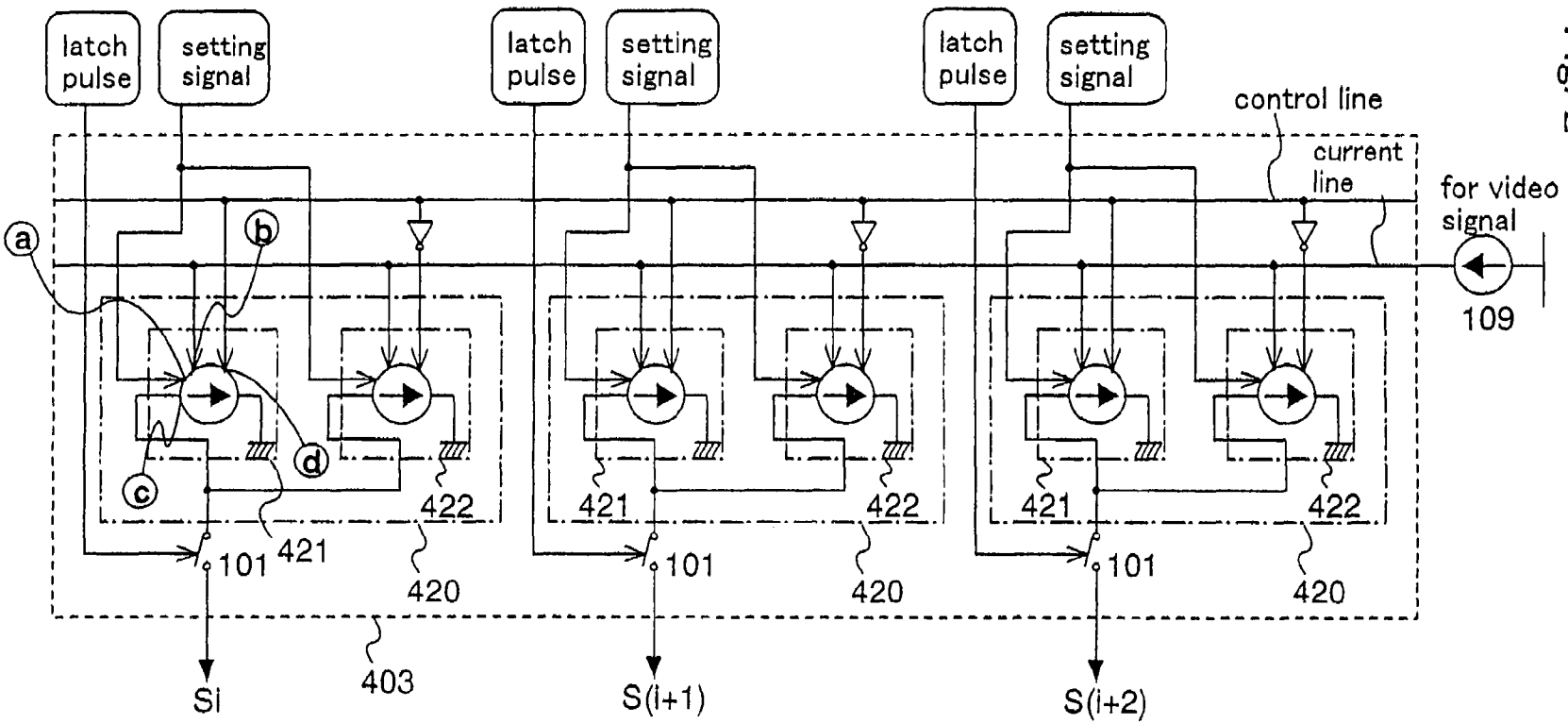
FIG. 2 is a view of a signal line drive circuit.

The structure in which the current source circuit 420 including for each signal line the two current source circuits, namely, the first and second current source circuits 421 and 422, is shown in FIG. 2. However, the present invention is not limited to this. For example, three current source circuits 420 may be provided for each signal line. Then, a signal current may be set by different r constant current sources 109 for the respective current source circuits 420. For example, it may be such that a 1-bit video-signal current source is used to set a signal current for one of the current source circuits 420, a 2-bit video-signal current source is used to set a signal current for one of the current source circuits 420, and a 3-bit video-signal current source is used to set a signal current for one of the current source circuits 420. Thus, 3-bit display can be performed.

This embodiment may be arbitrarily combined with first embodiment. That is, as shown in FIGS. 4, 5, 26 and 27, current source circuits of FIG. 6 can be disposed such that two current source circuits are disposed in each column as shown in FIG. 2 from that one current source circuit is disposed in each column. Then, for example, in FIG. 2, assuming that a current supplied from the current source circuit 421 is 4.9A, a current supplied from the current source circuit 422 is 5.1A, by supplying a current from either the current source circuit 421 or the current source circuit 422 in each frame, variation of the current source circuits can be averaged.

This embodiment may be arbitrarily combined with first embodiment.

Third Embodiment

In this embodiment, the structure of a light emitting device including the signal line drive circuit of the present invention will be described using FIG. 15.

The light emitting device includes a pixel portion 402 including a plurality of pixels arranged in matrix on a substrate 401, and includes a signal line drive circuit 403 and a first scanning line drive circuit 404 and a second scanning line drive circuit 405 in the periphery of the pixel portion 402. While the signal line drive circuit 403 and the two scanning line drive circuits 404 and 405 are provided in FIG. 15A, the present invention is not limited to this. The number of drive circuits may be arbitrarily designed depending on the pixel structure. Signals are supplied from the outside to the signal line drive circuit 403, the first scanning line drive circuit 404 and the second scanning line drive circuit 405 via FPCs 406.

Figure 15A:
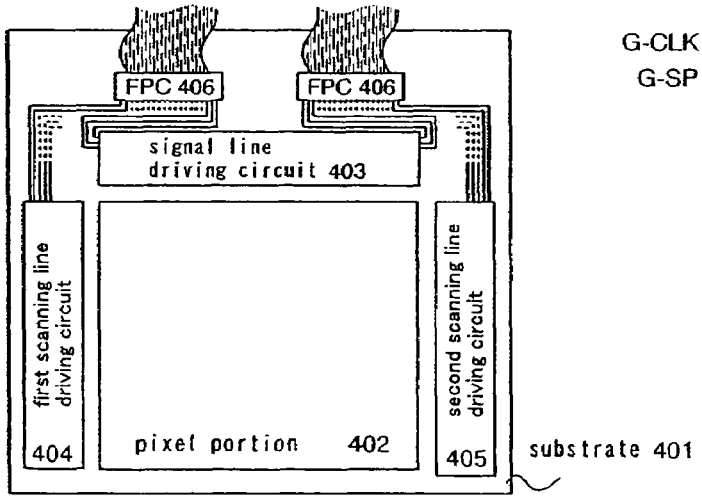
FIGS. 15A-15B are views of a light emitting device of the present invention.
Figure 15B:
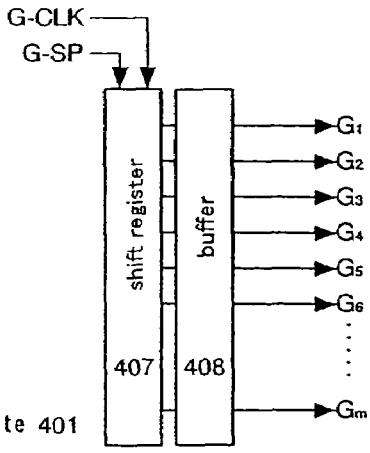

The structures and operations of the first scanning line drive circuit 404 and the second scanning line drive circuit 405 will be described using FIG. 15B. Each the first scanning line drive circuit 404 and the second scanning line drive circuit 405 includes a shift register 407 and a buffer 408. If the operation is described briefly, the shift register 407 sequentially outputs sampling pulses in accordance with a clock signal (G-CLK), a start pulse (S-SP), and an inverted clock signal (G-CLKb). Thereafter, the sampling pulses amplified in the buffer 408 are input to scanning lines, and the scanning lines are set to be in a selected state for each line. Signals are sequentially written to pixels controlled by the selected signal lines.

Note that the structure may be such that a level shifter circuit is disposed between the shift register 407 and the buffer 408. Disposition of the level shifter circuit enables the voltage amplitude to be increased.

The structure of the signal line drive circuit 403 will be hereafter described. This embodiment may be arbitrarily combined with Embodiments 1 and 2.

Fourth Embodiment

In this embodiment, the configuration and the operation of the signal-line drive circuit 403 shown in FIG. 15A will be described. In this embodiment, the signal-line drive circuit 403 used for performing analog intensity-level assigning or 1-bit digital intensity-level assigning will be described with reference to FIG. 3A and FIG. 4.

Figure 3A:
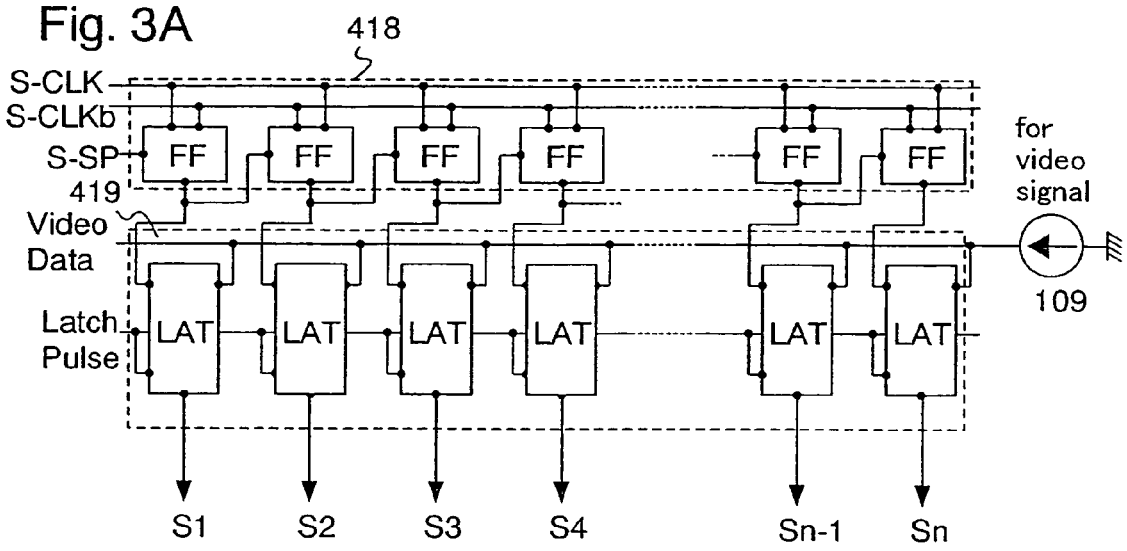
FIGS. 3A-3B are views of a signal line drive circuit (1-bit, 2-bit).

FIG. 3A is a schematic diagram of the signal-line drive circuit 403 in analog intensity-level assigning or 1-bit digital intensity-level assigning. The signal-line drive circuit 403 includes a shift register 418 and a latch circuit 419.

A brief description of the operation will be given. The shift register 418 is configured using a plurality of columns of flip-flop circuits (FFs), to which a clock signal (S-CLK), a start pulse (S-SP), and a clock inversion signal (S-CLKb) are inputted. Sampling pulses are outputted in sequence in accordance with the timing of such signals.

The sampling pulses outputted from the shift register 418 are inputted to the latch circuit 419. To the latch circuit 419, a video signal (an analog video signal or a digital video signal) are inputted, which are held in each column in accordance with the timing of inputting the sampling pulses.

A constant current source 109 for a video signal is connected to a video line. A signal current (corresponding to the video signal) set in the video-signal constant current source 109 is held in the latch circuit 419.

A latch pulse is inputted to the latch circuit 419, and the video signal held in the latch circuit 419 is inputted to pixels connected to the signal line. The latch circuit 419 is sometimes responsible for converting a digital signal to an analog signal.

Figure 4:
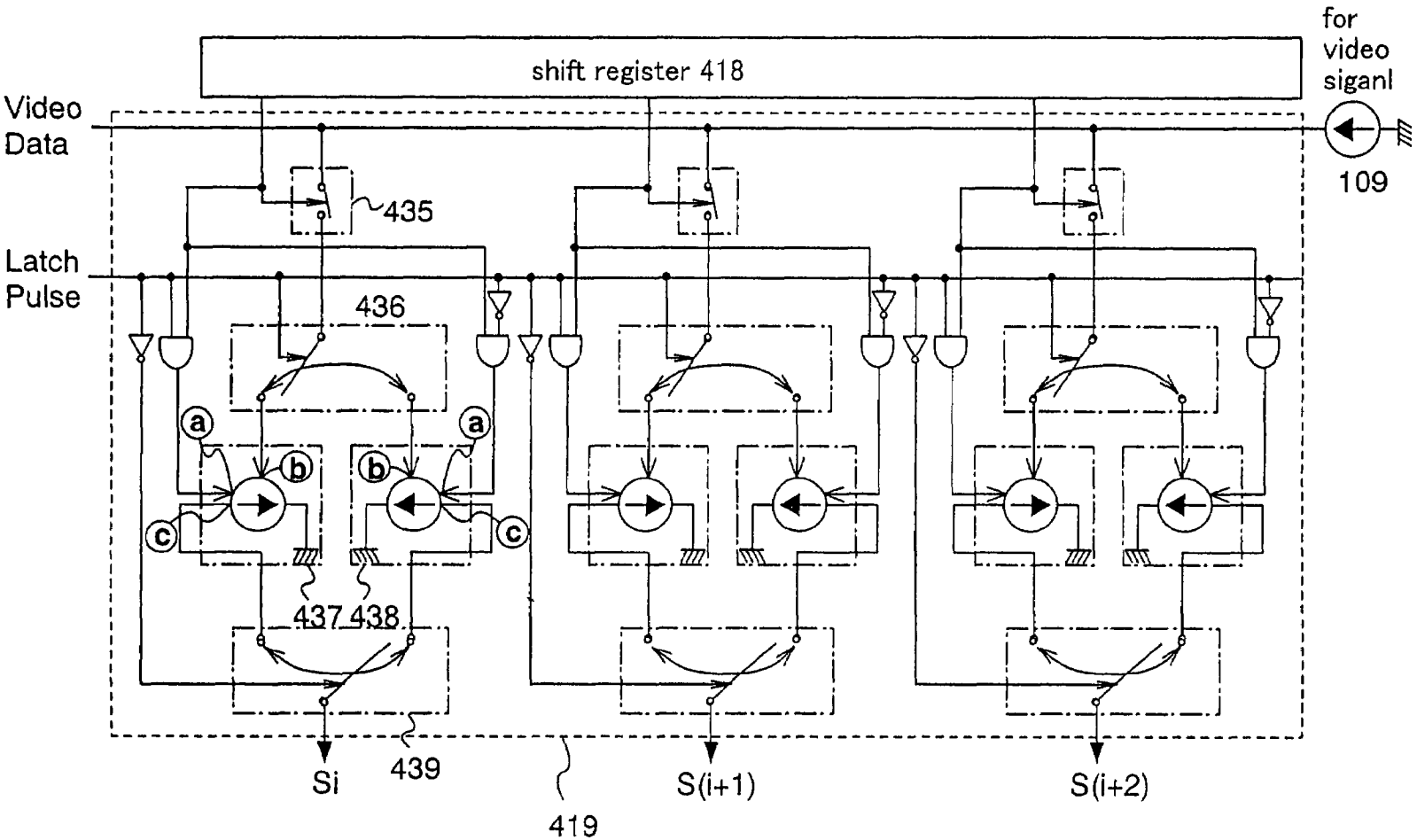
FIG. 4 is a view of a signal line drive circuit (1-bit).

Next, the configuration of the latch circuit 419 will be described with reference to FIG. 4. FIG. 4 shows the outline of the signal-line drive circuit 403 around the ith to (i+2)th three signal lines.

The latch circuit 419 includes a switch 435, a switch 436, a current source circuit 437, a current source circuit 438, and a switch 439 for each column. The switch 435 is controlled by the sampling pulse inputted from the shift register 418. The switch 436 and the switch 439 are controlled by the latch pulses.

To the switch 436 and the switch 439, inverted signals from each other are inputted. As a result, one of the current source circuit 437 and the current source circuit 438 performs setting operation and the other performs inputting operation.

In other words, when the current source circuit 437 performs setting operation, the current source circuit 438 outputs a signal current to pixels, thus performing inputting operation at the same time. In this manner, the setting operation and the inputting operation of the current source s can be performed at the same time, allowing the setting operation to be accurately performed over a long period of time.

This allows line-sequential driving.

The signal current supplied from the video line (video data line) has a magnitude depending on the video signal. Thus, the amount of current supplied to the pixels is proportional to the signal current, allowing the provision of an image (a tone image).

The current source circuit 437 and the current source circuit 438 are controlled by the signal inputted through the terminal a. The current source circuit 437 and the current source circuit 438 also hold a current (signal current $I_{data}$) set using the video-signal constant current source 109 connected to the video line (current line) via the terminal b. The switch 439 is arranged between the current source circuit 437 and the current source circuit 438 and the pixels connected to the signal line, wherein the On/OFF of the switch 439 is controlled by the latch pulse.

For performing 1-bit digital intensity-level assigning, when the video signal is a light signal, the signal current $I_{data}$ is outputted from the current source circuit 437 or the current source circuit 438 to the pixels. On the other hand, when the video signal is a dark signal, the current source circuit 437 or the current source circuit 438 has no ability of feeding current, thus feeding no current to the pixels. For performing analog intensity-level assigning, a signal current $I_{data}$ is outputted from a current source circuit 433 to the pixels in response to the video signal. More specifically, in the current source circuit 437 and the current source circuit 438, the capacity ($V_{GS}$) of feeding a constant current is controlled by the video signal; thus, the brightness is controlled depending on the magnitude of the current outputted to the pixels.

In the present invention, a setting signal inputted from the terminal a indicates a signal inputted from the output terminal of the logical operator. In other words, the setting signal in FIG. 1 corresponds to a signal inputted from the output terminal of the logical operator. In the present invention, the current source circuit 420 is set in correspondence with the signal inputted from the output terminal of the logical operator.

The sampling pulse from the shift register is inputted to one of the two input terminals of the logical operator and the latch pulse is inputted to the other. The logical operator performs logical operation of the two inputted signal and outputs a signal from the output terminal. In the current source circuits, setting operation or inputting operation is performed in response to the signal inputted from the output terminal of the logical operator.

The current source circuit 437 and the current source circuit 438 may freely employ the configuration of the current source circuits shown in FIGS. 6 and 7, FIG. 29, FIG. 28, and FIG. 31. The current source circuits may not employ only one system but a plurality of systems.

Figure 33:
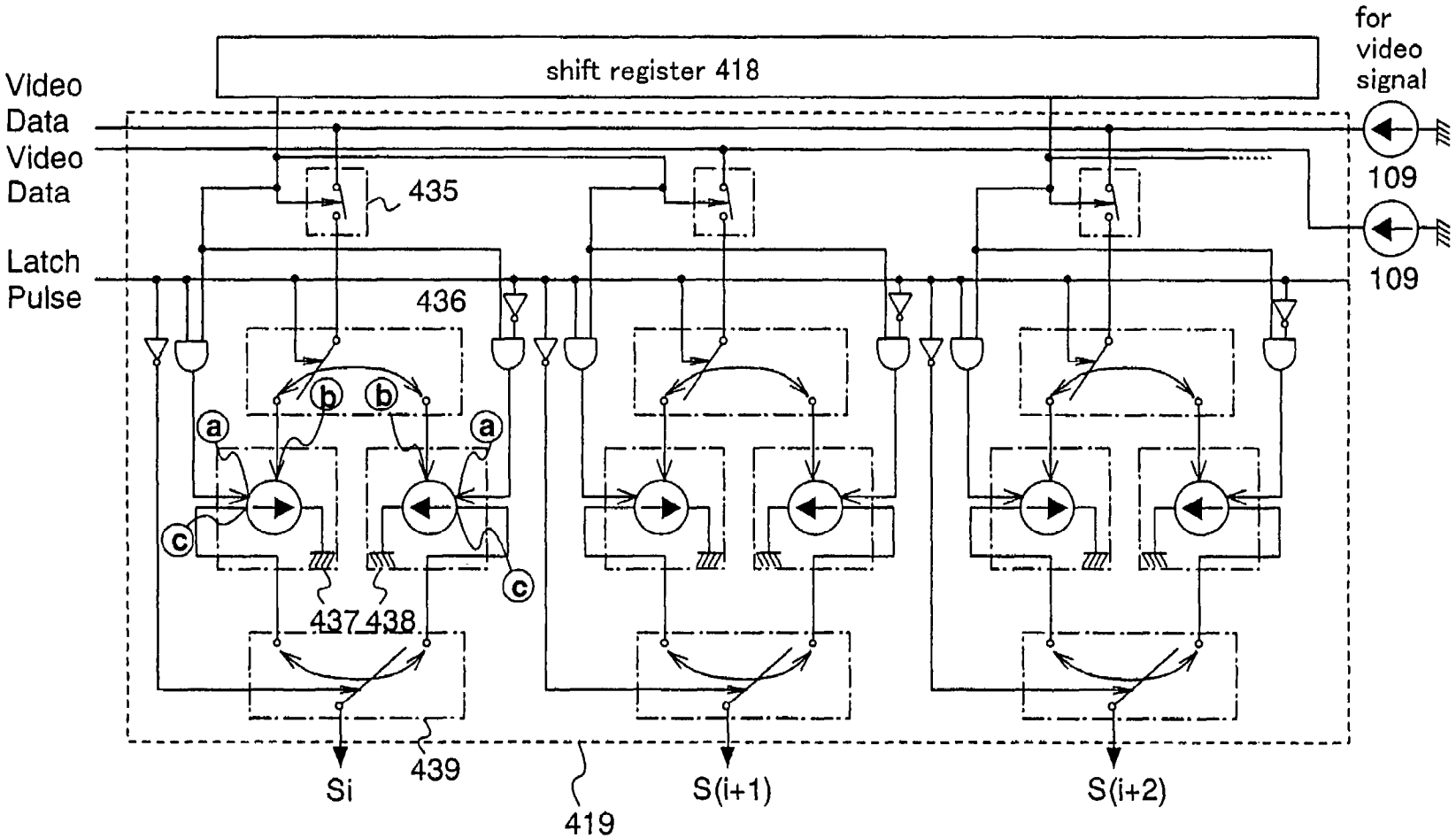
FIG. 33 is a view showing a signal line drive circuit.

In FIG. 4, while the latch circuits are configured for one column from the video-signal constant current source 109, it is not limited to that. As shown in FIG. 33, a plurality of columns may be configured at the same time; in other words, polyphase configuration is possible. While FIG. 33 shows an arrangement of two video-signal constant current source s 109, another video-signal constant current source may be perform setting operation for the two video-signal constant current source s.

The following are examples of a combination system of the current source circuit 437 and the current source circuit 438 and the advantages thereof.

First, an example of employing a circuit of FIG. 6A for the current source circuit 437 and the current source circuit 438 will be described. Using a current source circuit as in FIG. 6A allows the decrease of the number of transistors to be arranged, thus further reducing the effects of variations in the characteristics of the transistors. In other words, since a transistor for setting operation and a transistor for inputting operation are the identical transistor, they are not affected by the variations between the transistors at all. However, since the current in setting operation cannot be increased, setting operation cannot be performed more quickly. The current in setting operation corresponds to the current supplied to the latch circuit from the video-signal constant current source 109.

Figure 34:
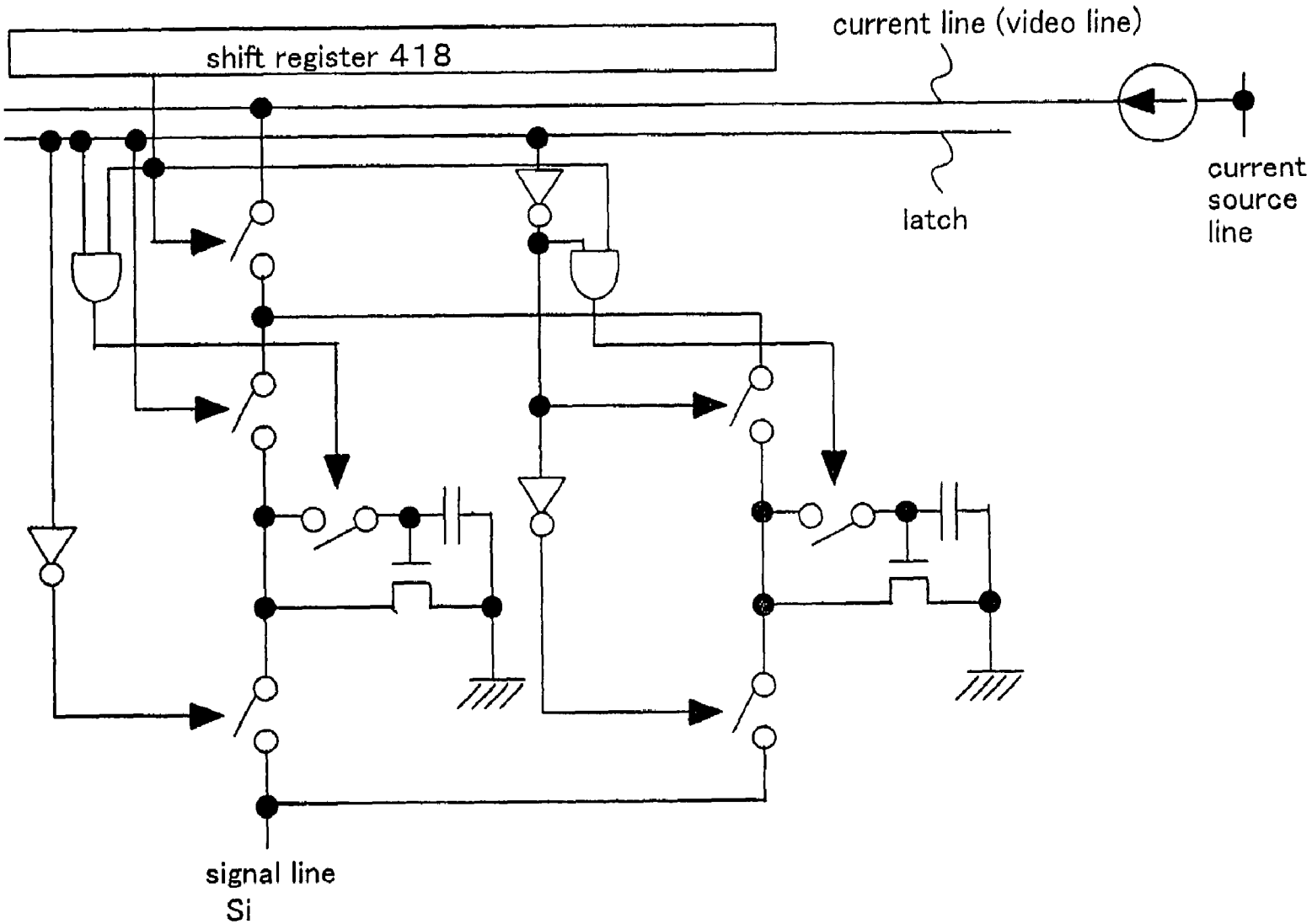
FIG. 34 is a view showing a signal line drive circuit.

The circuit diagram in this case is shown in FIG. 34.

Figure 35:
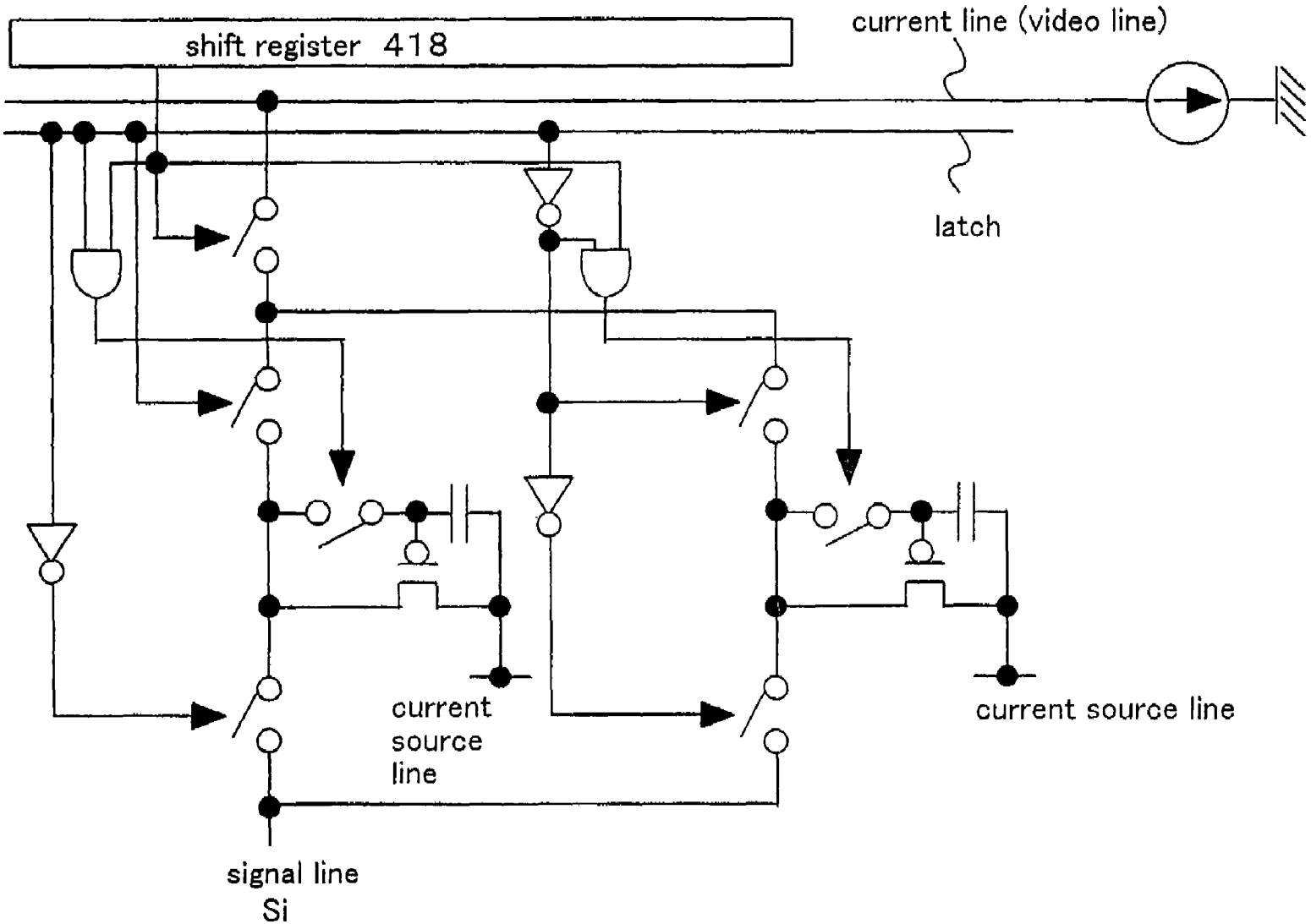
FIG. 35 is a view showing a signal line drive circuit.

In FIG. 34, a current flows from the pixels toward the current source circuit through a signal line. However, the direction of the current varies depending on the pixel configuration. Therefore, FIG. 35 shows a circuit diagram when a current flows from the circuit source circuit toward the pixels.

In this manner, a circuit in the case where the direction of the current is different can be configured by changing the polarities of the transistors. Alternatively, by using a circuit of FIG. 7A in place of FIG. 6A, a circuit in the case where the direction of the current is different can also be configured without changing the polarities of the transistors.

Next, a case where a current mirror circuit as shown in FIG. 6C is employed as the current source circuit 437 and the current source circuit 438 will be described with reference to FIG. 36.

In the two transistors of the current mirror circuit as in FIG. 6C, when the value of W (gate width)/L (gate length) of the transistor connected to the pixels is made lower than that of the transistor connected to the video-signal constant current source 109, the current value supplied from the video-signal constant current source 109 can be made high.

In other words, the value W/L of the transistor for setting operation is set higher than the value W/L of the transistor for inputting operation. Then, the current for setting operation, that is, the current flowing from the video-signal constant current source 109 to the latch circuit can be made high. High current allows electrical charge to quickly be carried to a wiring cross capacitance accompanying wirings, thereby entering a steady state quickly. Thus, setting operation can be performed more quickly.

The current mirror circuit as in FIG. 6C includes at least two transistors having a gate electrode in common or electrically connected thereto. When the two transistors vary in characteristics, the currents outputted from the source terminals or drain terminals of the transistors also vary. However, if the two transistors have identical characteristics, the currents outputted therefrom do not vary. Conversely, the characteristics of the two transistors need to be identical in order not to vary the outputted currents. In other words, in the current mirror circuit as in FIG. 6C, it is sufficient for the two transistors having a gate electrode in common or electrically connected thereto to have identical characteristics. There is no need for transistors having no common gate electrode to have the identical characteristics. This is because setting operation is performed for each current source circuit. In other words, it is sufficient for the transistor for the setting operation and the transistor used for inputting operation to have the identical characteristics. Even when the transistors having no common gate electrode have not identical characteristics, setting operation is performed for each current source circuit; therefore, variations in characteristics are corrected.

In general, in the current mirror circuit as in FIG. 6C, the two transistors having a gate electrode in common or electrically connected thereto are arranged in close proximity to each other in order to reduce the variations in the characteristics of the two transistors.

Figure 36:
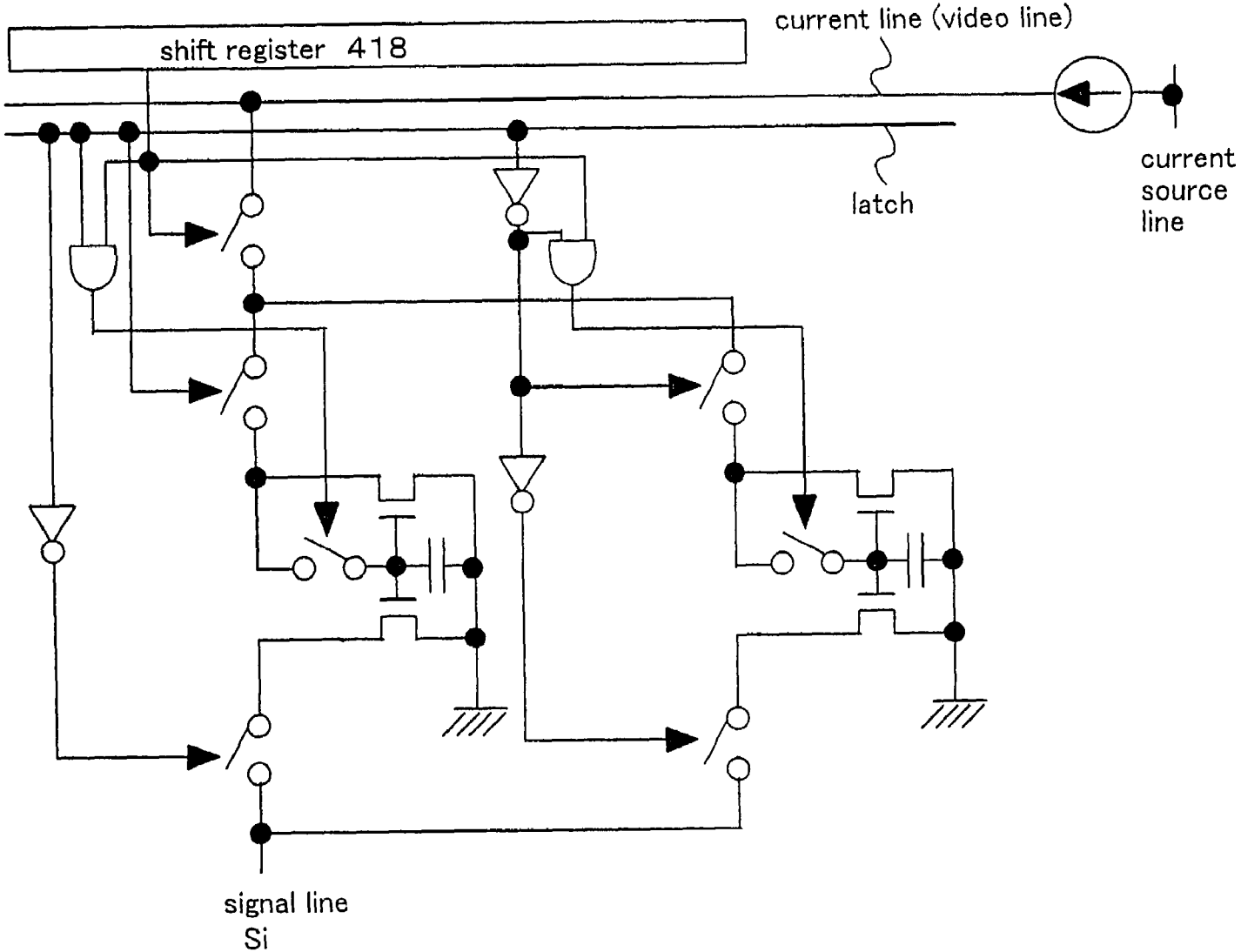
FIG. 36 is a view showing a signal line drive circuit.

Referring to FIG. 36, let the magnitude of current applied to the pixels be P. In the two transistors of the current mirror circuit as in FIG. 6C in the current source circuits (the current source circuits 437 and 438), if the value W/L of the transistor connected to the pixels is Wa, the value W/L of the transistor connected to the video signal line is set to (2×Wa). Then, the current value becomes twice in the current source circuits (the current source circuits 437 and 438). Then, the video-signal constant current source 109 supplies a current of (2×P). Consequently, since the current supplied from the video-signal constant current source 109 can be made high, the setting operation for the current source circuits (the current source circuits 437 and 438) can be performed quickly and accurately.

In summary, by employing the current mirror circuit as in FIG. 6C for a current source circuit and setting the value W/L to an appropriate value, the current supplied from the video-signal constant current source 109 can be made high. As a result, the setting operation for the current source circuit can be performed accurately.

In other words, high current allows electrical charge to be carried quickly to a wiring cross capacitance parasitic on wirings, thereby entering a steady state. In the steady state, setting operation can be performed sufficiently. In performing the setting operation in a certain period of time, high current allows the circuit to enter a steady state quickly; thus, the setting operation can be performed sufficiently. If current is low, the duration of setting operation is completed before entering the steady state. In such a case, for lack of sufficient time, accurate setting operation cannot be performed. Therefore, high current allows quick and accurate setting operation for the current source circuit.

However, the current mirror circuit as in FIG. 6C includes at least two transistors having a gate electrode in common or electrically connected thereto, wherein the variations in the characteristics of the two transistors cause the variations of the current outputted therefrom.

However, the magnitude of the current can be varied by setting the ratio W/L of the channel width W and the channel length L of the transistor to different values between the two transistors. Generally, the current in setting operation is set high, thus allowing quick setting operation.

The current in setting operation corresponds to the current supplied from the video-signal constant current source 109.

On the other hand, when the circuit as in FIG. 6A is used, the current flowing in setting operation and the current flowing in inputting operation are substantially equal. Therefore, the current for setting operation cannot be set high. However, the transistor for supplying current in setting operation and the transistor for supplying current in inputting operation are the identical. Therefore, they are not affected by the variations between the transistors at all. Accordingly, it is preferable to use an appropriate combination in the latch circuit, such as to use the current mirror circuit as in FIG. 6C for part where high current is desired in setting operation and to use the circuit as in FIG. 6A for part where more accurate current is desired to output.

Figure 48:
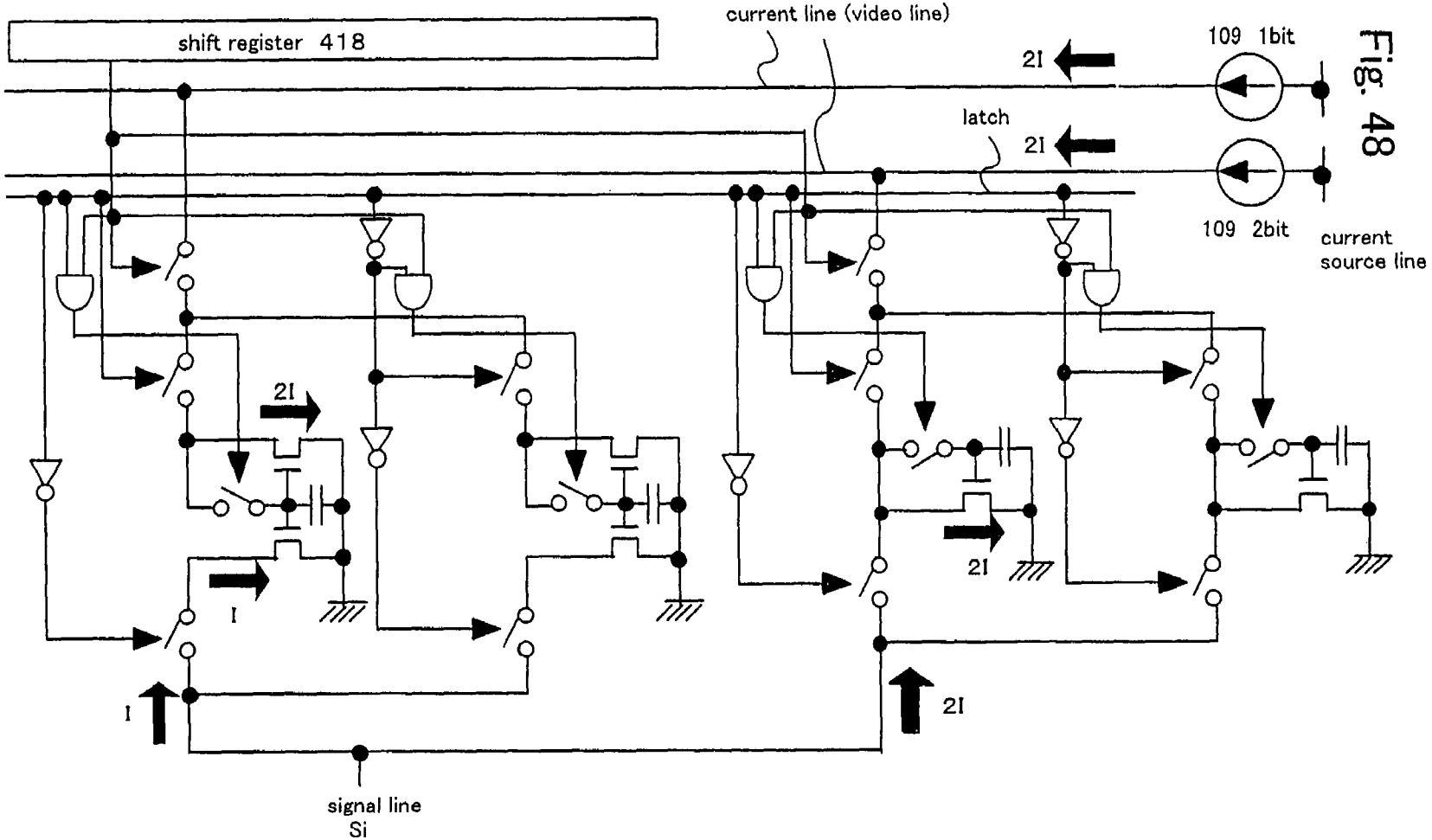
FIG. 48 is a view of a signal line drive circuit.

FIG. 48 shows a circuit diagram when the current mirror circuit as in FIG. 6C is used in a low-order-bit (first-bit) current source circuit and the circuit as in FIG. 6A is used in a high-order-bit (second-bit) current source circuit.

Transistors operated only as switches may have either polarity.

Figure 1:
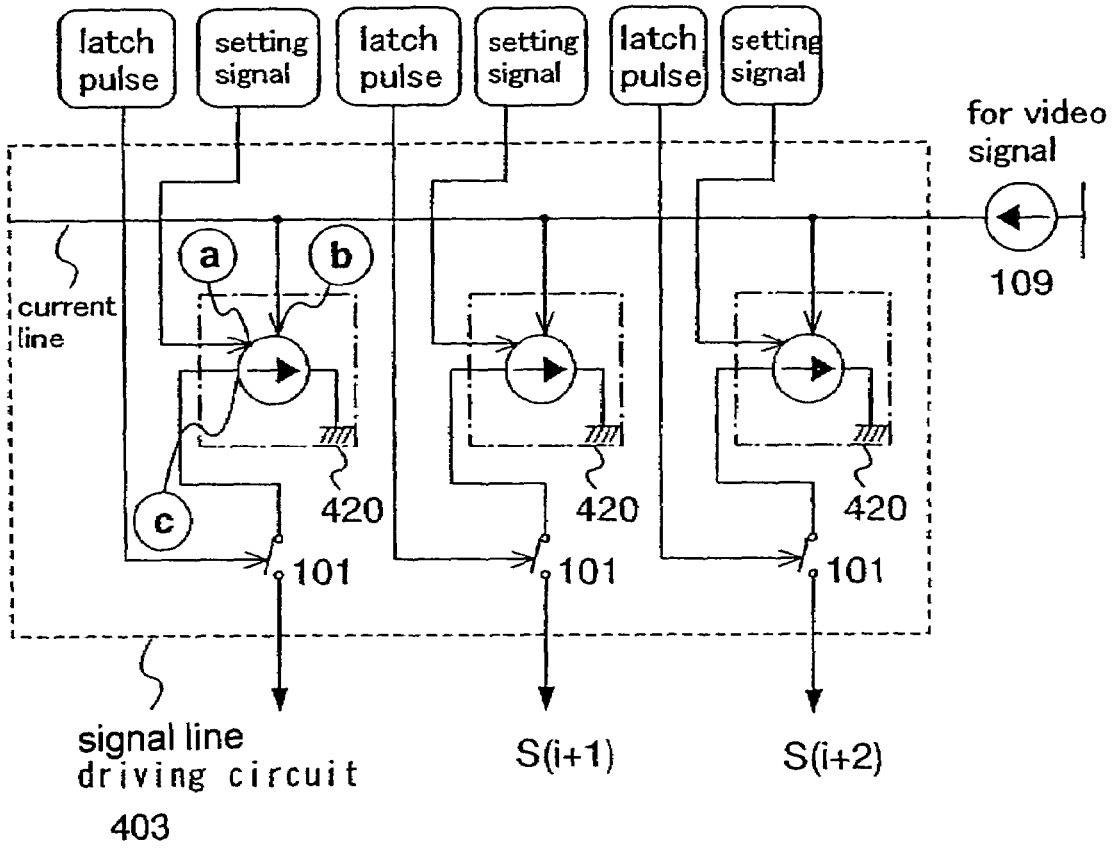
FIG. 1 is a view of a signal line drive circuit.

FIG. 4 showed a case in which the circuit of FIG. 2 was applied to the circuit of FIG. 3A. Subsequently, a case in which the circuit of FIG. 1 is applied to the circuit of FIG. 3A will be described with reference to FIG. 37.

Figure 37A:
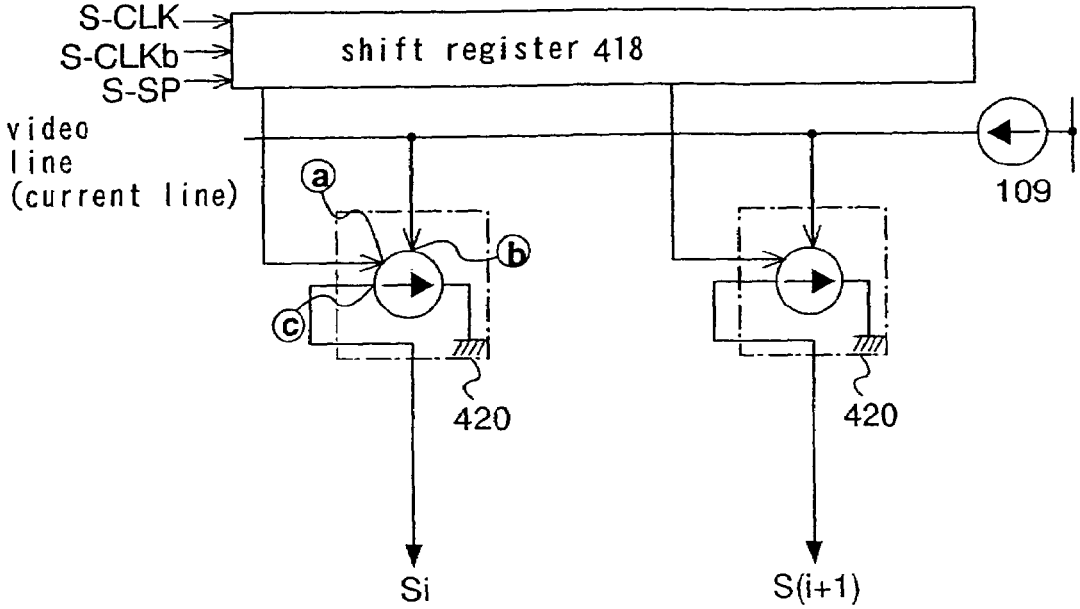
FIGS. 37A-37C are views showing a signal line drive circuit.

Referring to FIG. 37A, a video signal (signal current) supplied over a video line is supplied to a current source circuit. The setting operation for the current source circuit is performed in accordance with the timing of a sampling pulse supplied from the shift register 418. For example, with the configuration of FIG. 37A, the inputting operation (current output to pixels) is started after the setting operation of the current source circuit, thus allowing point sequential drive to be performed by sequentially setting the current source circuit on a column-by-column basis and then performing inputting operation.

Figure 38:
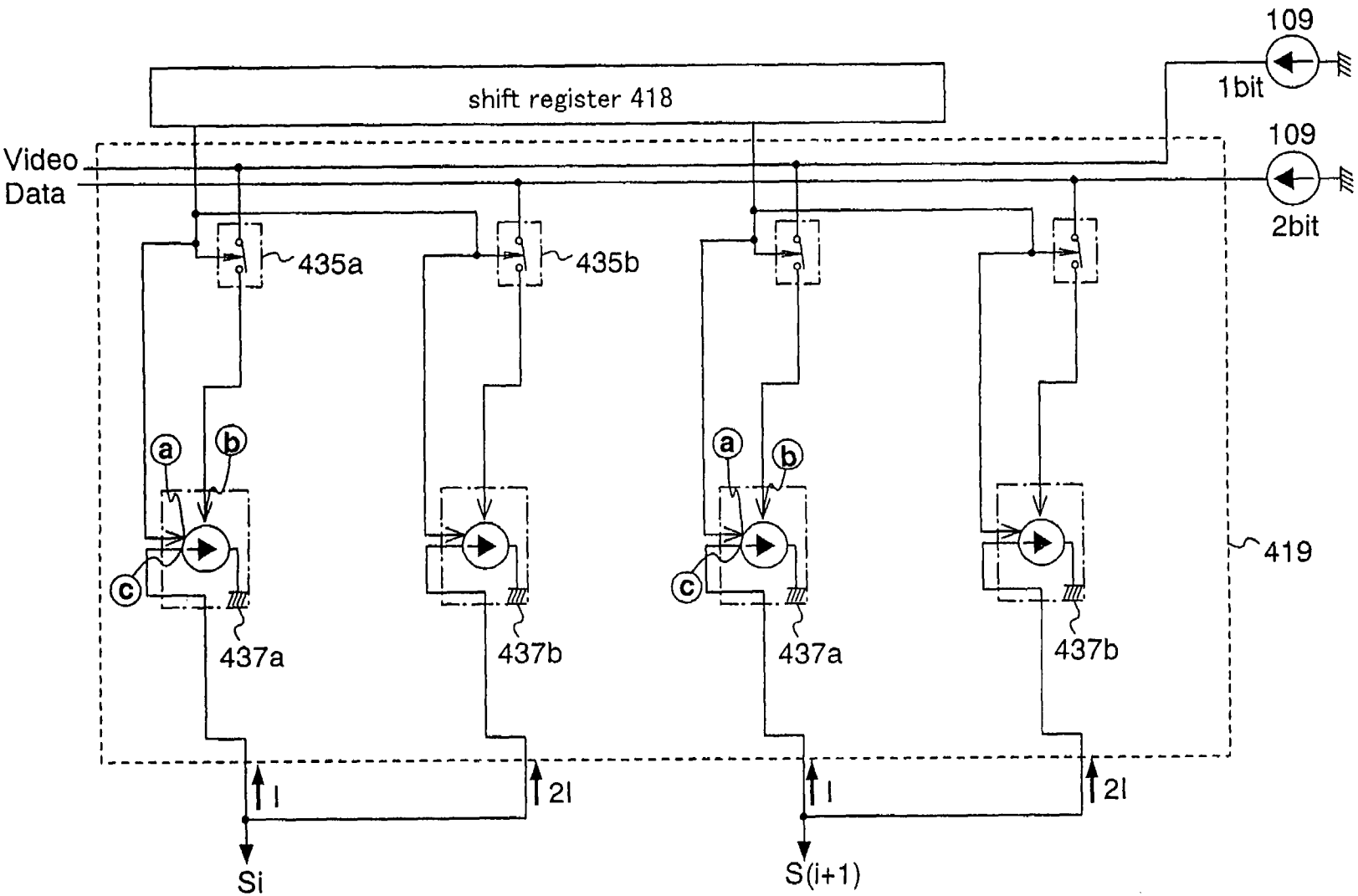
FIG. 38 is a view showing a signal line drive circuit.

FIG. 37A shows a case of analog intensity-level assigning or a 1-bit digital intensity level; and FIG. 38 shows a case of 2-bit digital intensity level.

Figure 39:
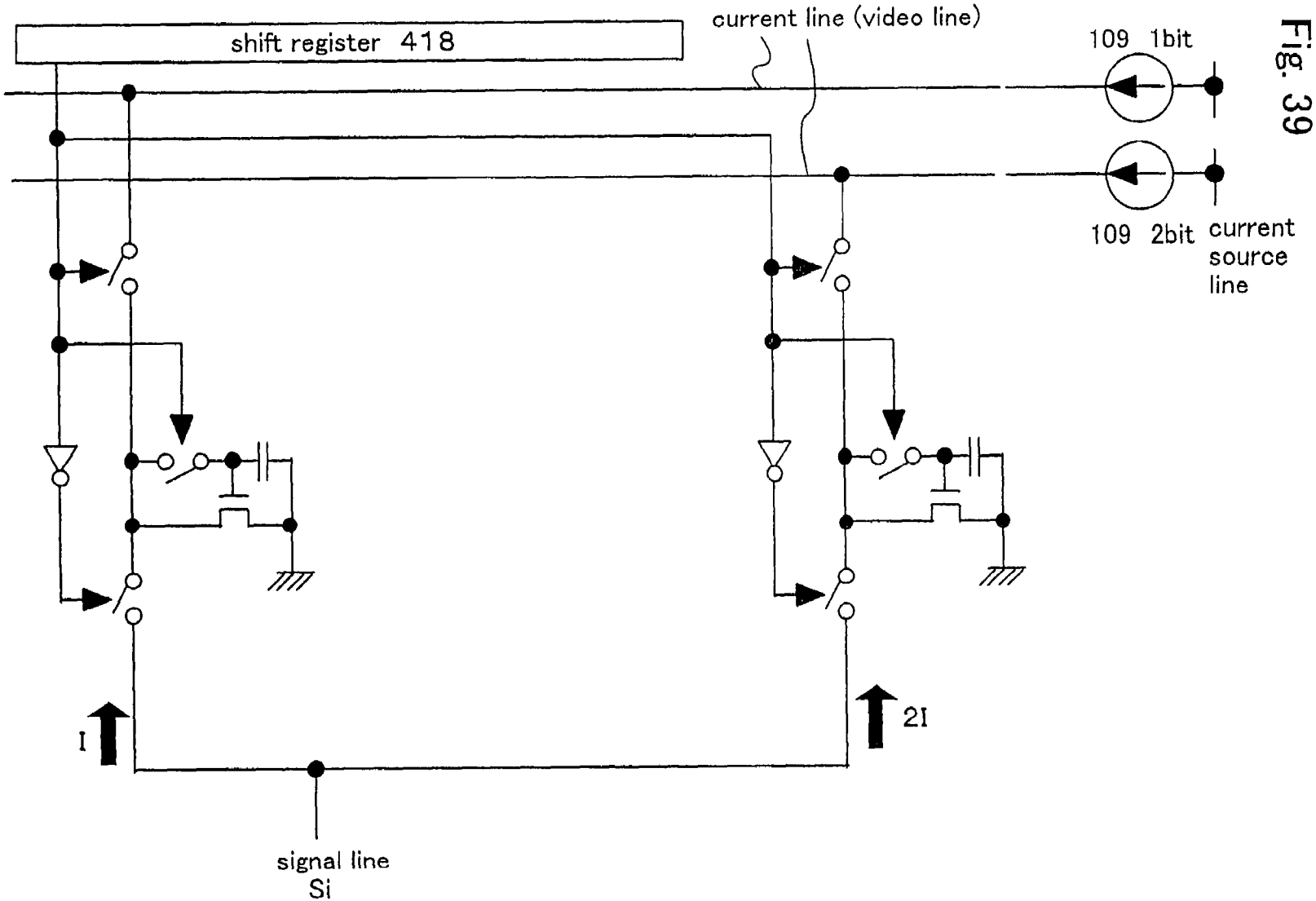
FIG. 39 is a view showing a signal line drive circuit.
Figure 40:
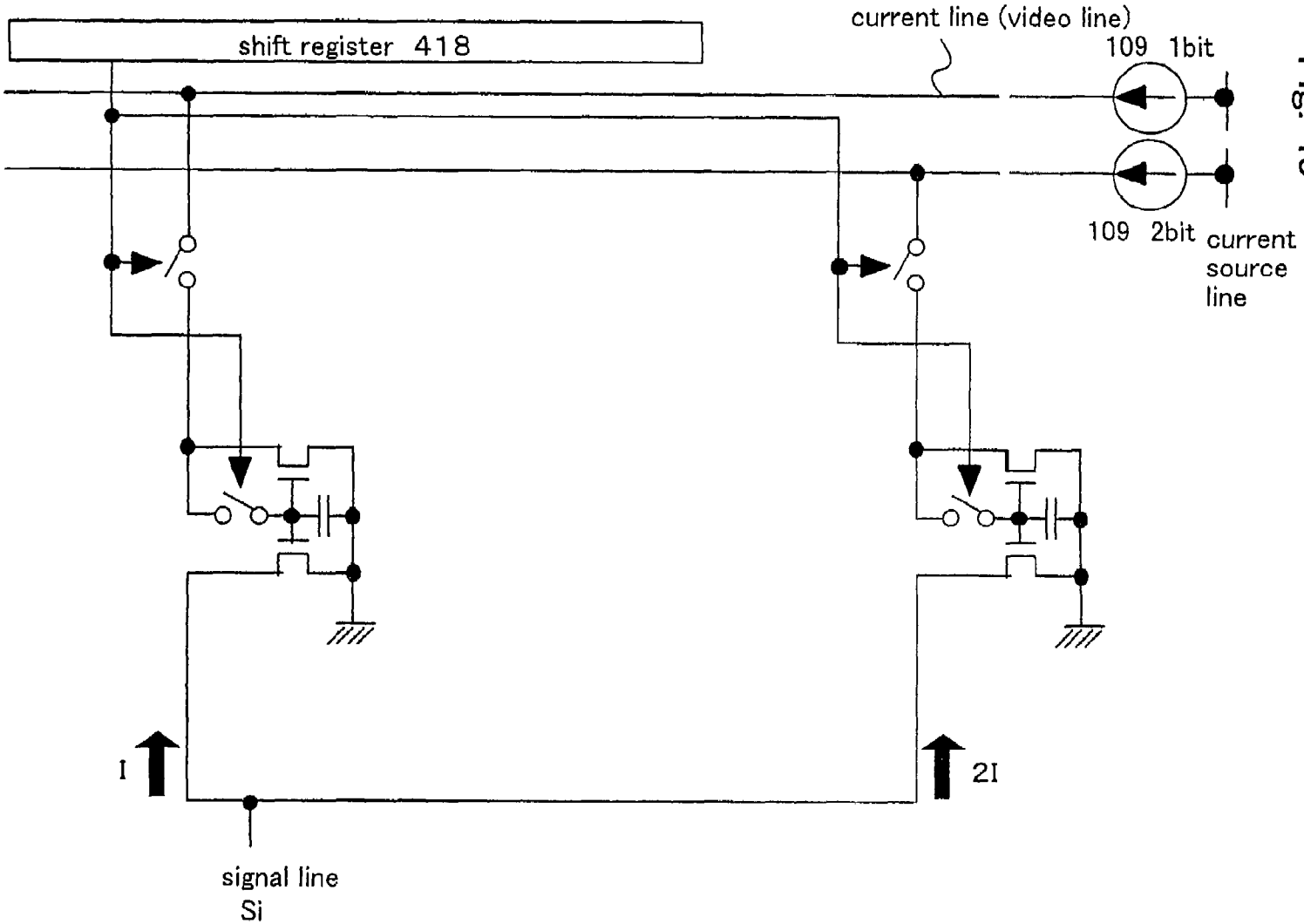
FIG. 40 is a view showing a signal line drive circuit.
Figure 41:
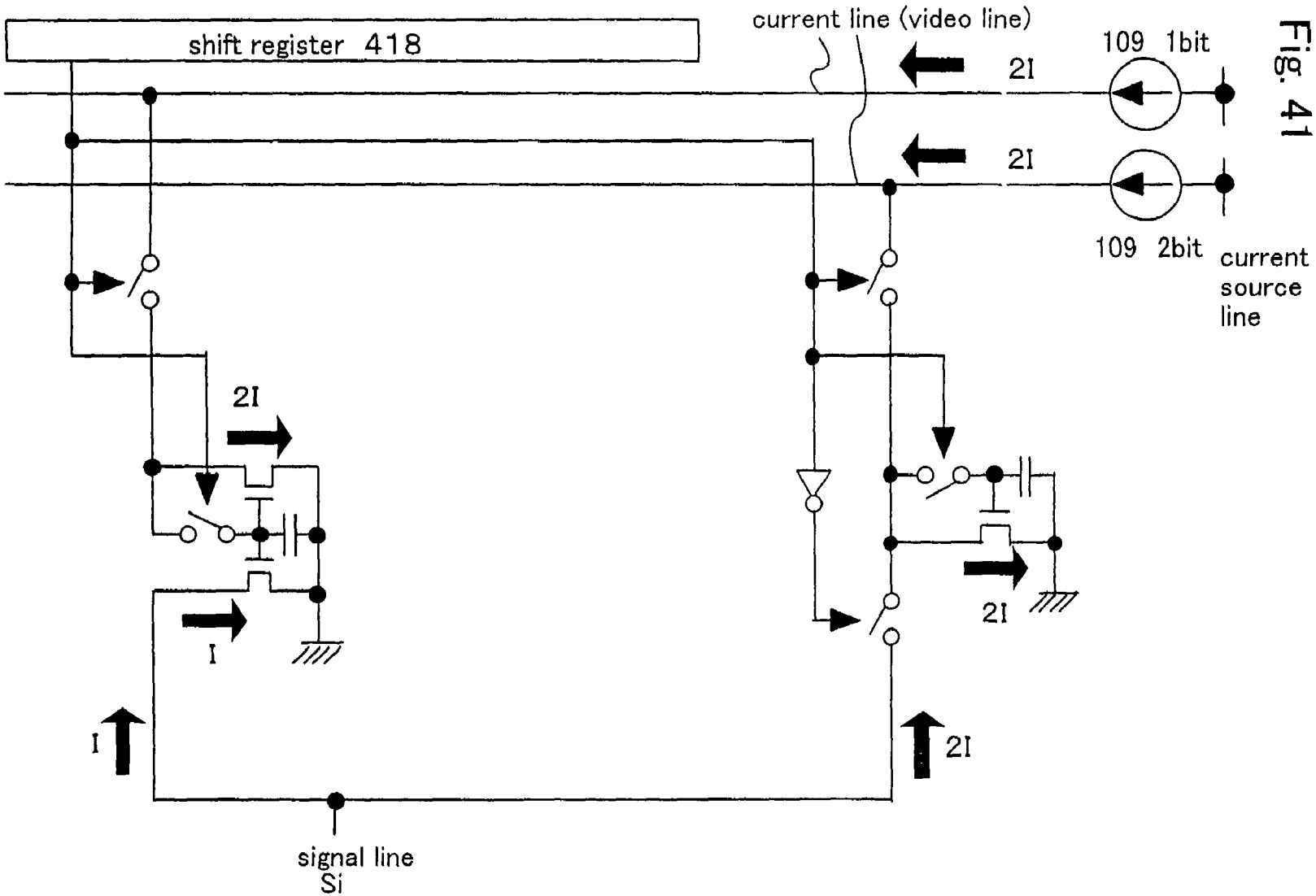
FIG. 41 is a view showing a signal line drive circuit.

FIG. 39 shows a circuit when the circuit of FIG. 38 employs the circuit of FIG. 6A. FIG. 40 shows a circuit when the circuit of FIG. 38 employs the circuit of FIG. 6C. Furthermore, FIG. 41 shows a circuit when a 1-bit current source circuit employs the circuit of FIG. 6C, and a 2-bit current source circuit employs the circuit of FIG. 6A. In the circuit of FIG. 41, the magnitude of the video signal current is increased by changing the value W/L of the 1-bit current source circuit. Consequently, the setting operation can be performed in substantially the same period of time as that of the 2-bit current source circuit.

Figure 37B:
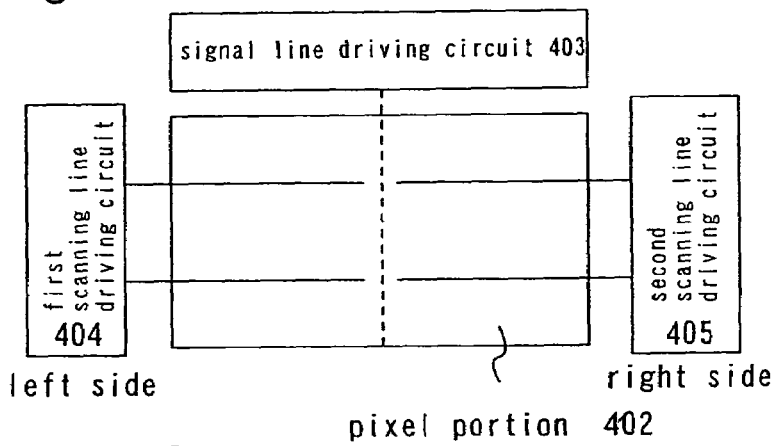
Figure 37C:
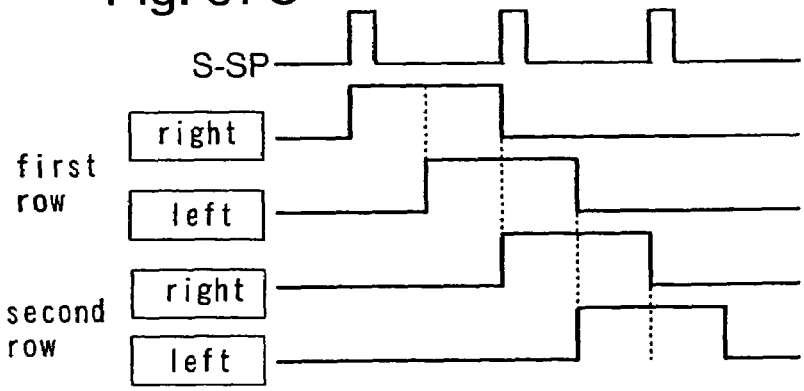

However, in sequential selection from the first to last column, it takes a long period of time to input signals to pixels in columns closer to the first. On the other hand, in columns closer to the last, pixels in the next row are selected immediately after the video signal has been inputted, resulting in a decreased period of time for inputting signals to pixels. In such a case, as shown in FIG. 37B, scanning-lines disposed in the pixel section 402 are divided at the center to increase the duration of inputting signals to the pixels. In that case, a scanning-line drive circuit is arranged on each of the left and right of the pixel section 402, wherein the pixels are driven using the scanning-line drive circuit. With such an arrangement, even for the pixels arranged in the same row, the duration of inputting signals can be changed between the right pixels and the left pixels. FIG. 37C shows output waveforms of the right and left scanning-line drive circuits in the first and second rows and a start pulse (S-SP) of the shift register 411. Since the duration of inputting signals to even the left pixels can be increased by the operation as the waveform in FIG. 37C, thus facilitating point sequential driving.

Figure 49:
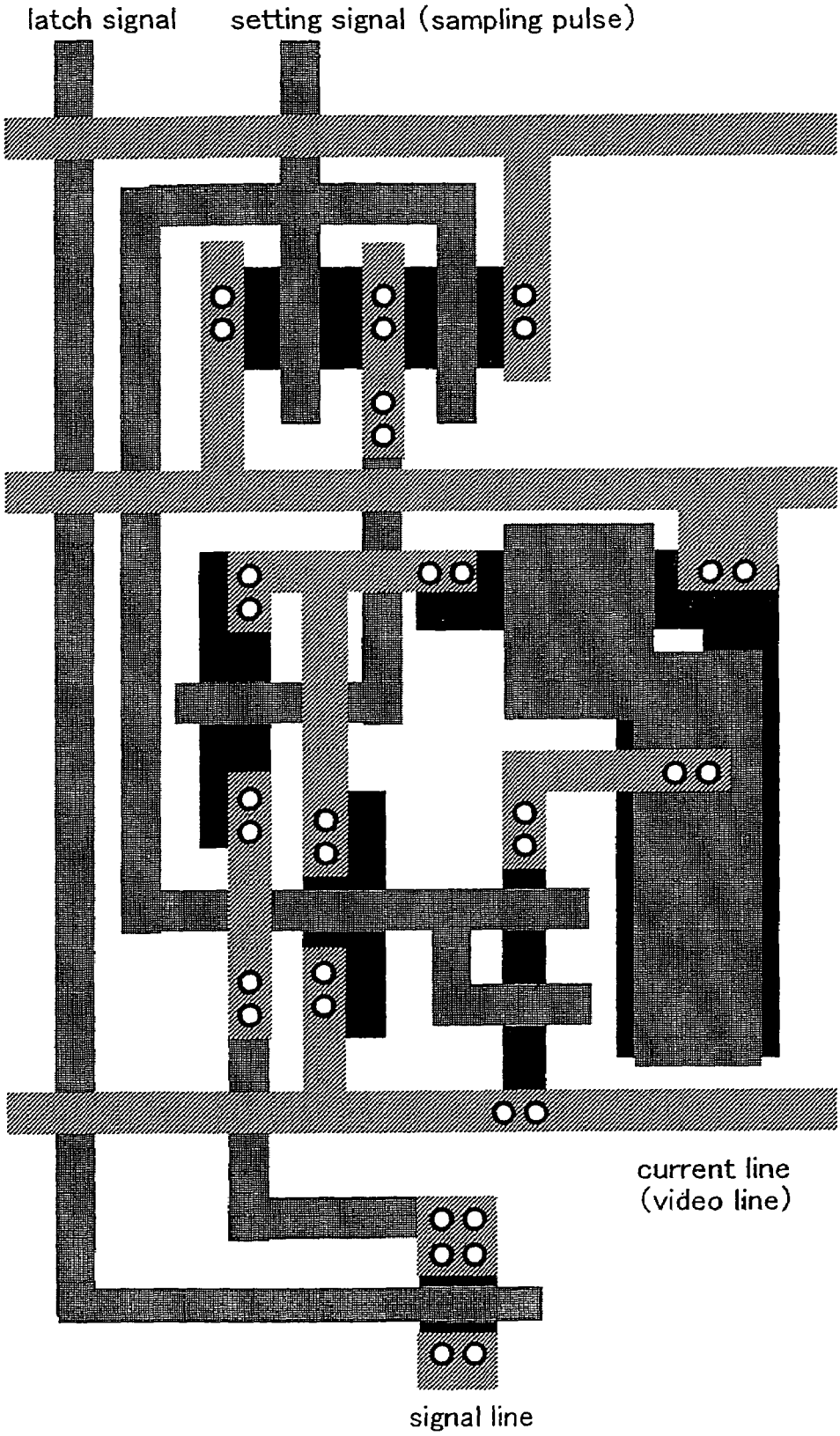
FIG. 49 is a layout view of a current source circuit.
Figure 50:
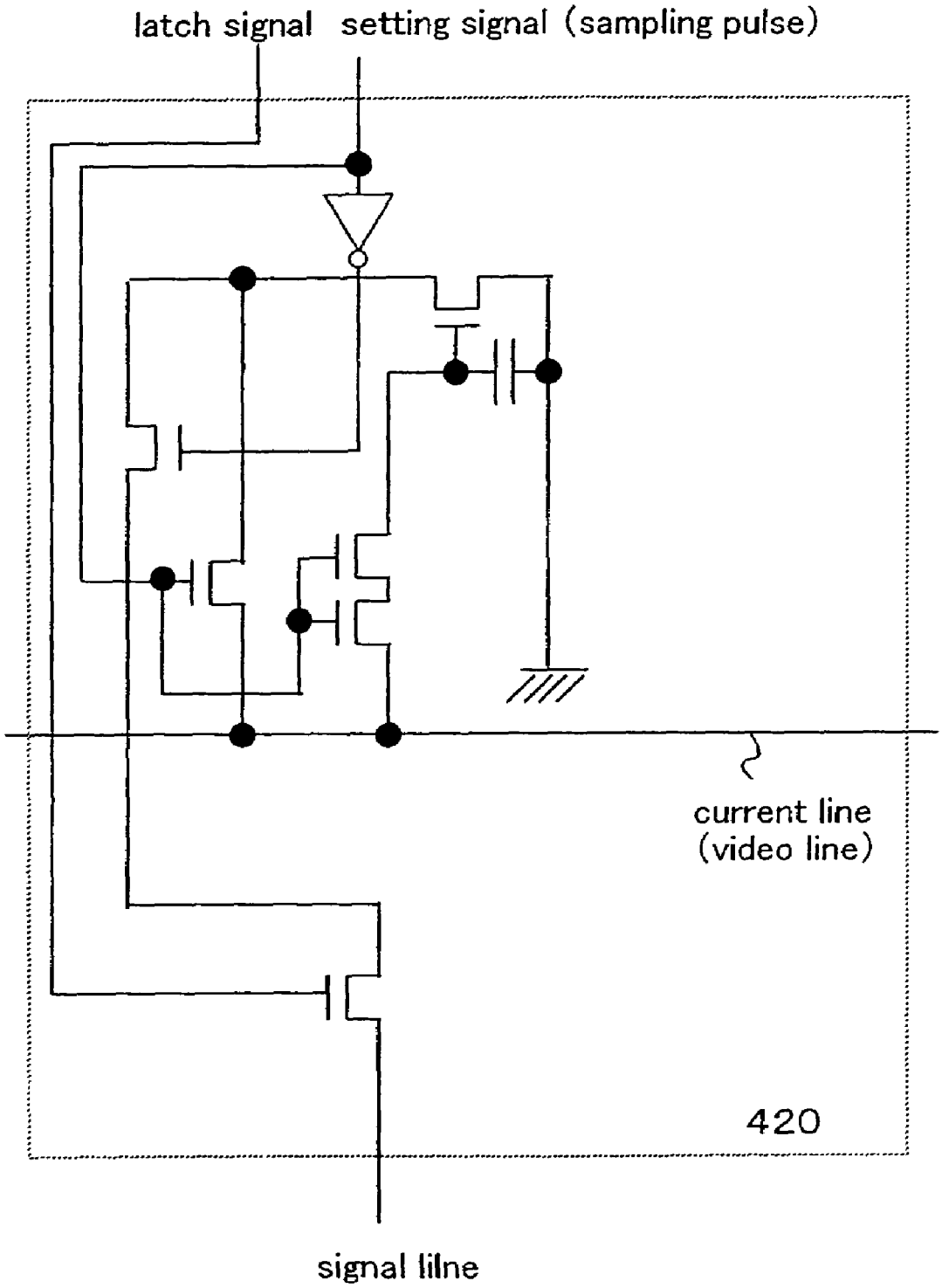
FIG. 50 is a circuit diagram of a current source circuit.

In the signal-line drive circuit of the present invention, the layout diagram of the current source circuit arranged in a latch is illustrated in FIG. 49; and a circuit diagram corresponding thereto is shown in FIG. 50.

This embodiment can freely be combined with the first to third embodiments.

Fifth Embodiment

In this embodiment, a detailed configuration and the operation of the signal-line drive circuit 403 shown in FIG. 15A will be described. In this embodiment, the signal-line drive circuit 403 used for performing 2-bit digital intensity-levels assigning will be described with reference to FIG. 3B, FIG. 5, and FIG. 26.

Figure 3B:
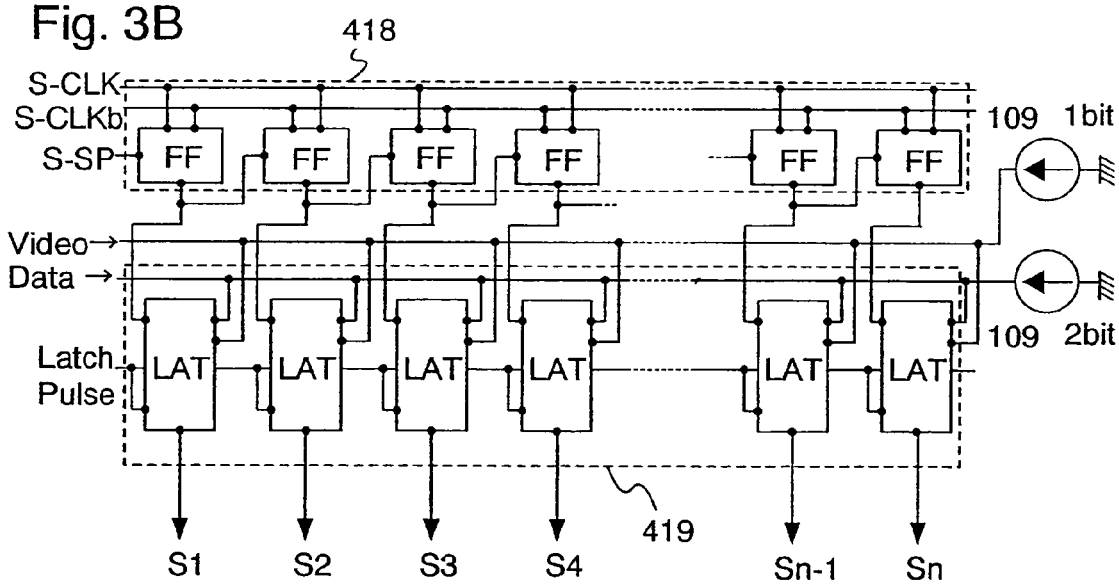

FIG. 3B is a schematic diagram of the signal-line drive circuit 403 in performing 2-bit digital intensity-level assigning. The signal-line drive circuit 403 includes the shift register 418 and the latch circuit 419.

A brief description of the operation will be given. The shift register 418 is configured using a plurality of columns of flip-flop circuits (FFs), to which a clock signal (S-CLK), a start pulse (S-SP), and a clock inversion signal (S-CLKb) are inputted. Sampling pulses are outputted in sequence in accordance with the timing of such signals.

The sampling pulses outputted from the shift register 418 are inputted to the latch circuit 419. To the latch circuit 419, a 2-bit digital video signal (digital data 1 and digital data 2) is inputted, which is held in each column in accordance with the timing of inputting the sampling pulses.

A 1-bit digital video signal is inputted over a current line connected to the 1-bit video-signal constant current source 109. The 2-bit digital video signal is inputted over a current line connected to the 2-bit video-signal constant current source 109. The signal current (corresponding to the video signal) set in the 1-bit and 2-bit video-signal constant current source s 109 is held in the latch circuit 419.

A latch pulse is inputted to the latch circuit 419, and the 2-bit digital video signal (digital data 1 and digital data 2) held in the latch circuit 419 is inputted to pixels connected to the signal line. The latch circuit 419 is sometimes responsible for converting the digital signal to an analog signal.

Figure 5:
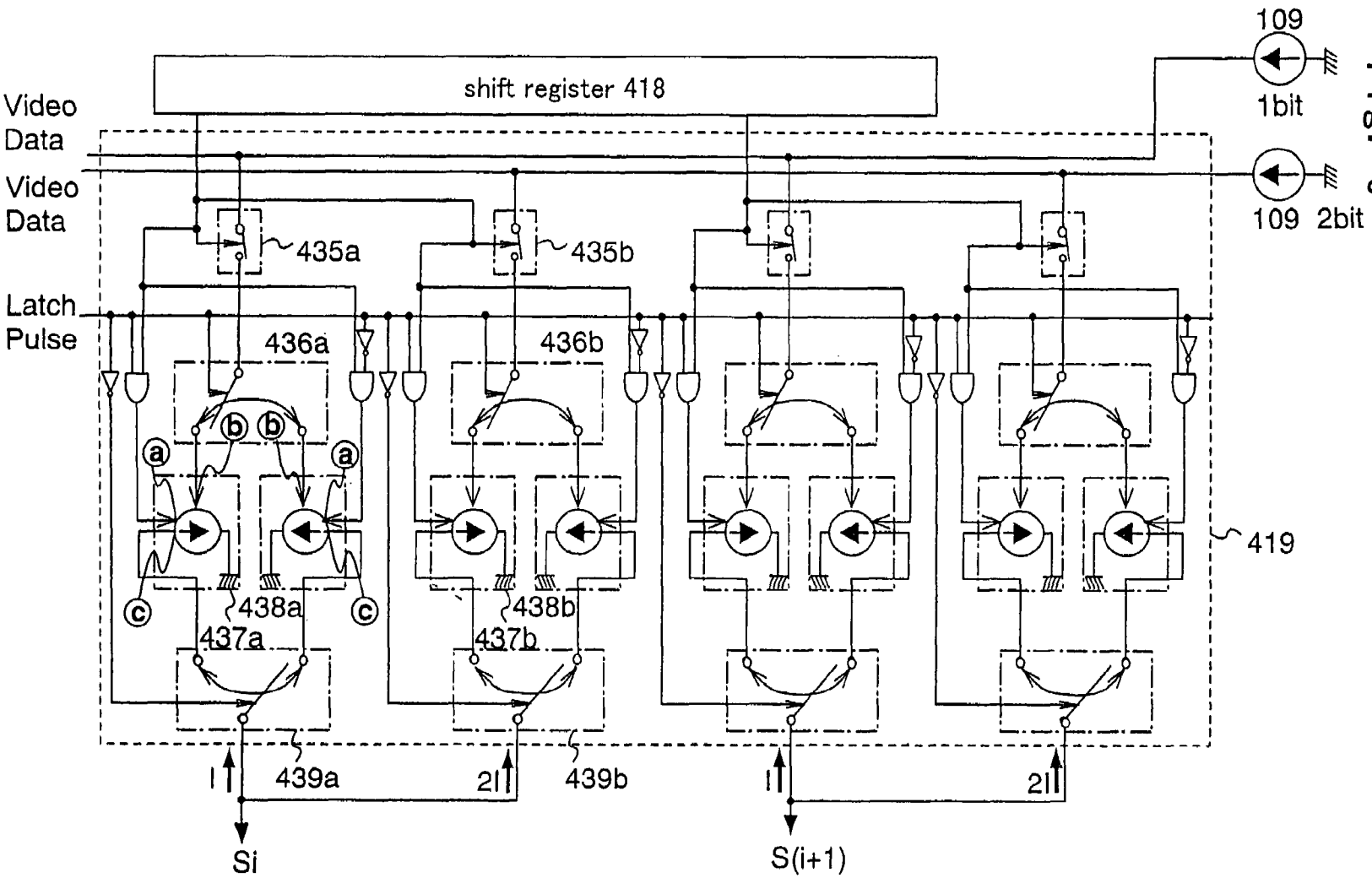
FIG. 5 is a view of a signal line drive circuit (2-bit).
Figure 26:
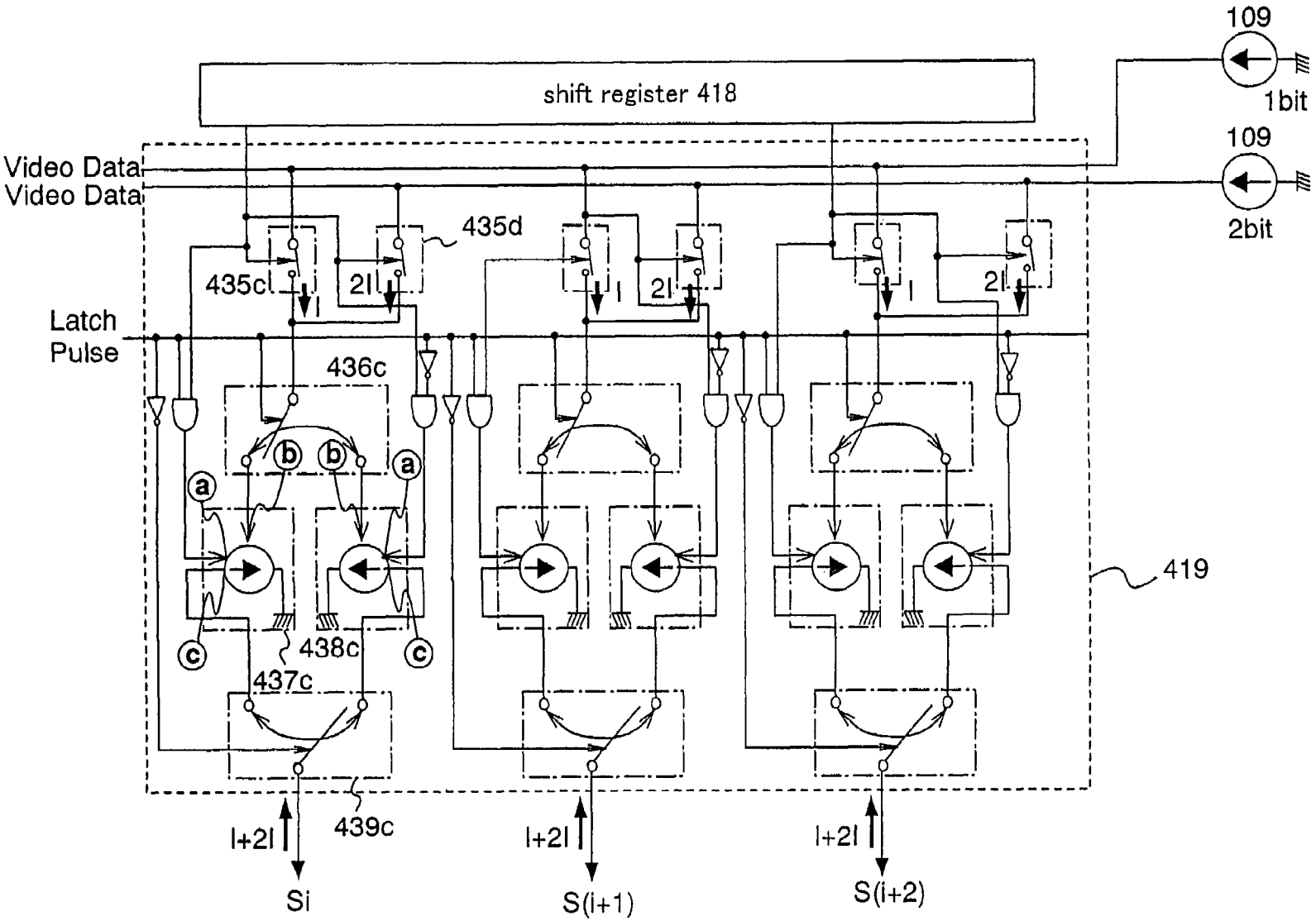
FIG. 26 is a view of a signal line drive circuit (2-bit).

Next, the configuration of the latch circuit 419 will be described with reference to FIG. 5. FIG. 5 shows the outline of the signal-line drive circuit 403 for performing 2-bit digital intensity-level assigning around the ith to (i+1)th two signal lines. Similarly, FIG. 26 shows the outline of a signal-line drive circuit for performing 2-bit digital intensity-level assigning around the ith to (i+1)th two signal lines.

FIG. 5 shows a case in which the video-signal constant current source s 109 corresponding to the respective bits are arranged.

Referring to FIG. 5, the latch circuit 419 includes a switch 435*a*, a switch 436*a*, a current source circuit 437*a* a current source circuit 438*a*, and a switch 439*a* for each column, and also includes a switch 435*b*, a switch 436*b*, a current source circuit 437*b*, a current source circuit 438*b*, and a switch 439*b* for each column.

The switch 435*a* and the switch 435*b* are controlled by the sampling pulses inputted from the shift register 418. The switch 436*a*, the switch 439*a*, the switch 436*b*, and the switch 439*b* are controlled by the latch pulses.

To the switch 436*a* and the switch 439*a*, inverted signals from each other are inputted. As a result, one of the current source circuit 437*a* and the current source circuit 438*a* performs setting operation and the other performs inputting operation. To the switch 436*b* and the switch 439*b*, inverted signals from each other are inputted. As a result, one of the current source circuit 437*b* and the current source circuit 438*b* performs setting operation and the other performs inputting operation.

In other words, when the current source circuit 437 performs setting operation, the current source circuit 438 outputs a signal current to pixels at the same time, thus performing inputting operation. In this manner, since the setting operation and the inputting operation of the current source circuits can be performed at the same time, setting operation can accurately be performed over a long period of time.

The signal current supplied from the video line (video data line) has a magnitude depending on the video signal. Thus, the magnitude of current supplied to the pixels is proportional to the signal current, allowing the provision of an image.

This allows line-sequential driving.

Referring to FIG. 5, the current lines and the video-signal constant current source s are arranged in correspondence with the respective bits. The total amount of the current values supplied from the current source s of respective bits is supplied to the signal lines. In brief, the current constant source circuits have the function of digital-analog conversion.

Each of the current source circuits (the current source circuits 437*a*, 438*a*, 437*b*, and 438*b*) has a terminal a, a terminal b, and a terminal c. Each of the current source circuits (the current source circuits 437*a*, 438*a*, 437*b*, and 438*b*) is controlled by a signal constant inputted through the terminal a, and holds a current (signal current $I_{data}$) that is set using the video-signal current source 109 connected to the video line via the terminal b. The current set in the 1-bit constant current source 109 is held in the current source circuit 437*a* and the current source circuit 438*a*. The current set in the 2-bit constant current source 109 is held in the current source circuit 437*b* and the current source circuit 438*b*. The switch 439*a* and the switch 439*b* are arranged between each current source circuit (current source circuits 437*a*, 438*a*, 437*b*, and 438*b*) and the pixels connected to the signal lines, wherein the On/OFF of the switch 439*a* and the switch 439*b* are controlled by the latch pulse.

When the video signal is a light signal, a signal current is outputted from each current source circuit (current source circuits 437*a*, 438*a*, 437*b*, and 438*b*) to the pixels. On the other hand, when the video signal is a dark signal, the current source circuits (current source circuits 437*a*, 438*a*, 437*b*, and 438*b*) have no ability of feeding current, thus feeding no current to the pixels. More specifically, in the current source circuits (current source circuits 437*a*, 438*a*, 437*b*, and 438*b*), the ability ($V_{GS}$) of feeding a constant current is controlled by the video signal; thus, the brightness is controlled depending on the magnitude of the current outputted to the pixels.

The total amount of the current from either of the 1-bit current source circuit 437*a* and current source circuit 438*a* and either of the 2-bit current source circuit 437*b* and current source circuit 438*b* is carried to the pixels and in the signal lines connected to the pixels.

Which of the 1-bit current source circuit 437*a* and current source circuit 438*a* performs setting operation and which performs inputting operation (output of current to the pixels) are controlled by the latch pulse. The same applies to the 2-bit current source circuit 437*b* and current source circuit 438*b*.

In other words, the currents of the video signals of the respective bits are combined for DA conversion in the position where the currents flow from the current source circuit 437*a* and the current source circuit 437*b* toward the pixels. Therefore, the magnitude of the current has only to correspond to the respective bits.

Next, the outline of the signal-line drive circuit shown in FIG. 26 will be described. Referring to FIG. 26, the latch circuit includes a switch 435*c*, a switch 435*d*, a switch 436*c*, a current source circuit 437*c*, a current source circuit 438*c*, and a switch 439*c* for each column. The switch 435*c* and the switch 435*d* are controlled by the sampling pulses inputted from the shift register 418. The switch 436*c* and the switch 439*c* are controlled by the latch pulses.

To the switch 436*c* and the switch 439*c*, inverted signals from each other are inputted. As a result, one of the current source circuit 437*c* and the current source circuit 438*c* performs setting operation and the other performs inputting operation. One of the current source circuit 437*c* and the current source circuit 438*c* performs setting operation and the other performs inputting operation.

In other words, when the current source circuit 437*a* performs setting operation, the current source circuit 438*a* outputs a signal current to pixels at the same time, thus performing inputting operation. In this manner, since the setting operation and the inputting operation of the current source circuits can be performed at the same time, setting operation can accurately be performed over a long period of time.

In other words, the setting operation must be continued until a steady state in order to perform the setting operation accurately. Upon the steady state, no current flows to the gate electrode of a transistor (a transistor for supplying a constant current, corresponding to a transistor 102 in FIG. 6A) in the current source circuit, causing no change of the potential of a capacitance (corresponding to a capacitance device 103 in FIG. 6A) that holds the gate-to-source voltage of the transistor. It follows from such a state that setting operation is completed sufficiently. In short, a proper magnitude of current can be fed in inputting operation. However, setting operation of short duration may cause the setting operation to be completed before the steady state. In such a case, the capacitance that holds the gate-to-source voltage of the transistor is not at a correct potential. Therefore, a proper magnitude of current cannot be fed in inputting operation; thus, the circuit is affected by the variations in the characteristics of the transistors. Accordingly, setting operation of long duration allows accurate setting operation.

Each of the current source circuits 437*c* and 438*c* has a terminal a, a terminal b, and a terminal c. Each of the current source circuits 437*c* and 438*c* is controlled by a signal inputted through the terminal a, and holds a current (signal current $I_{data}$) that is set using the video-signal constant current source 109 connected to the video line via the terminal b. The current set in the 1-bit and 2-bit constant current source s 109 is held in the current source circuit 437*a* or the current source circuit 438*a*. The switch 439*c* is arranged between the current source circuits 437*a* and 438*a* and the pixels connected to the signal lines, wherein the ON/OFF of the switch 439*c* is controlled by the latch pulse.

When the digital video signal is a light signal, signal current is outputted from the current source circuits 437*c* and 438*c* to the pixels. On the other hand, when the video signal is a dark signal, the current source circuits 437*c* and 438*c* have no ability of feeding current, thus feeding no current to the pixels. In brief, in the current source circuits 437*c* and 438*c*, the ability ($V_{GS}$) of feeding a constant current is controlled by the video signal; thus, the brightness is controlled by the magnitude of the current outputted to the pixels.

In the present invention, the setting signal inputted from the terminal a indicates a signal inputted from the output terminal of a logical operator. In other words, the setting signal in FIG. 1 corresponds to a signal inputted from the output terminal of the logical operator. In the present invention, the current source circuit 420 is set in accordance with the signal inputted from the output terminal of the logical operator.

The sampling pulse from the shift register is inputted to one of the two input terminals of the logical operator and the latch pulse is inputted to the other. The logical operator performs logical operation of the two inputted signals and outputs a signal from the output terminal. In the current source circuits, setting operation or inputting operation is performed in accordance with the signal inputted from the output terminal of the logical operator.

The following is an example of employing a circuit of FIG. 6A as each current source circuit shown in FIG. 5 and each current source circuit shown in FIG. 26. Using the current source circuit as in FIG. 6A decreases the number of transistors to be arranged, thus further reducing the effects of variations in the characteristics of the transistors. In other words, since a transistor for setting operation and a transistor for inputting operation are the identical transistor, they are not affected by the variations between the transistors at all. However, since the current in performing setting operation cannot be set high, setting operation cannot be performed more quickly. The current in setting operation corresponds to the current supplied to the latch circuit from the video-signal constant current source 109.

Figure 42:
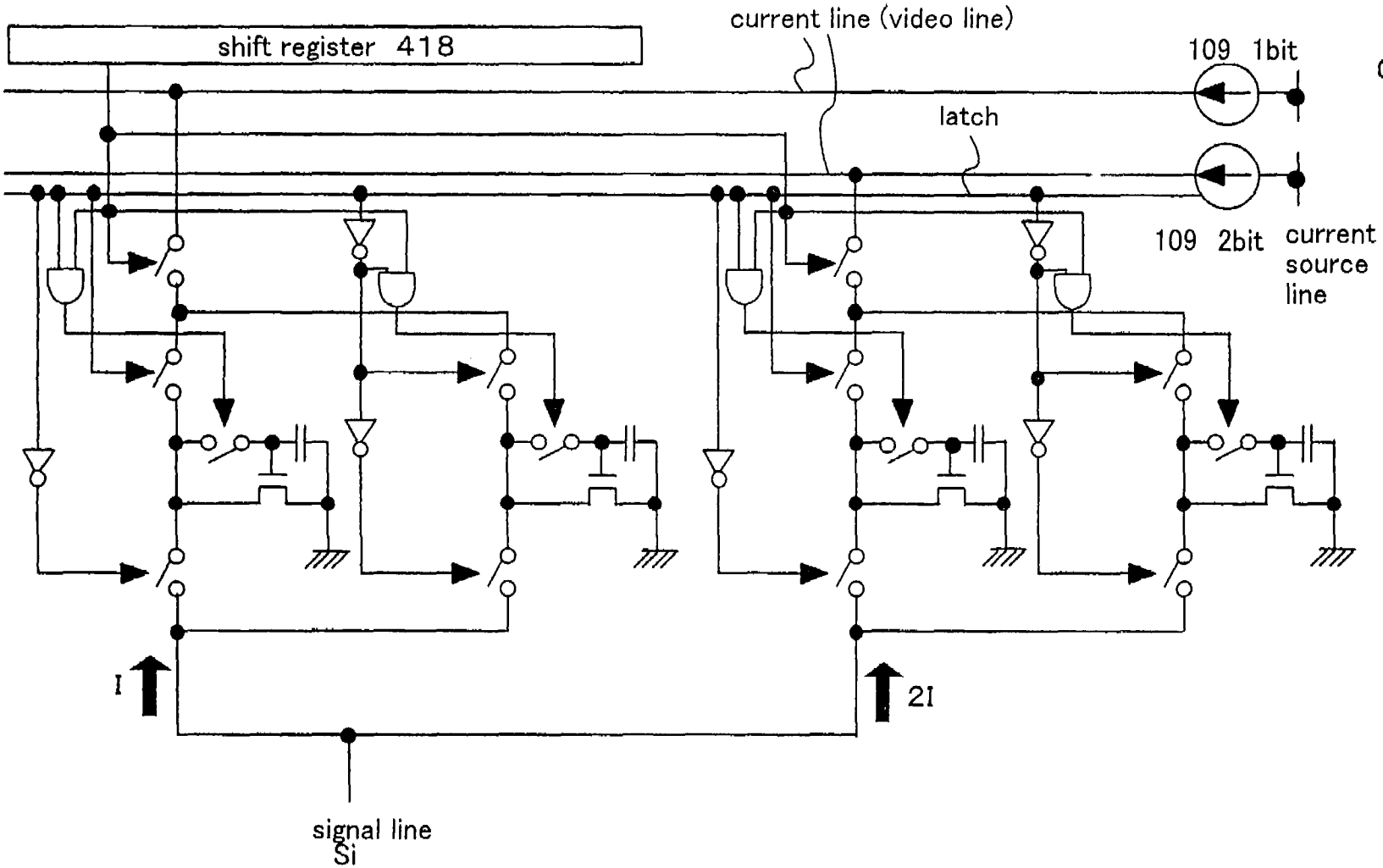
FIG. 42 is a view showing a signal line drive circuit.

A circuit diagram in this case is shown in FIG. 42.

Figure 43:
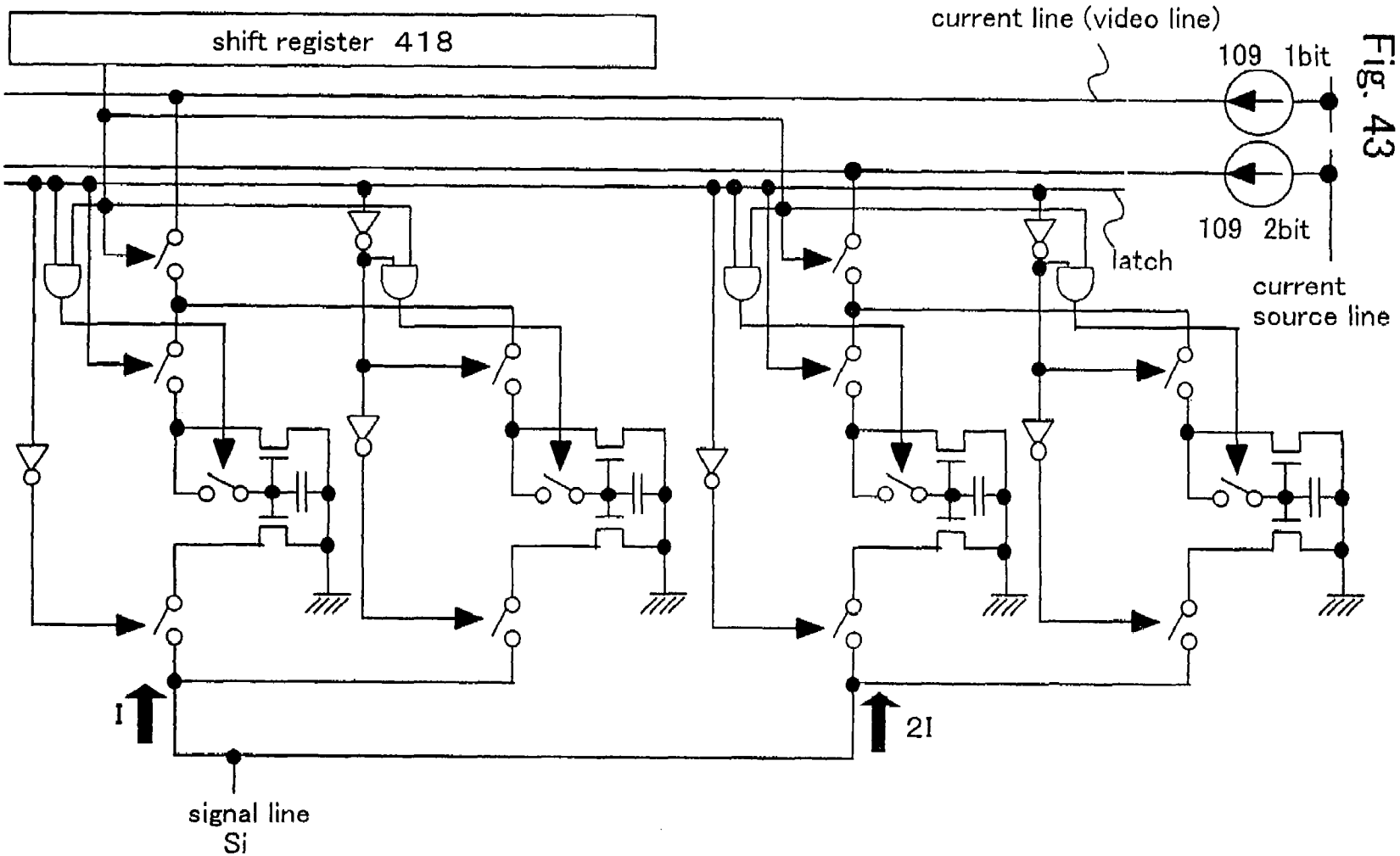
FIG. 43 is a view showing a signal line drive circuit.

Subsequently, a case where a current mirror circuit as shown in FIG. 6C is employed as each current source circuit shown in FIG. 5 and each current source circuit shown in FIG. 26 will be described with reference to FIG. 43.

In the two transistors of the current mirror circuit as in FIG. 6C, when the value of W (gate width)/L (gate length) of the transistor connected to the pixels is smaller than that of the transistor connected to the video-signal constant current source 109, the current value supplied from the video-signal constant current source 109 can be made high.

In other words, the value W/L of the transistor for setting operation is set higher than the value W/L of the transistor for inputting operation. Then, the current for setting operation, that is, the current flowing from the video-signal constant current source 109 to the latch circuit can be increased. High current allows electrical charge to be carried quickly to a wiring cross capacitance accompanying wirings, thereby entering a steady state quickly. Thus, setting operation can be performed more quickly.

The current mirror circuit as in FIG. 6C includes at least two transistors having a gate electrode in common or electrically connected thereto. When the two transistors have identical characteristics, the currents outputted from the source terminals or drain terminals of the transistors do not vary. In brief, the two transistors need to be identical in order not to vary the outputted currents. In other words, it is sufficient for the two transistors having a gate electrode in common or electrically connected thereto to have identical characteristics in the current mirror circuit as in FIG. 6C. Transistors having no common gate electrode do not need to have the identical characteristic. This is because setting operation is performed for each current source circuit. In other words, it is sufficient for the transistor for the setting operation and the transistor used for inputting operation to have the identical characteristics. There is no need for transistors having no common gate electrode to have the identical characteristics. Even when the transistors having no common gate electrode have not identical characteristics, setting operation is performed for each current source circuit; therefore, variations in characteristics are corrected.

In general, in the current mirror circuit as in FIG. 6C, two transistors having a gate electrode in common or electrically connected thereto are arranged in close proximity to each other in order to reduce the variations in the characteristics thereof.

Let the magnitude of current applied to the pixels be P. In the two transistors of the current mirror circuit in the current source circuits, if the value W/L of the transistor connected to the pixels is denoted by Wa, the value W/L of the transistor connected to the video signal line is set to (2×Wa). Then, the current value becomes twice in each current source circuit. Then, the video-signal constant current source s 109 (for 1-bit and 2-bit) supply a current of (2×P) or (4×P). Consequently, the current supplied from the video-signal constant current source s 109 can be increased, thus allowing the setting operation of each current source circuit to be performed quickly and accurately.

Since this embodiment performs 2-bit digital intensity-level assigning, it is provided with four current source circuits (437*a*, 438*a*, 437*b*, and 438*b*) for each signal line in FIG. 5, and two current source circuits (437*c* and 438*c*) for each signal line in FIG. 26.

The current source circuits (current source circuits 437*a*, 438*a*, 437*b*, and 438*b*) in FIG. 5 and the current source circuits (current source circuits 437*c* and 438*c*) shown in FIG. 26 can freely employ the circuit configurations of the current source circuits shown in FIGS. 6 and 7, FIG. 29, FIG. 28, and FIG. 31. The current source circuits 420 may adopt not only one system but also a plurality of systems.

When the current source circuit held in the latch circuit is a current mirror circuit as in FIG. 6C, the value W (gate width)/L (gate length) of the transistor may be varied for each bit. This allows the current in setting operation for a low-order-bit current source circuit, that is, the current flowing from the low-order-bit video-signal constant current source 109 can be made high, leading to a quick setting operation.

In a word, the value W/L of the transistor connected to the video-signal constant current source 109 is set higher than the W/L of the transistor connected to the pixels and signal lines. In short, the value W/L of the transistor for setting operation is set larger than the value W/L of the transistor for inputting operation. This further increases the current for setting operation, that is, the current flowing from the video-signal constant current source 109.

However, the current mirror circuit as in FIG. 6C includes at least two transistors having a gate electrode in common or electrically connected thereto. When the two transistors vary in characteristics, the currents outputted therefrom also vary. However, the magnitude of the currents can be varied by setting the ratio W/L of the channel width W and the channel length L of the transistor to different values for the two transistors. Generally, the current in setting operation is set high, thus allowing quick setting operation.

The current in setting operation corresponds to the current supplied from the video-signal constant current source 109.

On the other hand, when the circuit as in FIG. 6A is used, the current flowing in setting operation and the current flowing in inputting operation are substantially equal. Therefore, the current for setting operation cannot be set high. However, the transistor for supplying current in setting operation and the transistor for supplying current in inputting operation are the identical. Therefore, they are not affected by the variations between the transistors at all. Accordingly, it is preferable to use an appropriate combination in the latch circuit, such as to use the current mirror circuit as in FIG. 6C for part where high current is desired in setting operation and to use the circuit as in FIG. 6A for part where more accurate current is desired to output.

The current mirror circuit as in FIG. 6C includes at least two transistors having a gate electrode in common or electrically connected thereto. When the two transistors vary in characteristics, the currents outputted therefrom also vary. However, if the two transistors have identical characteristics, the currents outputted from the source terminals or drain terminals of the transistors do not vary. Conversely, the characteristics of the two transistors need to be identical in order not to vary the outputted currents. In other words, in the current mirror circuit as in FIG. 6C, it is sufficient for the two transistors having a gate electrode in common or electrically connected thereto to have identical characteristics. Transistors having no common gate electrode do not need to have the identical characteristic. This is because setting operation is performed for each current source circuit. In other words, it is sufficient for the transistor for the setting operation and the transistor used for inputting operation to have the identical characteristics. Even when the transistors having no common gate electrode have not identical characteristics, setting operation is performed for each current source circuit; therefore, variations in characteristics are corrected.

In general, in the current mirror circuit as in FIG. 6C, two transistors having a gate electrode in common or electrically connected thereto are arranged in close proximity to each other in order to reduce the variations in the characteristics of the two transistors.

The current source circuit held in the latch circuit may employ the circuit as in FIG. 6A or the current mirror circuit as in FIG. 6C, or alternatively, may employ a combination thereof.

The current mirror circuit as in FIG. 6C may be adopted in either a current source circuit for all bits or a current source circuit for part of bits. More effectively, it is preferable to use the current mirror circuit as in FIG. 6C for the low-order-bit current source circuit and to use the circuit as in FIG. 6A for the high-order-bit current source circuit.

This is because the high-order-bit current source circuit affects the current value significantly even if the characteristics of the transistors in the current source circuit vary slightly; this is because the absolute value of the difference in current due to the variations is large even with the same degree of variations in the characteristics of the transistors since the current supplied from the high-order-bit current source circuit is high in itself. Assuming that the characteristics of the transistors vary by ten percent, the amount of variations is 0.1I where the magnitude of the first-bit current is I. On the other hand, since the magnitude of the third-bit current amounts to 8I, the amount of the variations is 0.8I. As just described, even a slight variation in the characteristics of the transistors significantly affects the high-order-bit current source circuit.

Therefore, a system that is affected by the variations as little as possible is preferable. The high-order-bit current has a high current value, facilitating setting operation. On the other hand, the low-order-bit current exhibits a low value of current itself despite of some variations, having slight influence. Also, since the low-order-bit current exhibits a low value of current, setting operation is not easy.

In order to resolve the above situations, it is preferable to use the current mirror circuit as in FIG. 6C for the low-order-bit current source circuit and to use the circuit as in FIG. 6A for the high-order-bit current source circuit.

Particularly, for the low-order-bit current source circuit in which the current flowing from the video-signal constant current source 109 is low, it is effective to use the current mirror circuit as in FIG. 6C to increase the value of current.

More specifically, the low-order-bit current source circuit exhibits a low value of current flowing therefrom, thus taking much time for setting operation. Therefore, increasing the current value using the current mirror circuit as in FIG. 6C decreases the time for setting operation.

The current mirror circuit as in FIG. 6C includes at least two transistors having a gate electrode in common or electrically connected thereto. When the two transistors vary in characteristics, the currents outputted therefrom also vary. However, the low-order-bit current source circuit exhibits a low value of current outputted to the pixels and the signal lines. Therefore, variations in the characteristics of the two transistors have little effects. Therefore, it is effective for the low-order-bit current source circuit to use the current mirror circuit as in FIG. 6C.

In summary, by employing the current mirror circuit as in FIG. 6C as a current source circuit and setting the value W/L to an appropriate value, the current to be supplied from the video-signal constant current source 109 can be made high. This allows the setting operation of the current source circuit to be performed accurately.

However, the current mirror circuit as in FIG. 6C includes at least two transistors having a gate electrode in common or electrically connected thereto. If the two transistors vary in characteristics, the currents outputted therefrom also vary.

On the other hand, when the circuit as in FIG. 6A is used, the current flowing in setting operation cannot be increased; however, which is not at all affected by the variations between the transistors.

Accordingly, it is preferable to use a combination of circuits appropriately, as to use the current mirror circuit as in FIG. 6C for part where high current is desired and to use the circuit as in FIG. 6A for part where more accurate current is desired to output.

The transistor to be operated as merely a switch may have either polarity.

Referring to FIG. 5, the 1-bit video-signal constant current source 109 is connected to a 1-bit video line (video data line) and the 2-bit video-signal constant current source 109 is connected to a 2-bit video line (video data line). Assuming that current supplied from the 1-bit video-signal constant current source 109 is I, current supplied from the 2-bit video-signal constant current source 109 is 2I. However, the present invention is not limited to that but the magnitude of the currents supplied from the 1-bit video-signal constant current source 109 and the 2-bit video-signal constant current source 109 can be equated. Equating the magnitude of the currents supplied from the 1-bit video-signal constant current source 109 and the 2-bit video-signal constant current source 109 allows the operating conditions and the load to be equated and also the time for writing signals to the current source circuits to be the same.

However, at that time, the current source circuits shown in FIG. 5 and FIG. 26 need to employ the current mirror circuit as in FIG. 6C. In the current source circuits shown in FIG. 5, it is necessary to set the values W/L of the transistors held in the current source circuit 437*a* and the current source circuit 438*a* and the transistors held in the current source circuit 437*b* and the current source circuit 438*b* to 2:1. Thus, the ratio of the magnitude of the current outputted from the current source circuit 437*a* and the current source circuit 438*a* and the magnitude of the current outputted from the current source circuit 437*b* and the current source circuit 438*b* can be set to 2:1. In the current source circuits shown in FIG. 26, the value W/L of the transistors connected to the video signal lines and the transistors connected to the pixels must be 2:1.

In this embodiment, the configuration and the operation of the signal-line drive circuit for performing 2-bit digital intensity-level assigning are described. However, according to the present invention, a signal-line drive circuit ready for not only the 2-bit but for any-bit can be designed on the basis of this embodiment to perform arbitrary bit assigning. This embodiment can freely be combined with the first to fourth embodiments.

Sixth Embodiment

The video-signal constant current source 109 shown in FIG. 2 to FIG. 5 may be integrated with the signal-line drive circuit on the substrate, or alternatively, may be arranged outside the substrate, from which a certain current is inputted using an IC and so on. For integral formation on the substrate, either of the current source circuits shown in FIGS. 6 to 8, FIG. 29, FIG. 28, and FIG. 31 may be used. Alternatively, only one transistor may be arranged to control the current value depending on the voltage to be applied to the gate. In this embodiment, a case in which a 3-bit video-signal constant current source 109 is configured with the current source circuit of the current mirror circuit as in FIG. 6C will be described with reference to FIG. 23 to FIG. 25.

The direction in which the current flows varies depending on the configuration of pixels. Changing the direction of the flow of current can easily be prepared by changing the polarity of the transistor.

Figure 23:
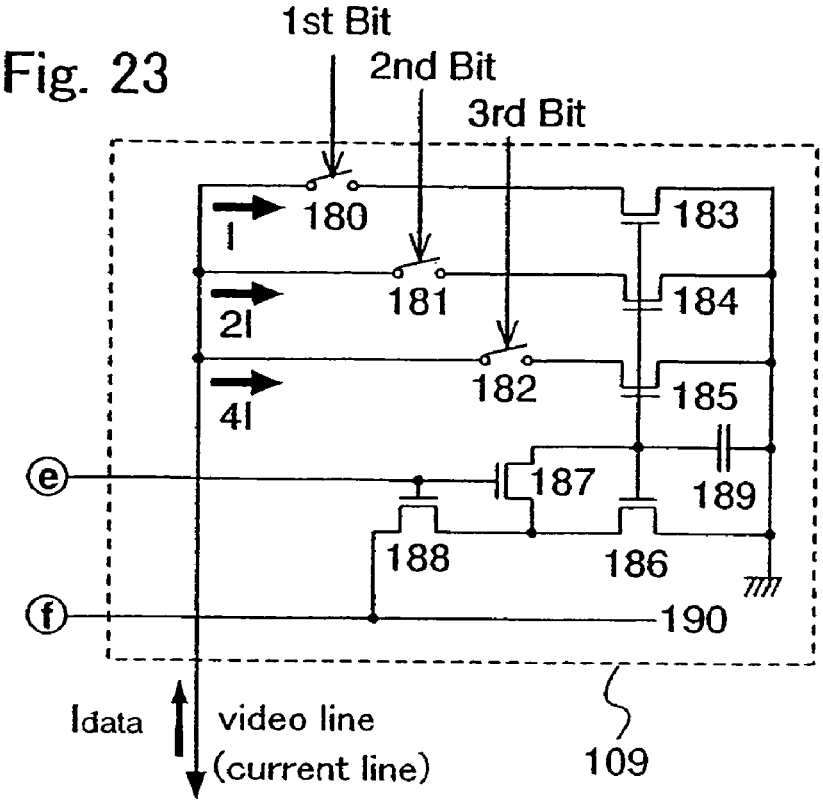
FIG. 23 is a circuit diagram of a video-signal current source.

Referring to FIG. 23, the video-signal constant current source 109 controls whether to output a predetermined signal current $I_{data}$ to a video line (a video data line and a current line) in accordance with the information on High/Low held in the 3-bit digital video signals (digital data 1 to digital data 3).

The video-signal constant current source 109 includes a switch 180 to a switch 182, a transistor 183 to a transistor 188, and a capacitance device 189. In this embodiment, all the transistor 180 to the transistor 188 are of n-channel type.

The switch 180 is controlled by a 1-bit digital video signal. The switch 181 is controlled by a 2-bit digital video signal. The switch 183 is controlled by a 3-bit digital video signal.

One of the source area and the drain area of the transistor 183 to the transistor 185 is connected to Vss and the other is connected to one of the terminals of the switch 180 to the switch 182. One of the source area and the drain area of the transistor 186 is connected to Vss and the other is connected to one of the source area and the source area of the transistor 188.

A signal is inputted from the exterior to the respective gate electrodes of the transistor 187 and the transistor 188 via a terminal e. To a current line 190, current is supplied from the exterior via a terminal f.

One of the source area and the drain area of the transistor 187 is connected to one of the source area and the drain area of the transistor 186 and the other is connected to one electrode of the capacitance device 189. One of the source area and the drain area of the transistor 188 is connected to the current line 190 and the other is connected to one of the source area and the drain area of the transistor 186.

One electrode of the capacitance device 189 is connected to the gate electrodes of the transistor 183 to the transistor 186 and the other electrode is connected to Vss. The capacitance device 189 is responsible for holding the gate-to-source voltage of the transistor 183 to the transistor 186.

In the video-signal constant current source 109, when the transistor 187 and the transistor 188 are turned on by the signal inputted from the terminal e, the current supplied from the terminal f is carried to the capacitance device 189 over the current line 190.

Electrical charge is gradually stored in the capacitance device 189 to begin generating a potential difference between both electrodes. When the potential difference between both electrodes reaches $V_{th}$, the transistor 183 to the transistor 186 are turned on.

In the capacitance device 189, the storage of electrical charge is continued until the potential difference between both electrodes, that is, the gate-to-source voltage of the transistor 183 to the transistor 186 reaches a desired voltage. In other words, the storage of electrical charge is continued until a voltage at which the transistor 183 to the transistor 186 can feed signal current can be obtained.

After completion of the storage of electrical charge, the transistor 183 to the transistor 186 are fully tuned on.

In the video-signal constant current source 109, continuity or discontinuity of the switch 180 to the switch 182 is selected according to the 3-bit digital signal. For example, when all the switch 180 to the switch 182 come in continuity, a current supplied to the current lines is the total amount of the drain current of the transistor 183, the drain current of the transistor 184, and the drain current of the transistor 185. When only the switch 180 comes in continuity, only the drain current of the transistor 183 is supplied to the current line.

When the ratio of the drain current of the transistor 183, the drain current of the transistor 184, and the drain current of the transistor 185 is set at 1:2:4, the magnitude of the current can be controlled in the level of $2^3=8$. Therefore, when the values W (channel width)/L (channel length) of the transistor 183 to the transistor 185 are designed at 1:2:4, the ratio of the respective ON-state currents reaches 1:2:4.

Figure 44:
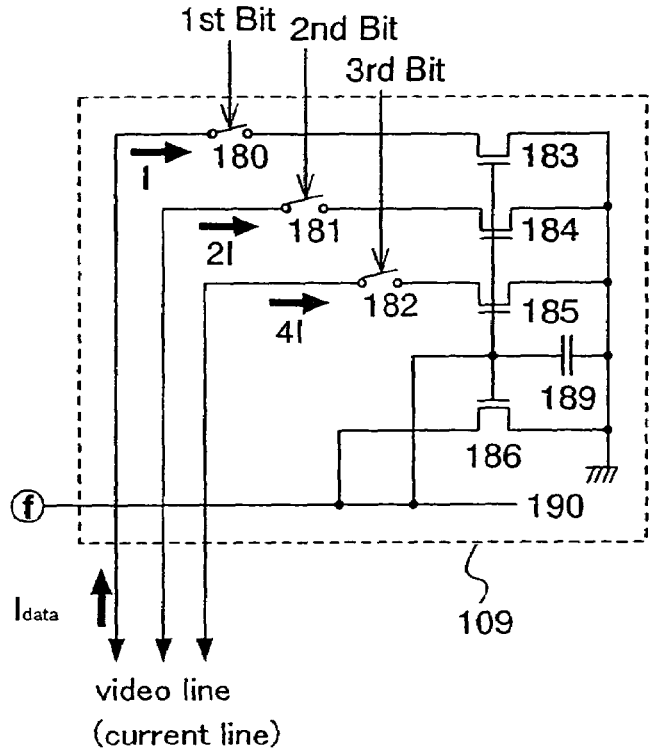
FIG. 44 is a circuit diagram of a video-signal current source.

FIG. 23 shows a configuration with one current line (video line). However, the number of current lines (video lines) to be arranged differs depending on whether the circuit as in FIG. 4 or the circuit as in FIG. 26 is used. FIG. 44 shows a diagram when a plurality of current lines (video lines) is used in the circuit of FIG. 23.

Figure 24:
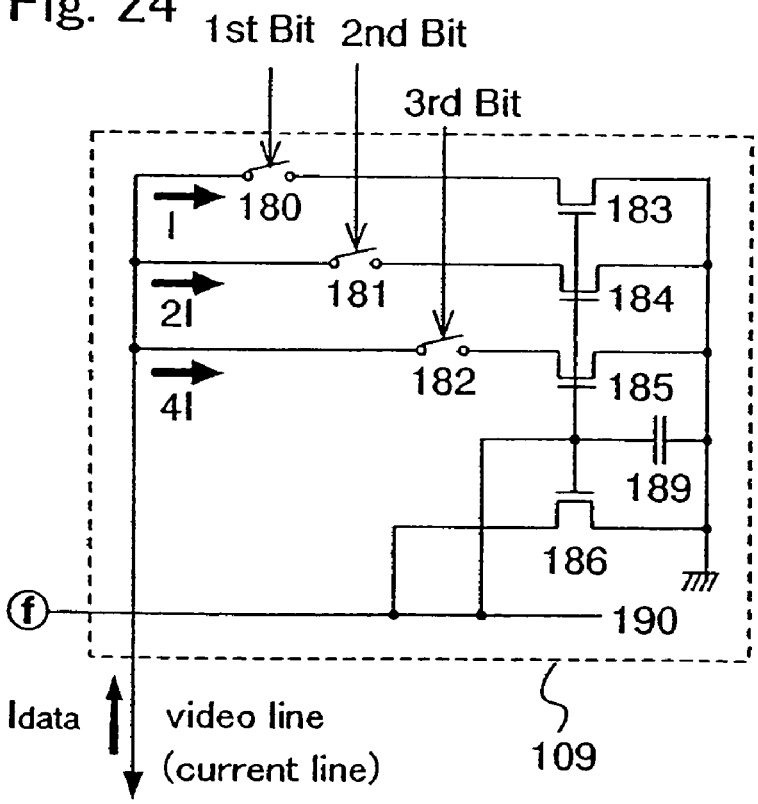
FIG. 24 is a circuit diagram of a video-signal current source.

Next, the video-signal current source 109 with a different configuration from that of FIG. 23 is shown in FIG. 24. In FIG. 24, when compared to the video-signal current source 109 shown in FIG. 23, the operation is the same as that of the video-signal current source 109 shown in FIG. 23 except that the transistors 187 and 188 are eliminated and one terminal of the capacitance device 189 is connected to the current line 190; therefore, a description thereof will be omitted in this embodiment.

With the configuration of FIG. 24, the signal (current) must continuously be inputted through the terminal f while current is supplied to the video line (current line). If the input of the current flowing from the terminal f is stopped, the electrical charge in the capacitance device 189 is discharged through the transistor 186. Consequently, the potential of the gate electrode of the transistor 186 is decreased to avoid the output of normal current from the transistors 183 to 185. On the other hand, with the configuration of FIG. 23, the capacitance device 189 holds a predetermined electrical charge; therefore, there is no need to input the signal (current) through the terminal f continuously while current is supplied to the video line (current line). Therefore, the capacitance device 189 may be omitted in the configuration of FIG. 24.

Figure 45:
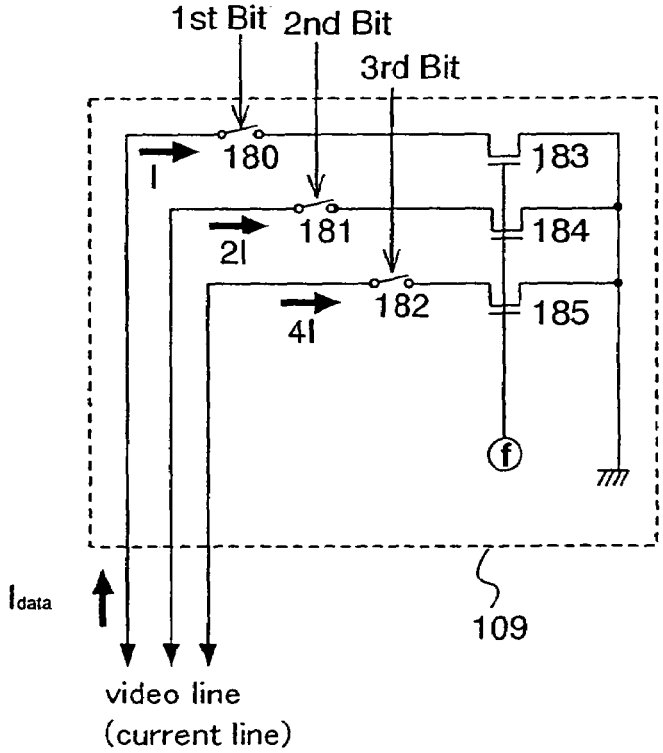
FIG. 45 is a circuit diagram of a video-signal current source.

FIG. 24 shows a configuration with one current line (video line). However, the number of current lines (video lines) differs depending on whether the circuit as in FIG. 4 or the circuit as in FIG. 26 is used. Thus, FIG. 45 shows a diagram when a plurality of current lines (video lines) is used in the circuit in FIG. 24.

Figure 25:
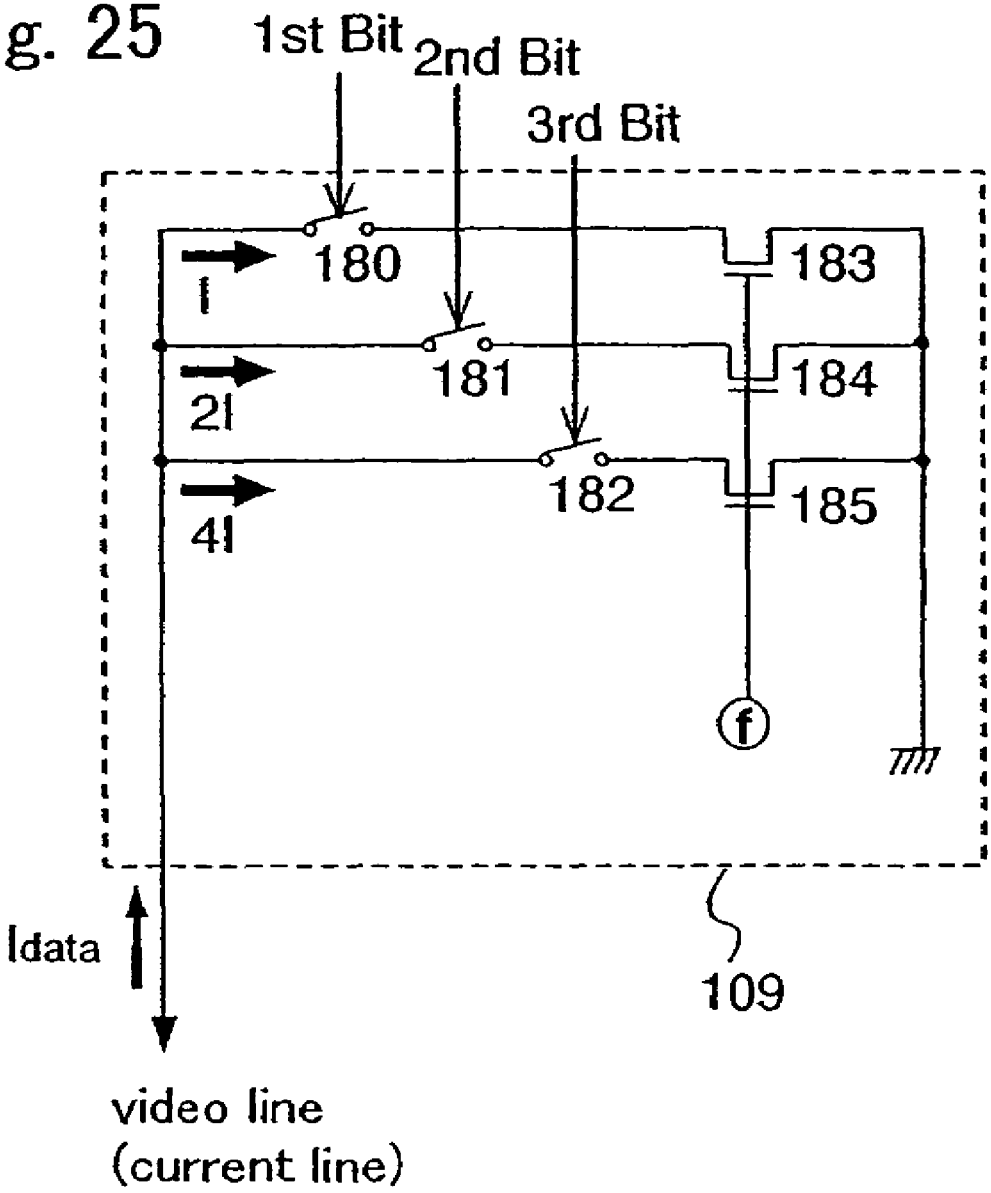
FIG. 25 is a circuit diagram of a video-signal current source.

Subsequently, the video-signal current source 109 with a different configuration from those of FIGS. 23 and 24 will be shown in FIG. 25. In FIG. 25, as compared to the video-signal current source 109 shown in FIG. 23, the operation is the same as that of the video-signal current source 109 shown in FIG. 23 except that the transistors 186, 187, and 188 and the capacitance device 189 are eliminated, and a constant voltage is applied from the exterior to the gate electrodes of the transistor 183 to the transistor 185 via the terminal f; therefore, a description thereof will be omitted in this embodiment.

In the case of FIG. 25, voltage (gate voltage) is applied to the gate electrodes of the transistors 183 to 185 through the terminal f. However, even if the same gate voltage is applied to the transistors 183 to 185, the values of the current flowing between the source and the drain of the transistors 183 to 185 vary with the variations in the characteristics of the transistors 183 to 185. Accordingly, current flowing in the video line (current line) also varies. Also, since the characteristics vary by temperature, the values of currents supplied from the transistors 183 to 185 vary as well.

On the other hand, in the case of FIG. 23 and FIG. 24, current as well as voltage can be applied through the terminal f. When current is applied, the value of current does not vary if the transistors 183 to 186 have the identical characteristics. Even if the characteristics vary by temperature, the characteristics of the transistors 183 to 186 also vary at the same level as that; thus, the current value does not vary.

Figure 46:
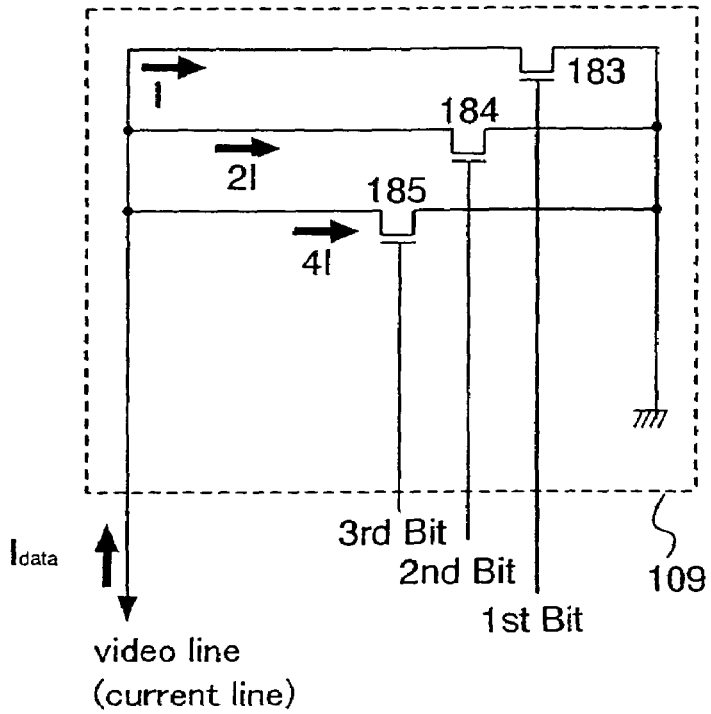
FIG. 46 is a circuit diagram of a video-signal current source.
Figure 47:
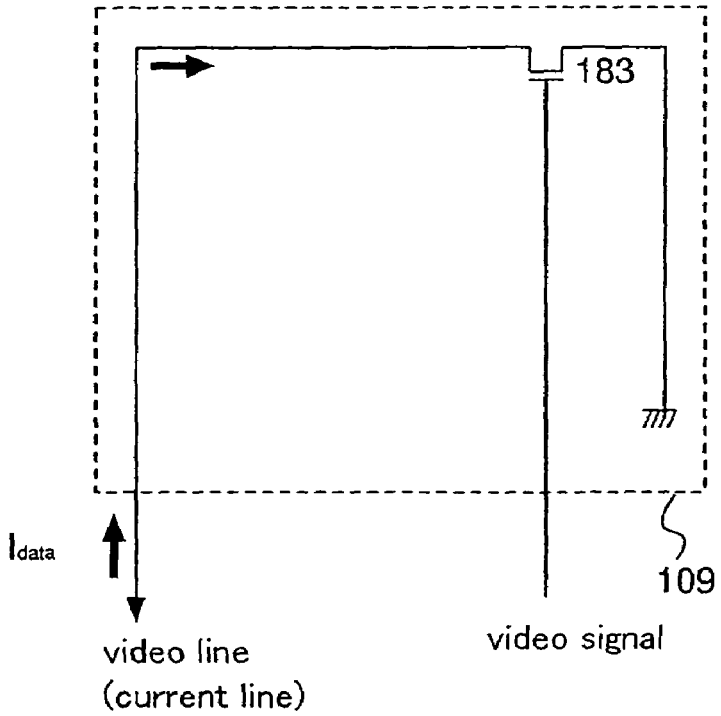
FIG. 47 is a circuit diagram of a video-signal current source.

In FIG. 25, voltage (gate voltage) is applied to the transistors 183 to 185 through the terminal f, which does not vary by the video signal. In FIG. 25, the video signal controls whether current flows in the current line by controlling the switches 180 to 182. Therefore, as in FIG. 46, voltage (gate voltage) is applied to the gate electrodes of the transistors 183 to 185, wherein the voltage may be varied by the video signal. Thus, the magnitude of the video-signal current can be varied. Also, as in FIG. 47, voltage (gate voltage) applied to the gate electrode of the transistor 183 may be analog voltage, wherein the voltage and thus current may be varied depending on the gray level.

Figure 9:
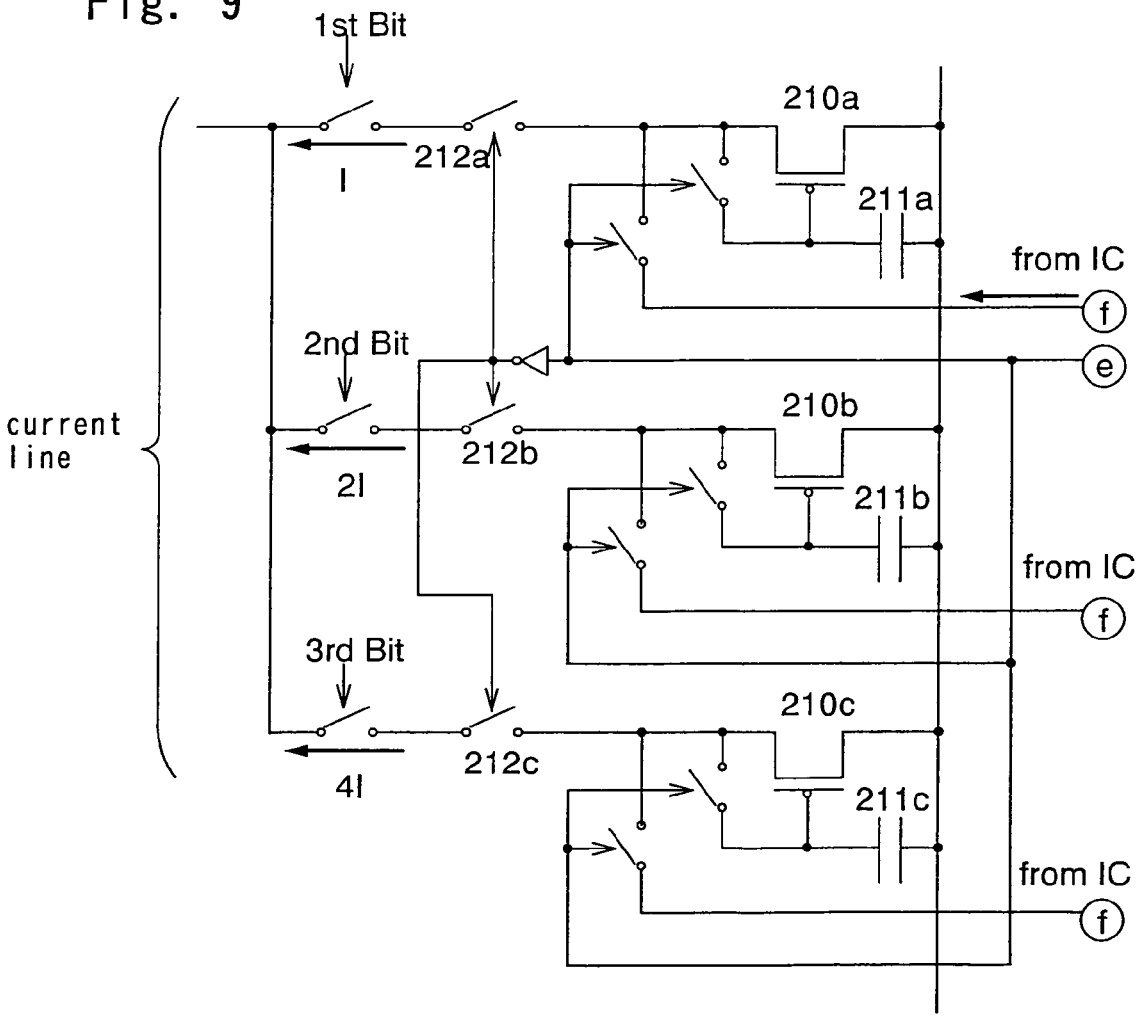
FIG. 9 is a circuit diagram of a video-signal current source.

Subsequently, the video-signal current source 109 with a different configuration from those of FIGS. 23, 24, and 25 is shown in FIG. 9. While, FIG. 23 employed the current source circuit of FIG. 6C, FIG. 9 employs the current source circuit of FIG. 6A.

Figure 10:
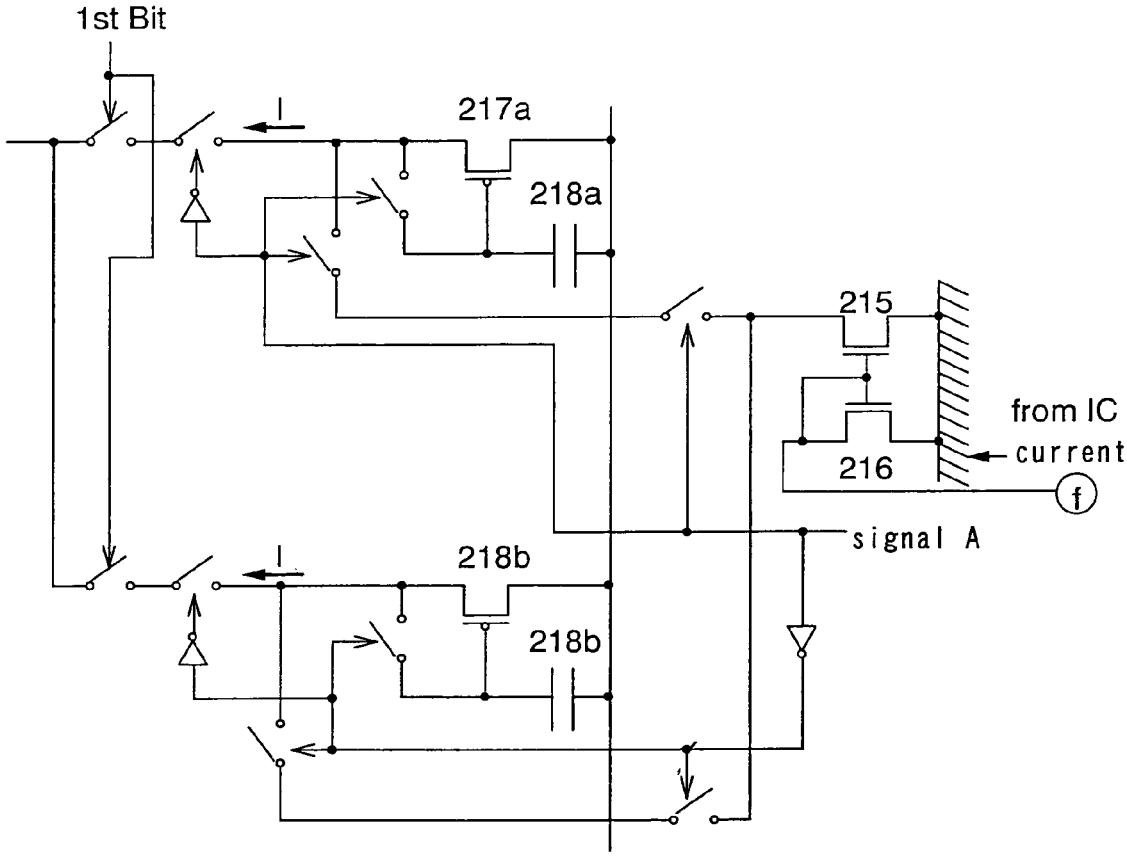
FIG. 10 is a circuit diagram of a video-signal current source.

In the case of FIG. 23, when the characteristics of the transistors 183 to 186 vary, the current values also vary. On the other hand, in FIG. 9, setting operation is performed for each current source, thus reducing the effects of the variations of the transistors. However, in the case of FIG. 9, inputting operation (operation of supplying current to the current line) cannot be performed simultaneously with the setting operation. Accordingly, the setting operation must be performed during the period of time the inputting operation is not performed. In order to allow the setting operation to be performed also during the inputting operation, a plurality of current source circuits may be arranged, as in FIG. 10, so that while one current source circuit performs the setting operation, the other current source circuit can perform the inputting operation.

This embodiment may freely be combined with the first to fifth embodiments.

Seventh Embodiment

Figure 11A:
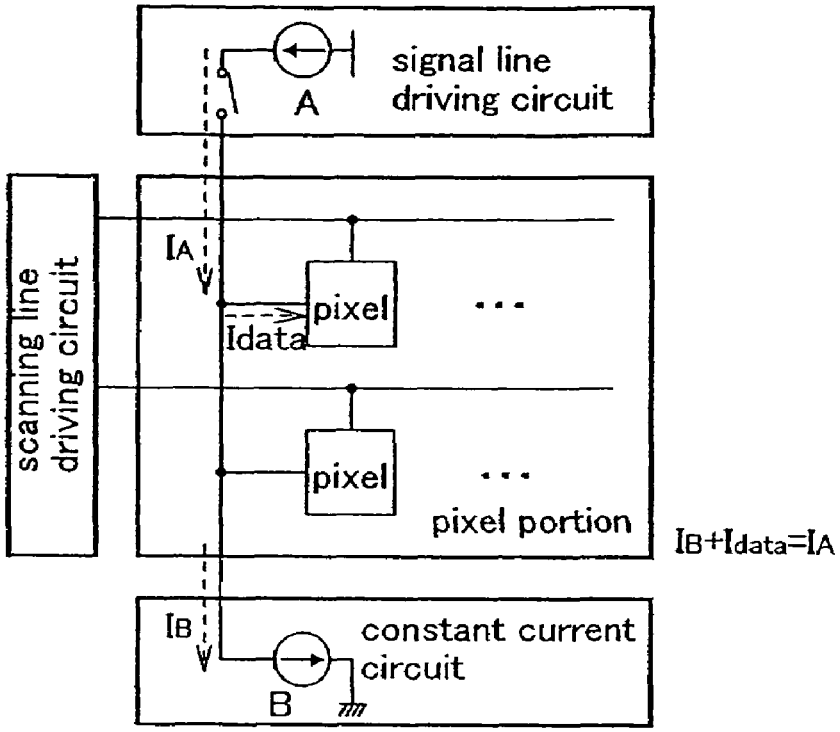
FIGS. 11A-11B are circuit diagrams of a video-signal current source.

An embodiment of the present invention will be described with reference to FIG. 11. Referring to FIG. 11A, a signal-line drive circuit is disposed above a pixel section; and a constant current circuit is disposed below, wherein a current source A is disposed in the signal-line drive circuit and a current source B is disposed in the constant current circuit. Equation $I_A=I_B+I_{data}$ is established where currents supplied from the current source s A and B are $I_A$ and $I_B$, respectively, and signal current supplied to the pixels is $I_{data}$. Setting is made so that currents are supplied from both current source s A and B when signal current is written into the pixels. At that time, increasing $I_A$ and $I_B$ can increase the writing speed of the signal current to the pixels.

At that time, the setting operation for the current source B is performed using the current source A. Current that is obtained by subtracting the current of the current source B from the current fed from the current source A flows to the pixels. Therefore, the setting operation for the current source B using the current source A can reduce the effects of noise and so on.

Figure 11B:
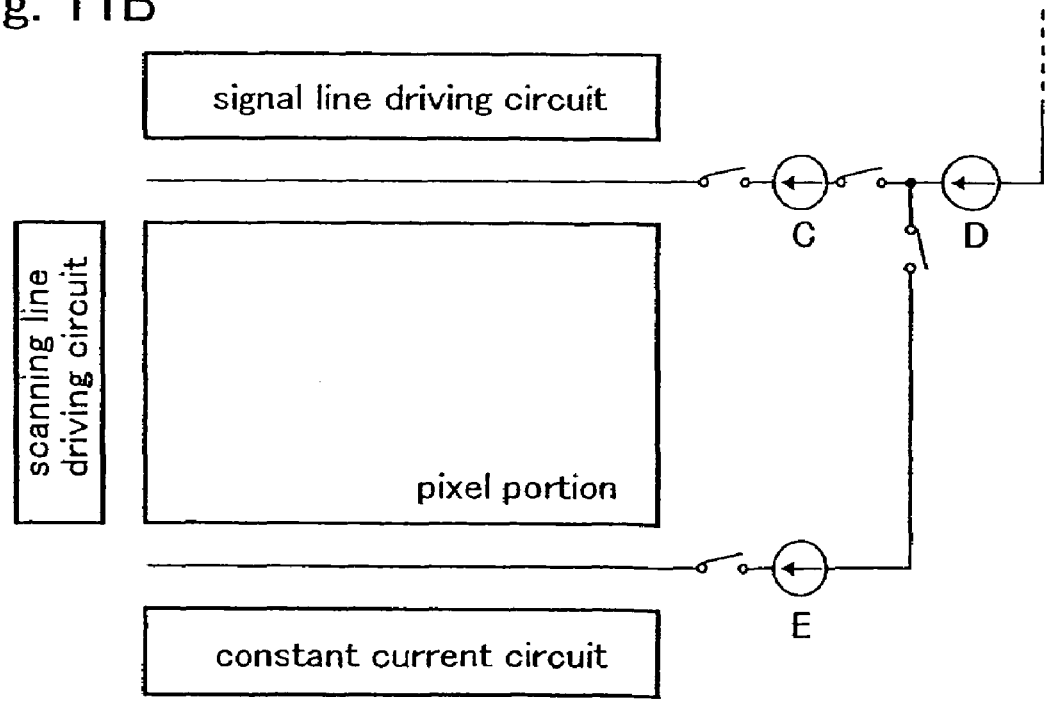

Referring to FIG. 11B, video-signal constant current source s (hereinafter, referred to as constant current source s) C and E are arranged above and below the pixel section, respectively. Setting operation for the current source circuits disposed in the signal-line drive circuit and the constant current circuit is performed using the current source s C and E. A current source D serves as a current source for setting the current source s C and E, to which video-signal current is supplied from the exterior.

In FIG. 11B, the constant current circuit arranged below may be a signal-line drive circuit. This allows the video-signal drive circuits to be arranged both above and below, which control the upper and lower half of a screen (the whole pixel section), respectively. With such an arrangement, two columns of pixels can simultaneously be controlled. Therefore, the time for setting operation (signal inputting operation) for the current source s of the signal-line drive circuit, the pixels, and the current source s for the pixels can be increased, thus allowing more accurate setting.

This embodiment can freely be combined with the first to sixth embodiments.

EXAMPLES

Example 1

Figure 14A:
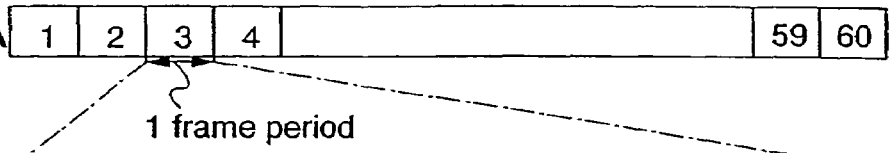
FIGS. 14A-14D are explanatory views of a driving method of a light emitting device according to the present invention.

In this example, the time gradation method will be described in detail with reference to FIG. 14. In display devices such as liquid crystal display devices and light emitting devices, a frame frequency is about 60 (Hz). That is, as shown in FIG. 14A, screen rendering is performed about 60 times per second. This enables flickers (flickering of a screen) not to be recognized by the human eyes. At this time, a period during which screen rendering is performed once is called one frame period.

Figure 14B:
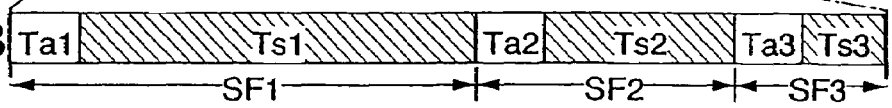

As an example, in Example 1, a description will be made of a time gradation method disclosed in the publication as Patent Document 1. In the time gradation method, one frame period is divided into a plurality of subframe periods. In many cases, the number of divisions is identical to the number of gradation bits. For the sake of a simple description, a case where the number of divisions is identical to the number of gradation bits. Specifically, since the 3-bit gradation is employed in this example, an example is shown in which one frame period is divided into three subframe periods SF1 to SF3 (FIG. 14B).

Each of the subframe periods includes an address (writing) period Ta and a sustain (light emission) period (Ts). The address period is a period during which a video signal is written to a pixel, and the length thereof is the same among respective subframe periods. The sustain period is a period during which the light emitting element emits light in response to the video signal written in the address period Ta. At this time, the sustain periods SF1 to SF3 are set at a length ratio of Ts1:Ts2:Ts3=4:2:1. More specifically, the length ratio of n sustain periods is set to $2^{(n-1)}:2^{(n-2)}: \ldots :2^1:2^0$. Depending on whether a light emitting element performs emission in which one of the sustain periods, the length of the period during which each pixel emits light in one frame period is determined, and the gradation representation is thus performed.

Figure 16A:
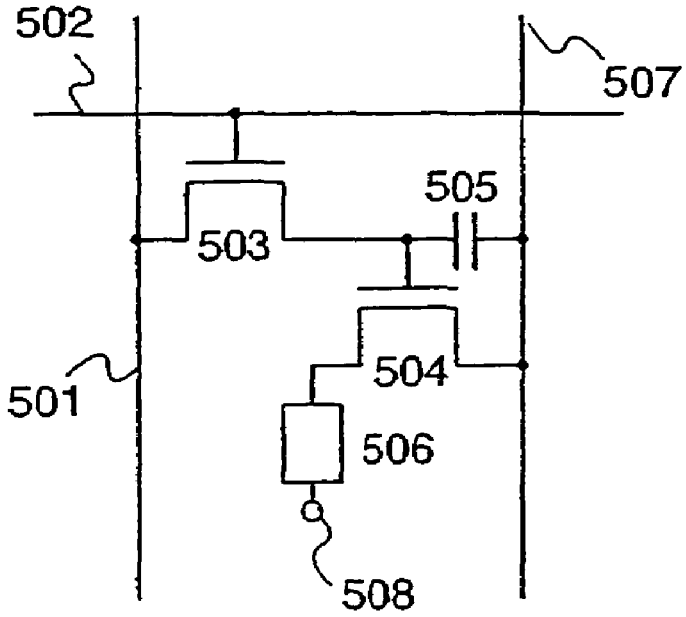
Fig. 16A PRIOR ART
FIGS. 16A-16B are circuit diagrams of a pixel in a light emitting device.
Figure 16B:
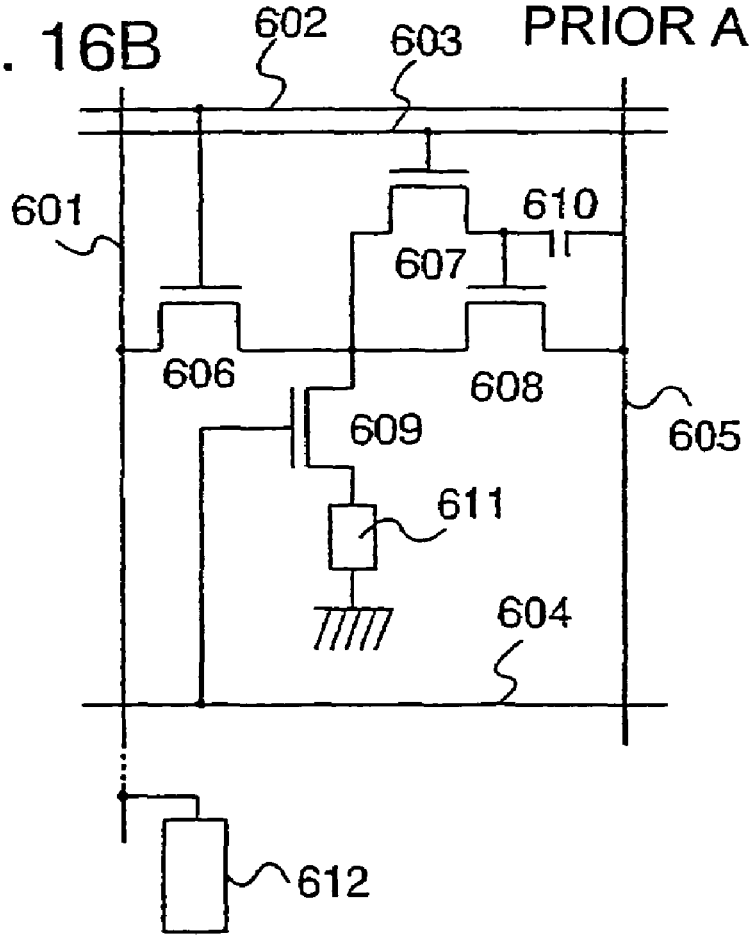
Fig. 16B PRIOR ART
Figure 18A:
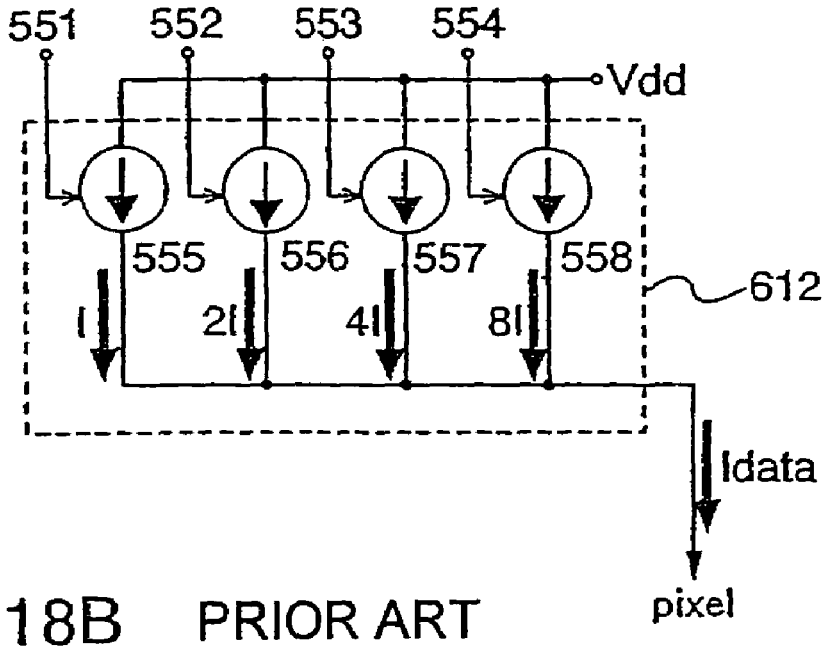
Fig. 18A PRIOR ART
FIGS. 18A-18B are views of a current source circuit.
Figure 18B:
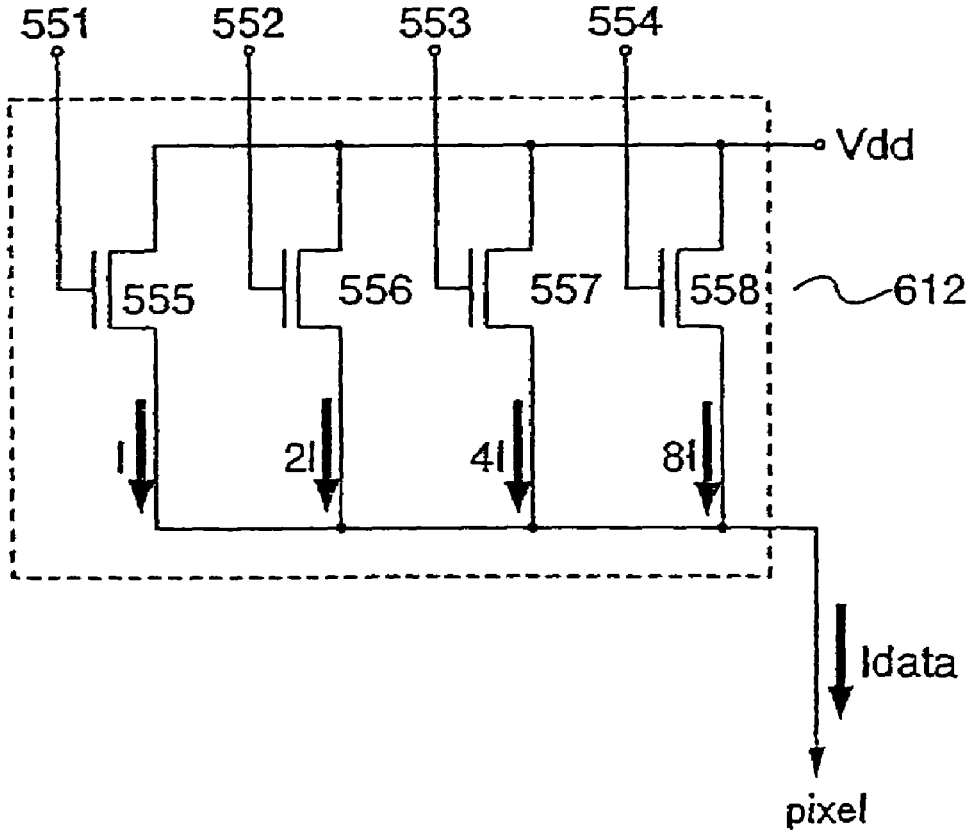
Fig. 18B PRIOR ART

Next, a specific operation of a pixel employing the time gradation method will be described. In this example, a description thereof will be made referring to the pixel shown in FIG. 16B. A current input method is applied to the pixel shown in FIG. 16B.

First, the following operation is performed during the address period Ta. A first scanning line 602 and a second scanning line 603 are selected, and TFTs 606 and 607 are turned ON. A current flowing through a signal line 601 at this time is used as a signal current $I_{data}$. Then, when a predetermined charge has been accumulated in a capacitor device 610, selection of the first and second scanning lines 602 and 603 is terminated, and the TFTs 606 and 607 are turned OFF.

Subsequently, the following operation is performed in the sustain period Ts. A scanning line 604 is selected, and a TFT 609 is turned ON. Since the predetermined charge that has been written is stored in the capacitor device 610, the TFT 608 is already turned ON, and a current identical with the signal current $I_{data}$ flows thereto from a current line 605. Thus, a light emitting element 611 emits light.

Figure 14C:
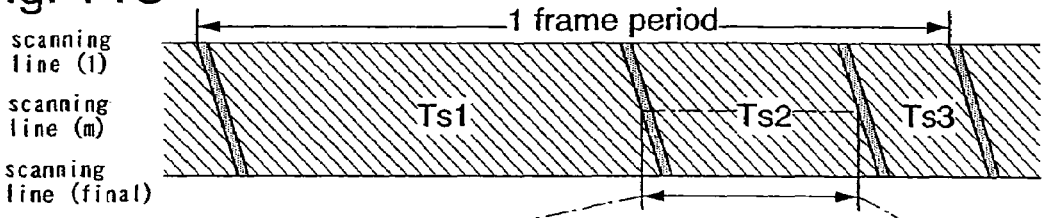

The operations described above are performed in each subframe period, thereby forming one frame period. According to this method, the number of divisions for subframe periods may be increased to increase the number of display gradations. The order of the subframe periods does not necessarily need to be the order from an upper bit to a lower bit as shown in FIGS. 14B and 14C, and the subframe periods may be disposed at random within one frame period. In addition, the order may be variable within each frame period.

Figure 14D:
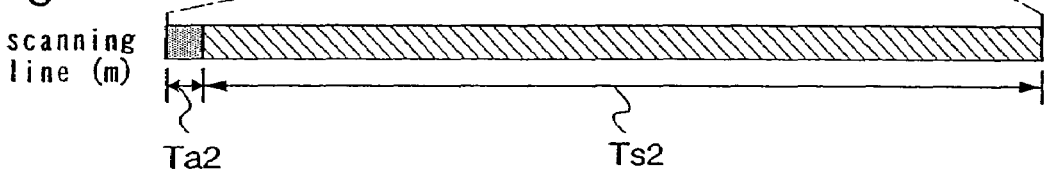

Further, a subframe period SF2 of an m-th scanning line is shown in FIG. 14D. As shown in FIG. 14D, in the pixel, upon termination of an address period Ta2, a sustain period Ts2 is immediately started.

This example may be arbitrarily combined with Embodiments 1 to 7.

Example 2

In this example, example structures of pixel circuits provided in the pixel portion will be described with reference to FIG. 13.

Note that a pixel of any structure may be applicable as long as the structure includes a current input portion.

Figure 13A:
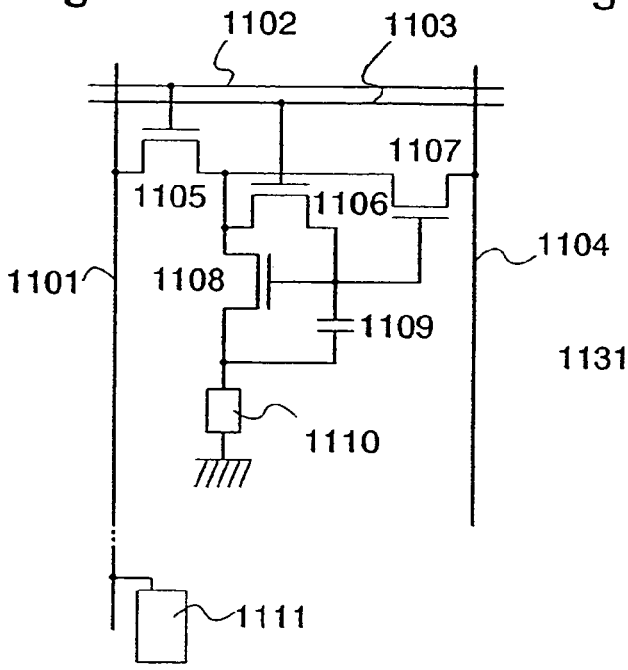
FIGS. 13A-13C are circuit diagrams of pixels of a light emitting device.

A pixel shown in FIG. 13A includes a signal line 1101, first and second scanning lines 1102 and 1103, a current line (power supply line) 1104, a switching TFT 1105, a holding TFT 1106, a driving TFT 1107, a conversion driving TFT 1108, a capacitor device 1109, and a light emitting element 1110. Each signal line is connected to a current source circuit 1111.

Note that the current source circuit 1111 corresponds to the current source circuit 420 disposed in the signal line drive circuit 403.

The gate electrode of the switching TFT 1105 is connected to the first scanning line 1102, a first electrode thereof is connected to the signal line 1101, and a second electrode thereof is connected to a first electrode of the driving TFT 1107 and a first electrode of the conversion driving TFT 1108. The gate electrode of the holding TFT 1106 is connected to the second scanning line 1103, a first electrode thereof is connected to the signal line 1102, and a second electrode thereof is connected to the gate electrode of the driving TFT 1107 and the gate electrode of the conversion driving TFT 1108. A second electrode of the driving TFT 1107 is connected to the current line (power supply line) 1104, and a second electrode of the conversion driving TFT 1108 is connected to one of the electrodes of the light emitting element 1110. The capacitor device 1109 is connected between the gate electrode of the conversion driving TFT 1108 and a second electrode thereof, and retains a gate-source voltage of the conversion driving TFT 1108. The current line (power supply line) 1104 and the other electrode of the light emitting element 1110 are respectively input with predetermined potentials and have mutually different potentials.

The pixel of FIG. 13A corresponds to the case where a circuit of FIG. 29B is applied to a pixel. However, since the current-flow direction is different, the transistor polarity is reverse. The driving TFT 1107 of FIG. 13A corresponds to a TFT 126 of FIG. 29B, the conversion driving TFT 1108 of FIG. 13A corresponds to a TFT 122 of FIG. 29B, and the holding TFT 1106 of FIG. 13A corresponds to the TFT 124 of FIG. 29B.

Figure 13B:
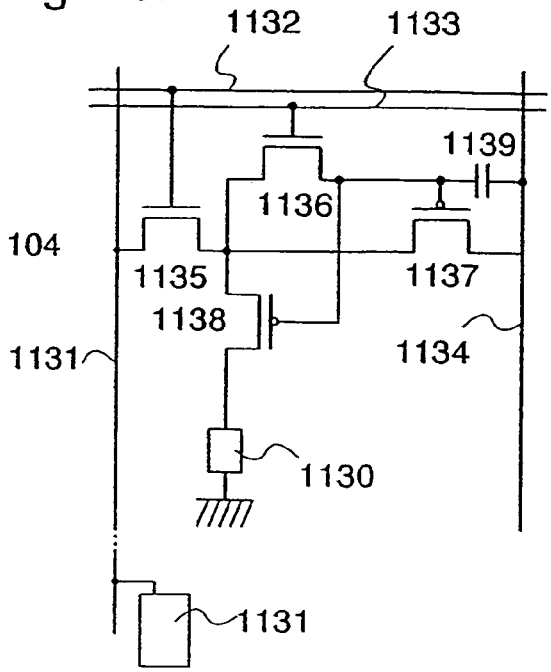

A pixel shown in FIG. 13B includes a signal line 1151, first and second scanning lines 1142 and 1143, a current line (power supply line) 1144, a switching TFT 1145, a holding TFT 1146, a conversion driving TFT 1147, a driving TFT 1148, a capacitor device 1149, and a light emitting element 1140. The signal line 1151 is connected to a current source circuit 1141.

Note that the current source circuit 1141 corresponds to the current source circuit 420 disposed in the signal line drive circuit 403.

The gate electrode of the switching TFT 1145 is connected to the first scanning line 1142, a first electrode thereof is connected to the signal line 1151, and a second electrode thereof is connected to a first electrode of the driving TFT 1148 and a first electrode of the conversion driving TFT 1148. The gate electrode of the holding TFT 1146 is connected to the second scanning line 1143, a first electrode thereof is connected to the first electrode of the drive TFT 1148, and a second electrode thereof is connected to the gate electrode of the driving TFT 1148 and the gate electrode of the conversion driving TFT 1147. A second electrode of the conversion driving TFT 1147 is connected to the current line (power supply line) 1144, and a second electrode of the conversion driving TFT 1147 is connected to one of the electrodes of the light emitting element 1140. The capacitor device 1149 is connected between the gate electrode of the conversion driving TFT 1147 and a second electrode thereof, and retains a gate-source voltage of the conversion driving TFT 1147. The current line (power supply line) 1144 and the other electrode of the light emitting element 1140 are respectively input with predetermined potentials and have mutually different potentials.

Note that the pixel of FIG. 13B corresponds to the case where a circuit of FIG. 6B is applied to a pixel. However, since the current-flow direction is different, the transistor polarity is reverse. The conversion driving TFT 1147 of FIG. 13B corresponds to a TFT 122 of FIG. 6B, the driving TFT 1138 of FIG. 13B corresponds to a TFT 126 of FIG. 6B, and the holding TFT 1136 of FIG. 13B corresponds to the TFT 124 of FIG. 6B.

Figure 13C:
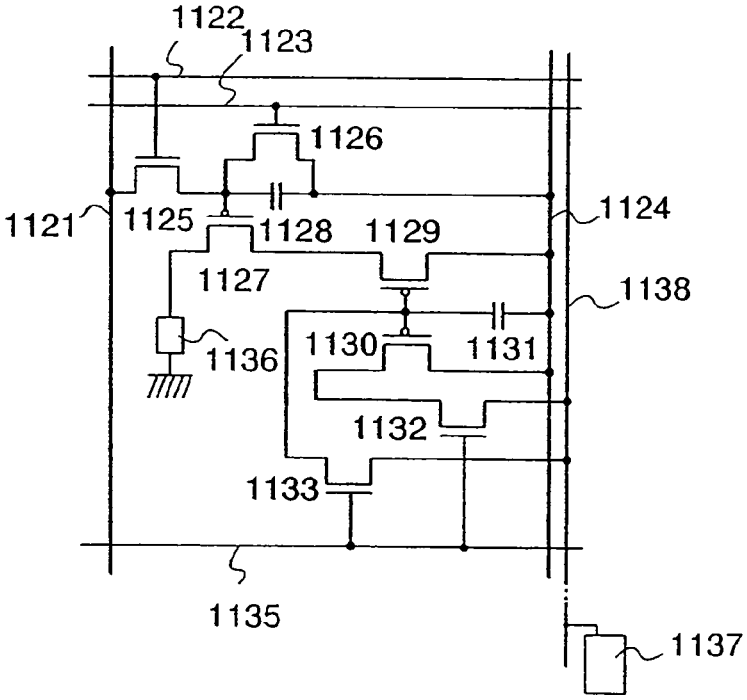

A pixel shown in FIG. 13C includes a signal line 1121, a first scanning line 1122, a second scanning line 1123, a third scanning line 1135, a current line (power supply line) 1124, a current line 1138, a switching TFT 1125, an erasing TFT 1126, a driving TFT 1127, a capacitor device 1128, a current-supply TFT 1129, a mirror TFT 1130, a capacitor device 1131, a current-input TFT 1132, a holding TFT 1133, and a light emitting element 1136. Each signal line is connected to a current source circuit 1137.

The gate electrode of the switching TFT 1125 is connected to the first scanning line 1122, a first electrode of the switching TFT 1125 is connected to the signal line 1121, and a second electrode of the switching TFT 1125 is connected to the gate electrode of the driving TFT 1127 and a first electrode of the erasing TFT 1126. The gate electrode of the erasing TFT 1126 is connected to the second scanning line 1123, and a second electrode of the erasing TFT 1126 is connected to the current line (power supply line) 1124. A first electrode of the driving TFT 1127 is connected to one of the electrodes of the light emitting element 1136, and a second electrode of the driving TFT 1127 is connected to a first electrode of the current-supply TFT 1129. A second electrode of the current-supply TFT 1129 is connected to the current line (power supply line) 1124. One of the electrodes of the capacitor device 1131 is connected to the gate electrode of the current-supply TFT 1129 and the gate electrode of the mirror TFT 1130 and the other electrode thereof is connected to the current line (power supply line) 1124. A first electrode of the mirror TFT 1130 is connected to the current line 1124, and a second electrode of the mirror TFT 1130 is connected to a first electrode of the current-input TFT 1132. A second electrode of the current-input TFT 1132 is connected to the current line (power supply line) 1124, and the gate electrode of the current-input TFT 1132 is connected to the third scanning line 1135. The gate electrode of the current holding TFT 1133 is connected to the third scanning line 1135, a first electrode of the current holding TFT 1133 is connected to the pixel current line 1138, a second electrode of the current holding TFT 1133 is connected to the gate electrode of the current-supply TFT 1129 and the gate electrode of the mirror TFT 1130. The current line (power supply line) 1124 and the other electrode of light emitting element 1136 are input with predetermined potentials and have mutually different potentials.

This example may be arbitrarily combined with Embodiments 1 to 7 and Example 1.

Example 3

In this example, technical devices when performing color display will be described.

With a light emitting element comprised of an organic EL element, the luminance can be variable depending on the color even though a current having the same magnitude is supplied to the light emitting device. In addition, in the case where the light emitting element has deteriorated because of, for example, a time factor, the deterioration degree is variable depending on the color. Thus, when performing color display with a light emitting device using light emitting elements, various technical devices are required to adjust the white balance.

The simplest technique is to change the magnitude of the current that is input to the pixel. To achieve the technique, the magnitude of the video-signal current source should be changed depending on the color.

Another technique is to use circuits as shown in FIGS. 6C to 6E for the pixel, signal line drive circuit, video-signal current source, and the like. In the circuits as shown in FIGS. 6C to 6E, the W/L ratio of two transistors forming the current mirror circuit is changed depending on the color. Thus, the magnitude of the current to be input to the pixel can be changed depending on the color.

Still another technique is to change the length of a lightening period. The technique can be applied to either of the case where the time gradation method is employed and the case where the time gradation method is not employed. According to the technique, the luminance of each pixel can be adjusted.

The white balance can be easily adjusted by using any one of the techniques or a combination thereof.

This example may be arbitrarily combined with Embodiments 1 to 7 and Examples 1 and 2.

Example 4

Figure 12A:
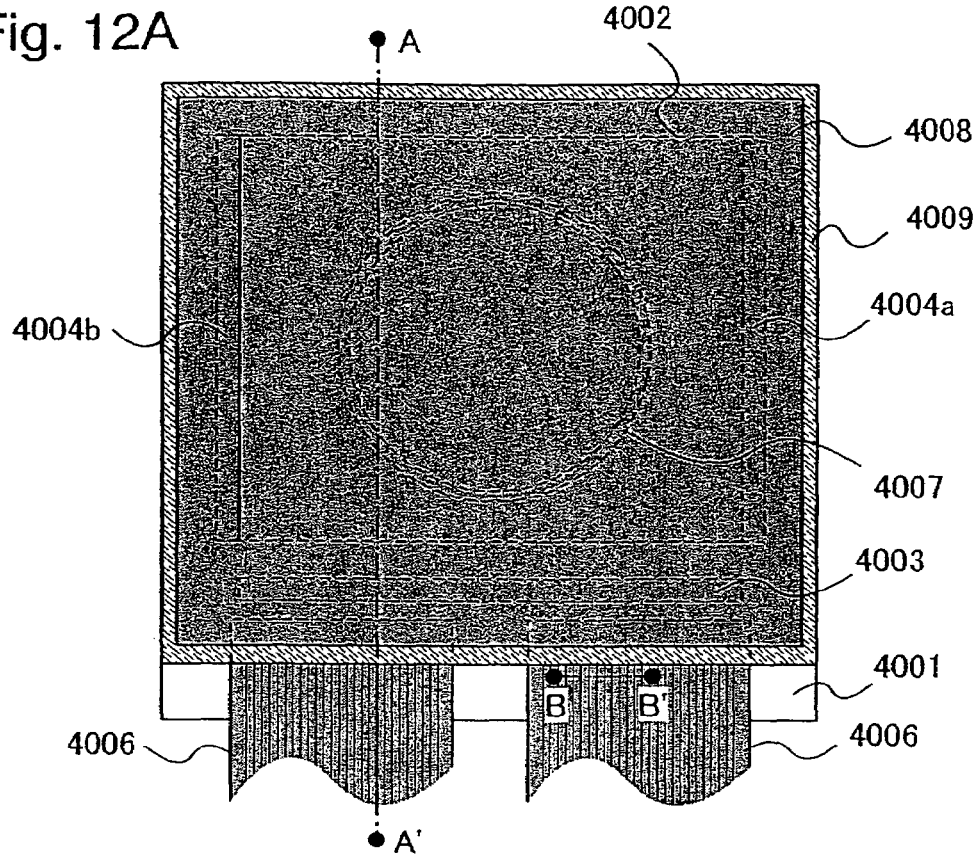
FIGS. 12A-12C are views of the appearance of a light emitting device according to the present invention.
Figure 12B:
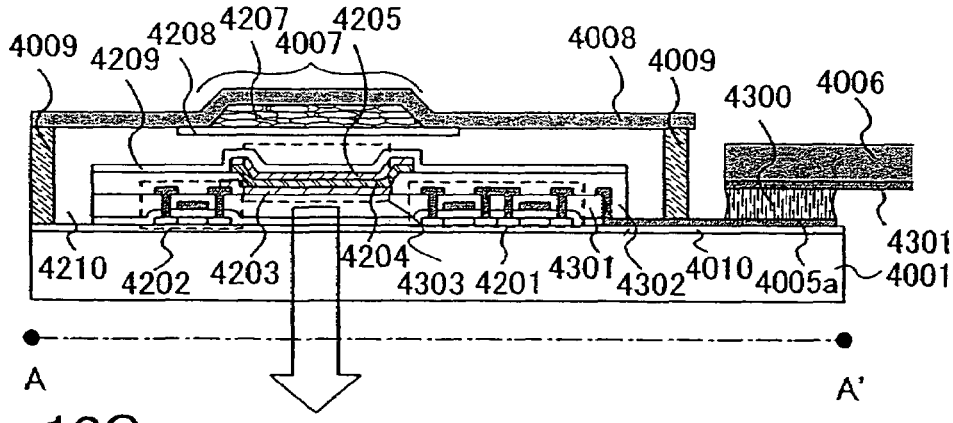
Figure 12C:
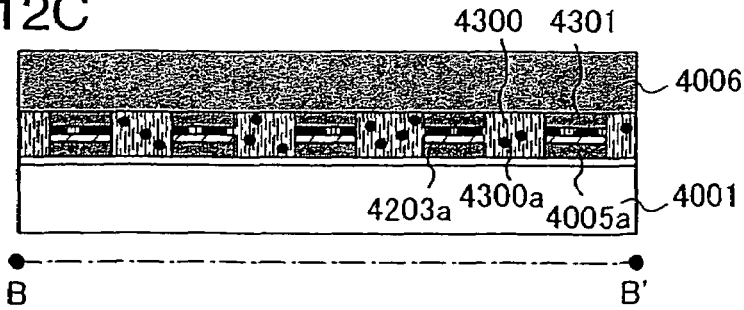

In this example, the appearances of the light emitting devices (semiconductor devices) of the present invention will be described using FIG. 12. FIG. 12A is a top view of a light emitting device formed such that an element substrate on which transistors are formed is sealed with a sealing material; FIG. 12B is a cross-sectional view taken along the line A-A' of FIG. 12A; and FIG. 12C is a cross-sectional view taken along the line B-B' of FIG. 12A.

A sealing material 4009 is provided so as to enclose a pixel portion 4002, a source signal line drive circuit 4003, and gate signal line drive circuits 4004*a* and 4004*b* that are provided on a substrate 4001. In addition, a sealing material 4008 is provided over the pixel portion 4002, the source signal line drive circuit 4003, and the gate signal line drive circuits 4004*a* and 4004*b*. Thus, the pixel portion 4002, the source signal line drive circuit 4003, and the gate signal line drive circuits 4004*a* and 4004*b* are sealed by the substrate 4001, the sealing material 4009, and the sealing material 4008 with a filler material 4210.

The pixel portion 4002, the source signal line drive circuit 4003, and the gate signal line drive circuits 4004*a* and 4004*b*, which are provided over the substrate 4001, include a plurality of TFTs. FIG. 12B representatively shows a driving TFT (incidentally, an n-channel TFT and a p-channel TFT are shown in this example) 4201 included in the source signal line drive circuit 4003, and an erasing TFT 4202 included in the pixel portion 4002, which are formed on a base film 4010.

In this example, a p-channel TFT or an n-channel TFT that is manufactured according to a known method is used for the driving TFT 4201, and an n-channel TFT manufactured according to a known method is used for the erasing TFT 4202.

An interlayer insulating film (leveling film) 4301 is formed on the driving TFT 4201 and the erasing TFT 4202, and a pixel electrode (anode) 4203 for being electrically connected to a drain of the erasing TFT 4202 is formed thereon. A transparent conductive film having a large work function is used for the pixel electrode 4203. For the transparent conductive film, a compound of indium oxide and tin oxide, a compound of indium oxide and zinc oxide, zinc oxide, tin oxide, or indium oxide can be used. Alternatively, the transparent conductive film added with gallium may be used.

An insulating film 4302 is formed on the pixel electrode 4203, and the insulating film 4302 is formed with an opening portion formed on the pixel electrode 4203. In the opening portion, a light emitting layer 4204 is formed on the pixel electrode 4203. The light emitting layer 4204 may be formed using a known light emitting material or inorganic light emitting material. As the light emitting material, either of a low molecular weight (monomer) material and a high molecular weight (polymer) material may be used.

As a forming method of the light emitting layer 4204, a known vapor deposition technique or coating technique may be used. The structure of the light emitting layer 4204 may be either a laminate structure, which is formed by arbitrarily combining a hole injection layer, a hole transportation layer, a light-emitting layer, an electron transportation layer, and an electron injection layer, or a single-layer structure.

Formed on the light emitting layer 4204 is a cathode 4205 formed of a conductive film (representatively, a conductive film containing aluminum, copper, or silver as its main constituent, or a laminate film of the conductive film and another conductive film) having a light shielding property. Moisture and oxygen existing on an interface of the cathode 4205 and the light emitting layer 4204 are desirably eliminated as much as possible. For this reason, a technical device is necessary in which the light emitting layer 4204 is formed in an nitrogen or noble gas atmosphere, and the cathode 4205 is formed without being exposed to oxygen, moisture, and the like. In this example, the above-described film deposition is enabled using a multi-chamber method (cluster-tool method) film deposition apparatus. In addition, the cathode 4205 is applied with a predetermined voltage.

In the above-described manner, a light emitting element 4303 constituted by the pixel electrode (anode) 4203, the light emitting layer 4204, and the cathode 4205 is formed. A protective film is formed on the insulating film so as to cover the light emitting element 4303. The protective film is effective for preventing, for example, oxygen and moisture, from entering the light emitting element 4303.

Reference numeral 4005*a* denotes a drawing line that is connected to a power supply line and that is electrically connected to a source region of the erasing TFT 4202. The drawing line 4005*a* is passed between the sealing material 4009 and the substrate 4001 and is then electrically connected to an FPC line 4301 of an FPC 4006 via an anisotropic conductive film 4300.

As the sealing material 4008, a glass material, a metal material (representatively, a stainless steel material), ceramics material, or a plastic material (including a plastic film) may be used. As the plastic material, an FRP (fiberglass reinforced plastics) plate, a PVF (polyvinyl fluoride) film, a Mylar film, a polyester film, or an acrylic resin film may be used. Alternatively, a sheet having a structure in which an aluminum foil is sandwiched by the PVF film or the Mylar film may be used.

However, a cover material needs to be transparent when light emission is directed from the light emitting layer to the cover material. In this case, a transparent substance such as a glass plate, a plastic plate, a polyester film, or an acrylic film, is used.

Further, for the filler material 4210, ultraviolet curing resin or a thermosetting resin may be used in addition to an inactive gas, such as nitrogen or argon; and PVC (polyvinyl chloride), acrylic, polyimide, epoxy resin, silicon resin, PVB (polyvinyl butyral), or EVA (ethylene vinyl acetate) may be used. In this example, nitrogen was used for the filler material.

To keep the filler material 4210 to be exposed to a hygroscopic substance (preferably, barium oxide) or an oxygen-absorbable substance, a concave portion 4007 is provided on the surface of the sealing material 4008 on the side of the substrate 4001, and a hygroscopic substance or oxygen-absorbable substance 4207 is disposed. The hygroscopic substance or oxygen-absorbable substance 4207 is held in the concave portion 4007 via a concave-portion cover material 4208 such that the hygroscopic substance or oxygen-absorbable substance 4207 does not diffuse. The concave-portion cover material 4208 is in a fine mesh state and is formed to allow air and moisture to pass through and not to allow the hygroscopic substance or oxygen-absorbable substance 4207 to pass through. The provision of the hygroscopic substance or oxygen-absorbable substance 4207 enables the suppression of deterioration of the light emitting element 4303.

As shown in FIG. 12C, simultaneously with the formation of the pixel electrode 4203, a conductive film 4203*a* is formed so as to be contact with an upper portion of the drawing line 4005*a*.

In addition, the anisotropic conductive film 4300 includes a conductive filler 4300*a*. The substrate 4001 and the FPC 4006 are thermally press-bonded, whereby the conductive film 4203*a* on the substrate 4001 and the FPC line 4301 on the FPC 4006 are electrically connected via the conductive filler 4300*a*.

This example may be arbitrarily combined with Embodiments 1 to 7 and Examples 1 to 3.

Example 5

A light emitting device using a light emitting element is of self-light emitting type, so that in comparison to a liquid crystal display, the light emitting device offers a better visibility in bright portions and a wider view angle. Hence, the light emitting device can be used in display portions of various electronic device.

Electronic device using the light emitting device of the present invention include, for example, video cameras, digital cameras, goggle type displays (head mount displays), navigation systems, audio reproducing devices (such as car audio and audio components), notebook personal computers, game machines, mobile information terminals (such as mobile computers, mobile telephones, portable game machines, and electronic books), and image reproducing devices provided with a recording medium (specifically, devices for reproducing a recording medium such as a digital versatile disc (DVD), which includes a display capable of displaying images). In particular, in the case of mobile information terminals, since the degree of the view angle is appreciated important, the terminals preferably use the light emitting device. Practical examples thereof are shown in FIG. 22.

Figure 22A:
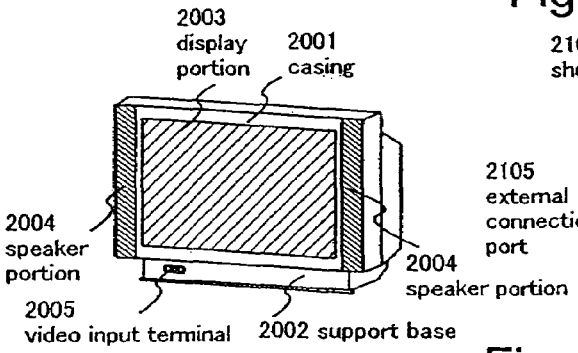
FIGS. 22A-22H are views of an electronic device to which a light emitting device according to the present invention is applied.

FIG. 22A shows a light emitting device, which contains a casing 2001, a support base 2002, a display portion 2003, a speaker portion 2004, a video input terminal 2005, and the like. The light emitting device of the present invention can be applied to the display portion 2003. Further, the light emitting device shown in FIG. 22A is completed with the present invention. Since the light emitting device is of self-light emitting type, it does not need a back light, and therefore a display portion that is thinner than a liquid crystal display can be obtained. Note that light emitting devices include all information display devices, for example, personal computers, television broadcast transmitter-receivers, advertisement displays and the like.

Figure 22B:
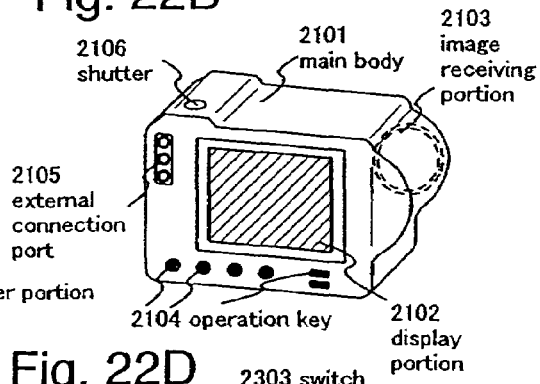

FIG. 22B shows a digital still camera, which contains a main body 2101, a display portion 2102, an image receiving portion 2103, operation keys 2104, an external connection port 2105, a shutter 2106, and the like. The light emitting device of the present invention can be applied to the display portion 2102. Further, the digital still camera shown in FIG. 22B is completed with the present invention.

Figure 22C:
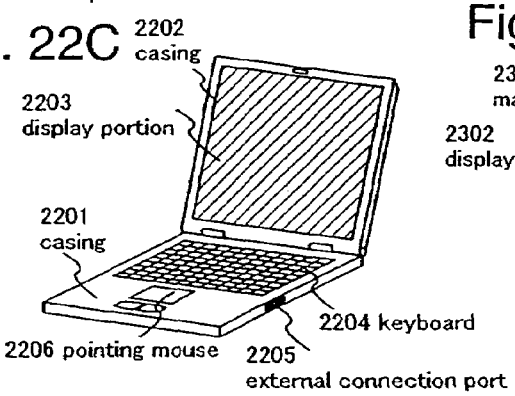

FIG. 22C shows a notebook personal computer, which contains a main body 2201, a casing 2202, a display portion 2203, a keyboard 2204, external connection ports 2205, a pointing mouse 2206, and the like. The light emitting device of the present invention can be applied to the display portion 2203. Further, the light emitting device shown in FIG. 22C is completed with the present invention.

Figure 22D:
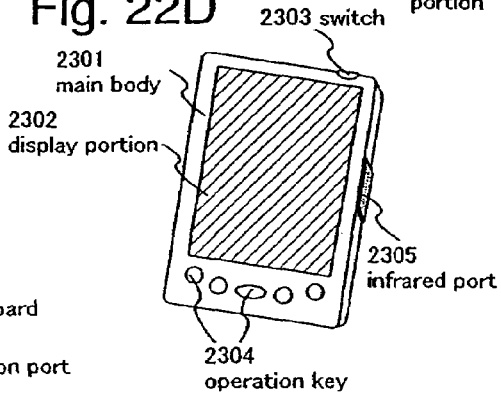

FIG. 22D shows a mobile computer, which contains a main body 2301, a display portion 2302, a switch 2303, operation keys 2304, an infrared port 2305, and the like. The light emitting device of the present invention can be applied to the display portion 2303. Further, the mobile computer shown in FIG. 22D is completed with the present invention.

Figure 22E:
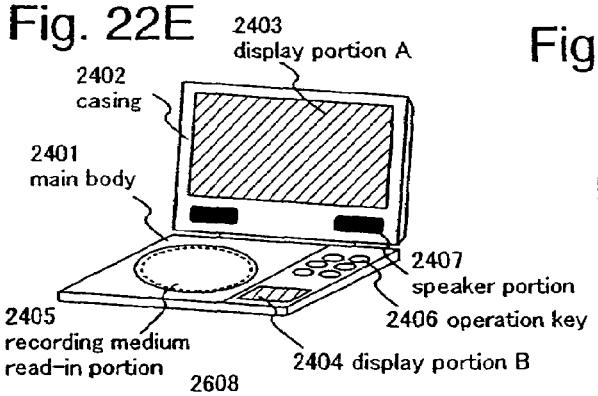

FIG. 22E shows a portable image reproducing device provided with a recording medium (specifically, a DVD reproducing device), which contains a main body 2401, a casing 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information. The light emitting device of the present invention can be used in the display portion A 2403 and in the display portion B 2404. Note that family game machines and the like are included in the image reproducing devices provided with a recording medium. Further, the DVD reproducing device shown in FIG. 22E is completed with the present invention.

Figure 22F:
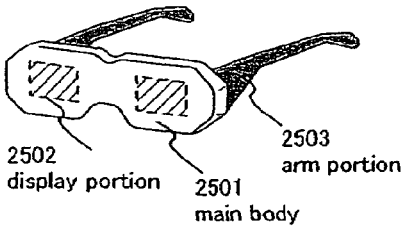

FIG. 22F shows a goggle type display (head mounted display), which contains a main body 2501, a display portion 2502, an arm portion 2503, and the like. The light emitting device of the present invention can be used in the display portion 2502. The goggle type display shown in FIG. 22 F is completed with the present invention.

Figure 22G:
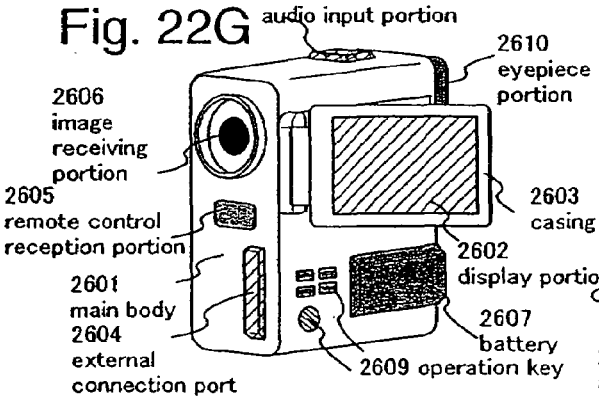

FIG. 22G shows a video camera, which contains a main body 2601, a display portion 2602, a casing 2603, external connection ports 2604, a remote control reception portion 2605, an image receiving portion 2606, a battery 2607, an audio input portion 2608, operation keys 2609, an eyepiece portion 2610, and the like. The light emitting device of the present invention can be used in the display portion 2602. The video camera shown in FIG. 22 G is completed with the present invention.

Figure 22H:
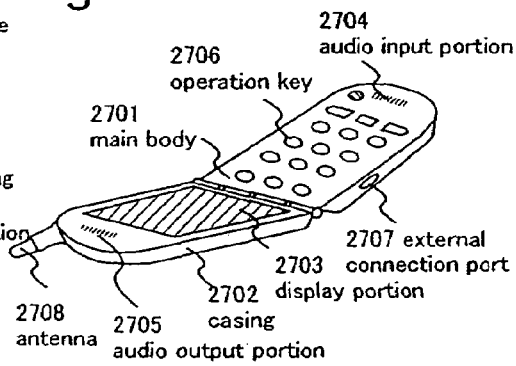

Here, FIG. 22H shows a mobile telephone, which contains a main body 2701, a casing 2702, a display portion 2703, an audio input portion 2704, an audio output portion 2705, operation keys 2706, external connection ports 2707, an antenna 2708, and the like. The light emitting device of the present invention can be used in the display portion 2703. Note that, by displaying white characters on a black background, the display portion 2703 can suppress the consumption current of the mobile telephone. Further, the mobile telephone shown in FIG. 22H is completed with the present invention.

When the emission luminance of light emitting materials are increased in the future, the light emitting device will be able to be applied to a front or rear type projector by expanding and projecting light containing image information having been output lenses or the like.

Cases are increasing in which the above-described electronic device displays information distributed via electronic communication lines such as the Internet and CATVs (cable TVs). Particularly increased are cases where moving picture information is displayed. Since the response speed of the light emitting material is very high, the light emitting device is preferably used for moving picture display.

Since the light emitting device consumes the power in light emitting portions, information is desirably displayed so that the light emitting portions are reduced as much as possible. Thus, in the case where the light emitting device is used for a display portion of a mobile information terminal, particularly, a mobile telephone, an audio playback device, or the like, which primarily displays character information, it is preferable that the character information be formed in the light emitting portions with the non-light emitting portions being used as the background.

As described above, the application range of the present invention is very wide, so that the invention can be used for electronic device in all of fields. The electronic device according to this example may use the light emitting device with the structure according to any one of Embodiments 1 to 7 and Examples 1 to 4.

The present invention can reduce the effects of characteristic variations of the TFTs, and can offer a signal line drive circuit capable of supplying a desired signal current to the outside.

The present invention provides a light emitting device as described above in which a signal line drive circuit having a current source circuit is provided. Furthermore, the present invention provides a light emitting device capable of reducing the effects of the characteristic variations of TFTs that constitute both pixels and drive circuits and supplying a desired signal current $I_{data}$ to light-emitting elements using the pixels with a circuit configuration in which the effects of the characteristic variations of TFTs are reduced.

What is claimed is:

1. A signal-line drive circuit comprising:
- a shift register;
- a video-signal current source;
- a circuit for supplying a latch pulse;
- a latch circuit comprising:
  - a first switch electrically connected to the video-signal current source;
  - a second switch electrically connected to a signal line;
  - a first logic circuit electrically connected to the shift register, and to the circuit;
  - a second logic circuit electrically connected to the shift register, and to the circuit;
  - a first current source circuit having:
    - a first terminal electrically connected to the first logic circuit;
    - a second terminal electrically connected to the first switch; and
    - a third terminal electrically connected to the second switch; and
  - a second current source circuit having:
    - a fourth terminal electrically connected to the second logic circuit;
    - a fifth terminal electrically connected to the first switch; and
    - a sixth terminal electrically connected to the second switch,
- wherein at least one of the first current source circuit and the second current source circuit comprises a thin film transistor, and
- wherein an integrated circuit is used to form the video-signal current source.

2. A signal-line drive circuit comprising:
- a shift register;
- n video-signal current sources;
- a circuit for supplying a latch pulse;
- (n×m) latch circuits, each of the (n×m) latch circuits comprising:
  - a first switch electrically connected to at least one of the n video-signal current sources;
  - a second switch electrically connected to corresponding one of m signal lines;
  - a first logic circuit electrically connected to the shift register, and to the circuit;

a second logic circuit electrically connected to the shift register, and to the circuit;

a first current source circuit having:

a first terminal electrically connected to the first logic circuit;

a second terminal electrically connected to the first switch; and a third terminal electrically connected to the second switch; and a second current source circuit having:

a fourth terminal electrically connected to the second logic circuit;

a fifth terminal electrically connected to the first switch; and a sixth terminal electrically connected to the second switch, wherein each of n and m is a natural number more than 1, wherein values of currents to be supplied from the n video-signal current sources are set at $2^0:2^1:\ldots:2^{n-1}$, wherein at least one of the first current source circuit and the second current source circuit comprises a thin film transistor, and wherein an integrated circuit is used to form the n video-signal current sources.

3. The signal-line drive circuit according to claim 1, wherein at least one of the first current source circuit and the second current source circuit comprises:

a transistor; and a capacitive element, wherein the capacitive element holds a voltage between a gate terminal of the transistor and a source terminal of the transistor, when a drain terminal and the gate terminal of the transistor are short-circuited and a current from the video-signal current source is flowing through the transistor.

4. The signal-line drive circuit according to claim 2, wherein at least one of the first current source circuit and the second current source circuit comprises:

a transistor; and a capacitive element, wherein the capacitive element holds a voltage between a gate terminal of the transistor and a source terminal of the transistor, when a drain terminal and the gate terminal of the transistor are short-circuited and a current from corresponding one of the n video-signal current sources is flowing through the transistor.

5. A signal-line drive circuit comprising:

a shift register;

a video-signal current source;

a circuit for supplying a latch pulse;

a latch circuit comprising:

a first switch electrically connected to the video-signal current source;

a second switch electrically connected to a signal line;

a first logic circuit electrically connected to the shift register, and to the circuit;

a second logic circuit electrically connected to the shift register, and to the circuit;

a first current source circuit comprising:

a first transistor; and a first capacitive element electrically connected between a gate terminal of the first transistor and a source terminal of the first transistor; and a second current source circuit comprising:

a second transistor; and a second capacitive element electrically connected between a gate terminal of the second transistor and a source terminal of the second transistor, wherein the gate terminal of the first transistor and a drain terminal of the first transistor are electrically connected via a third switch, wherein the drain terminal of the first transistor is electrically connected to the first switch, and to the second switch, wherein the third switch is controlled by an output of the first logic circuit, wherein the gate terminal of the second transistor and a drain terminal of the second transistor are electrically connected via a fourth switch, wherein the drain terminal of the second transistor is electrically connected to the first switch, and to the second switch, wherein the fourth switch is controlled by an output of the second logic circuit, wherein at least one of the first current source circuit and the second current source circuit comprises a thin film transistor, and wherein an integrated circuit is used to form the video-signal current source.

6. A signal-line drive circuit comprising:

a shift register;

n video-signal current sources;

a circuit for supplying a latch pulse;

(n×m) latch circuits, each of the (n×m) latch circuits comprising:

a first switch electrically connected to at least one of the n video-signal current sources;

a second switch electrically connected to corresponding one of m signal lines;

a first logic circuit electrically connected to the shift register, and to the circuit;

a second logic circuit electrically connected to the shift register, and to the circuit;

a first current source circuit comprising:

a first transistor; and a first capacitive element electrically connected between a gate terminal of the first transistor and a source terminal of the first transistor; and a second current source circuit comprising:

a second transistor; and a second capacitive element electrically connected between a gate terminal of the second transistor and a source terminal of the second transistor, wherein the gate terminal of the first transistor and a drain terminal of the first transistor are electrically connected via a third switch, wherein the drain terminal of the first transistor is electrically connected to the first switch, and to the second switch, wherein the third switch is controlled by an output of the first logic circuit, wherein the gate terminal of the second transistor and a drain terminal of the second transistor are electrically connected via a fourth switch, wherein the drain terminal of the second transistor is electrically connected to the first switch, and to the second switch, wherein the fourth switch is controlled by an output of the second logic circuit, wherein each of n and m is a natural number more than 1, wherein values of currents to be supplied from the n video-signal current sources are set at $2^0:2^1:\ldots:2^{n-1}$, wherein at least one of the first current source circuit and the second current source circuit comprises a thin film transistor, and wherein an integrated circuit is used to form the n video-signal current sources.

7. A signal-line drive circuit comprising:

a shift register;

a video-signal current source;

a circuit for supplying a latch pulse;

a latch circuit comprising:

a first switch electrically connected to the video-signal current source;

a second switch electrically connected to a signal line;

a first logic circuit electrically connected to the shift register, and to the circuit;

a second logic circuit electrically connected to the shift register, and to the circuit;

a first current source circuit comprising:

a first transistor;

a second transistor; and a first capacitive element electrically connected between a gate terminal of the first transistor and a source terminal of the first transistor, and between a gate terminal of the second transistor and a source terminal of the second transistor; and a second current source circuit comprising:

a third transistor;

a fourth transistor; and a second capacitive element electrically connected between a gate terminal of the third transistor and a source terminal of the third transistor, and between a gate terminal of the fourth transistor and a source terminal of the fourth transistor, wherein the gate terminal of the first transistor and a drain terminal of the first transistor are electrically connected via a third switch, wherein the drain terminal of the first transistor is electrically connected to the first switch, wherein a drain terminal of the second transistor is electrically connected to the second switch, wherein the third switch is controlled by an output of the first logic circuit, wherein the gate terminal of the third transistor and a drain terminal of the third transistor are electrically connected via a fourth switch, wherein the drain terminal of the third transistor is electrically connected to the first switch, wherein a drain terminal of the fourth transistor is electrically connected to the second switch, wherein the fourth switch is controlled by an output of the second logic circuit, wherein at least one of the first current source circuit and the second current source circuit comprises a thin film transistor, and wherein an integrated circuit is used to form the video-signal current source.

8. A signal-line drive circuit comprising:

a shift register;

n video -signal current sources;

a circuit for supplying a latch pulse;

(n×m) latch circuits, each of the (n×m) latch circuits comprising:

a first switch electrically connected to at least one of the n video-signal current sources;

a second switch electrically connected to corresponding one of m signal lines;

a first logic circuit electrically connected to the shift register, and to the circuit;

a second logic circuit electrically connected to the shift register, and to the circuit;

a first current source circuit comprising:

a first transistor;

a second transistor; and a first capacitive element electrically connected between a gate terminal of the first transistor and a source terminal of the first transistor, and between a gate terminal of the second transistor and a source terminal of the second transistor; and a second current source circuit comprising:

a third transistor;

a fourth transistor; and a second capacitive element electrically connected between a gate terminal of the third transistor and a source terminal of the third transistor, and between a gate terminal of the fourth transistor and a source terminal of the fourth transistor, wherein the first capacitive element and a drain terminal of the first transistor are electrically connected via a third switch, wherein the drain terminal of the first transistor is electrically connected to the first switch, wherein a drain terminal of the second transistor is electrically connected to the second switch, wherein the third switch is controlled by an output of the first logic circuit, wherein the second capacitive element and a drain terminal of the third transistor are electrically connected via a fourth switch, wherein the drain terminal of the third transistor is electrically connected to the first switch, wherein a drain terminal of the fourth transistor is electrically connected to the second switch, wherein the fourth switch is controlled by an output of the second logic circuit, wherein each of n and m is a natural number more than 1, wherein values of currents to be supplied from the n video-signal current sources are set at $2^0:2^1:\ldots:2^{n-1}$, wherein at least one of the first current source circuit and the second current source circuit comprises a thin film transistor, and wherein an integrated circuit is used to form the n video-signal current sources.

9. The signal-line drive circuit according to claim 7, wherein a value of (gate width/gate length) of the first transistor is equal to a value of (gate width/gate length) of the second transistor, and wherein a value of (gate width/gate length) of the third transistor is equal to a value of (gate width/gate length) of the fourth transistor.

10. The signal-line drive circuit according to claim 8, wherein a value of (gate width/gate length) of the first transistor is equal to a value of (gate width/gate length) of the second transistor, and wherein a value of (gate width/gate length) of the third transistor is equal to a value of (gate width/gate length) of the fourth transistor.

11. The signal-line drive circuit according to claim 7, wherein a value of (gate width/gate length) of the first transistor is larger than a value of (gate width/gate length) of the second transistor, and wherein a value of (gate width/gate length) of the third transistor is larger than a value of (gate width/gate length) of the fourth transistor.

12. The signal-line drive circuit according to claim 8, wherein a value of (gate width/gate length) of the first transistor is larger than a value of (gate width/gate length) of the second transistor, and wherein a value of (gate width/gate length) of the third transistor is larger than a value of (gate width/gate length) of the fourth transistor.

13. The signal-line drive circuit according to claim 8, wherein the first current source circuit further comprises:

i fifth switches; and i fifth transistors, wherein each of gate terminals of the i fifth transistors is electrically connected to the gate terminal of the second transistor, wherein each of source terminals of the i fifth transistors is electrically connected to the first capacitive element, wherein each of drain terminals of the i fifth transistors is electrically connected to the second switch via corresponding one of the i fifth switches, wherein each of the i fifth switches is controlled by corresponding one of the n video-signal current sources, wherein the second current source circuit further comprises:

i sixth switches; and i sixth transistors, wherein each of gate terminals of the i sixth transistors is electrically connected to the gate terminal of the fourth transistor, wherein each of source terminals of the i sixth transistors is electrically connected to the second capacitive element, wherein each of drain terminals of the i sixth transistors is electrically connected to the second switch via corresponding one of the i sixth switches, and wherein each of the i sixth switches is controlled by corresponding one of the n video-signal current sources.

14. The signal-line drive circuit according to claim 13, wherein values of (gate width/gate length) of the i fifth transistors are set to a proportion of $2^0:2^1:\ldots:2^{m-1}$, and wherein values of (gate width/gate length) of the i sixth transistors are set to a proportion of $2^0:2^1:\ldots:2^{m-1}$.

15. The signal-line drive circuit according to claim 1, wherein at least one of the first current source circuit and the second current source circuit comprises a transistor, and wherein the transistor operates in a saturated area.

16. The signal-line drive circuit according to claim 2, wherein at least one of the first current source circuit and the second current source circuit comprises a transistor, and wherein the transistor operates in a saturated area.

17. The signal-line drive circuit according to claim 1, wherein at least one of the first current source circuit and the second current source circuit comprises a transistor, and wherein an active layer of the transistor comprises polysilicon.

18. The signal-line drive circuit according to claim 2, wherein at least one of the first current source circuit and the second current source circuit comprises a transistor, and wherein an active layer of the transistor comprises polysilicon.

19. A light emitting device comprising the signal-line drive circuit of claim 1 and a pixel section having a plurality of pixels arranged in matrix, wherein each of the plurality of pixels comprises a light-emitting element.

20. A light emitting device comprising the signal-line drive circuit of claim 2 and a pixel section having a plurality of pixels arranged in matrix, wherein each of the plurality of pixels comprises a light-emitting element.

21. The signal-line drive circuit according to claim 5, wherein at least one of the first transistor and the second transistor operates in a saturated area.

22. The signal-line drive circuit according to claim 6, wherein at least one of the first transistor and the second transistor operates in a saturated area.

23. The signal-line drive circuit according to claim 7, wherein at least one of the first transistor, the second transistor, the third transistor and the fourth transistor operates in a saturated area.

24. The signal-line drive circuit according to claim 8, wherein at least one of the first transistor, the second transistor, the third transistor and the fourth transistor operates in a saturated area.

25. The signal-line drive circuit according to claim 5, wherein at least one of the first transistor and the second transistor comprises polysilicon.

26. The signal-line drive circuit according to claim 6, wherein at least one of the first transistor and the second transistor comprises polysilicon.

27. The signal-line drive circuit according to claim 7, wherein at least one of the first transistor, the second transistor, the third transistor and the fourth transistor comprises polysilicon.

28. The signal-line drive circuit according to claim 8, wherein at least one of the first transistor, the second transistor, the third transistor and the fourth transistor comprises polysilicon.

29. A light emitting device comprising the signal-line drive circuit of claim 5 and a pixel section having a plurality of pixels arranged in matrix, wherein each of the plurality of pixels comprises a light-emitting element.

30. A light emitting device comprising the signal-line drive circuit of claim 6 and a pixel section having a plurality of pixels arranged in matrix, wherein each of the plurality of pixels comprises a light-emitting element.

31. A light emitting device comprising the signal-line drive circuit of claim 7 and a pixel section having a plurality of pixels arranged in matrix, wherein each of the plurality of pixels comprises a light-emitting element.

32. A light emitting device comprising the signal-line drive circuit of claim 8 and a pixel section having a plurality of pixels arranged in matrix, wherein each of the plurality of pixels comprises a light-emitting element.

* * * * *